US007260336B2

(12) United States Patent
Shimura et al.

(10) Patent No.: US 7,260,336 B2
(45) Date of Patent: Aug. 21, 2007

(54) IMAGE FORMING APPARATUS AND IMAGE FORMING METHOD FOR PERFORMING DENSITY CONTROL OF TONER IMAGES

(75) Inventors: Hidetsugu Shimura, Nagano-ken (JP); Takashi Hama, Nagano-ken (JP); Yoshihiro Nakashima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/432,347

(22) Filed: May 12, 2006

(65) Prior Publication Data

US 2006/0204261 A1 Sep. 14, 2006

Related U.S. Application Data

(62) Division of application No. 10/476,222, filed as application No. PCT/JP03/01742 on Feb. 18, 2003, now Pat. No. 7,072,597.

(30) Foreign Application Priority Data

| | | |
|---|---|---|
| Feb. 20, 2002 | (JP) | 2002-043542 |
| Mar. 20, 2002 | (JP) | 2002-077971 |
| May 29, 2002 | (JP) | 2002-155075 |
| May 31, 2002 | (JP) | 2002-159006 |
| Jul. 29, 2002 | (JP) | 2002-219723 |

(51) Int. Cl.
*G03G 15/00* (2006.01)

(52) U.S. Cl. ..... 399/49
(58) Field of Classification Search ..... 399/49, 399/59, 60, 74

See application file for complete search history.

(56) References Cited

U.S. PATENT DOCUMENTS

| | | | | |
|---|---|---|---|---|
| 4,502,778 | A * | 3/1985 | Dodge et al. | 399/30 |
| 4,801,980 | A * | 1/1989 | Arai et al. | 399/29 |
| 5,083,160 | A | 1/1992 | Suzuki et al. | |
| 5,245,390 | A * | 9/1993 | Ishigaki et al. | 399/74 |
| 5,497,221 | A * | 3/1996 | Takemoto | 399/74 |
| 5,543,895 | A * | 8/1996 | Katsuhara | 399/59 |
| 6,021,288 | A | 2/2000 | Okuno et al. | |
| 6,226,466 | B1 | 5/2001 | Ojima et al. | |
| 6,336,008 | B1 | 1/2002 | Nakazato et al. | |
| 6,341,203 | B1 | 1/2002 | Nakazato et al. | |
| 6,650,849 | B2 | 11/2003 | Shimura | |
| 6,871,026 | B2 | 3/2005 | Shimura et al. | |
| 6,889,015 | B2 | 5/2005 | Shimura | |
| 7,072,597 | B2 * | 7/2006 | Shimura et al. | 399/49 |
| 2004/0037577 | A1 | 2/2004 | Shimura et al. | |

FOREIGN PATENT DOCUMENTS

| | | | |
|---|---|---|---|
| CN | 1475867 | A | 2/2004 |

(Continued)

*Primary Examiner*—Robert Beatty
(74) *Attorney, Agent, or Firm*—Sughrue Mion, PLLC

(57) ABSTRACT

In a density control technique wherein a density of a toner image formed as a patch image is detected for performing density control based on the detected result, detection errors are decreased so as to properly set a density control factor. The density control factor is optimized based on a variation rate of the patch image densities against a varied density control factor. The detected results of the patch image densities are corrected based on information on an image carrier acquired before the formation of the patch images.

8 Claims, 54 Drawing Sheets

FOREIGN PATENT DOCUMENTS

| | | | | |
|---|---|---|---|---|
| CN | 1477458 | A | | 2/2004 |
| CN | 1487375 | A | | 4/2004 |
| DE | 38 43 672 | A1 | | 7/1989 |
| GB | 2 212 419 | A | | 7/1989 |
| JP | 60-260066 | A | | 12/1985 |
| JP | 1-169468 | A | | 7/1989 |
| JP | 04284466 | A | * | 10/1992 |
| JP | 10268591 | A | * | 10/1998 |
| JP | 11-15217 | A | | 1/1999 |
| JP | 11-30908 | A | | 2/1999 |
| JP | 11-84762 | A | | 3/1999 |
| JP | 11-258872 | A | | 9/1999 |
| JP | 2000081739 | A | * | 3/2000 |
| JP | 2000131900 | A | * | 5/2000 |
| JP | 2000267369 | A | * | 9/2000 |
| JP | 2001-125325 | A | | 5/2001 |

* cited by examiner

FIG. 15A: PARTICLE SIZE DISTRIBUTION
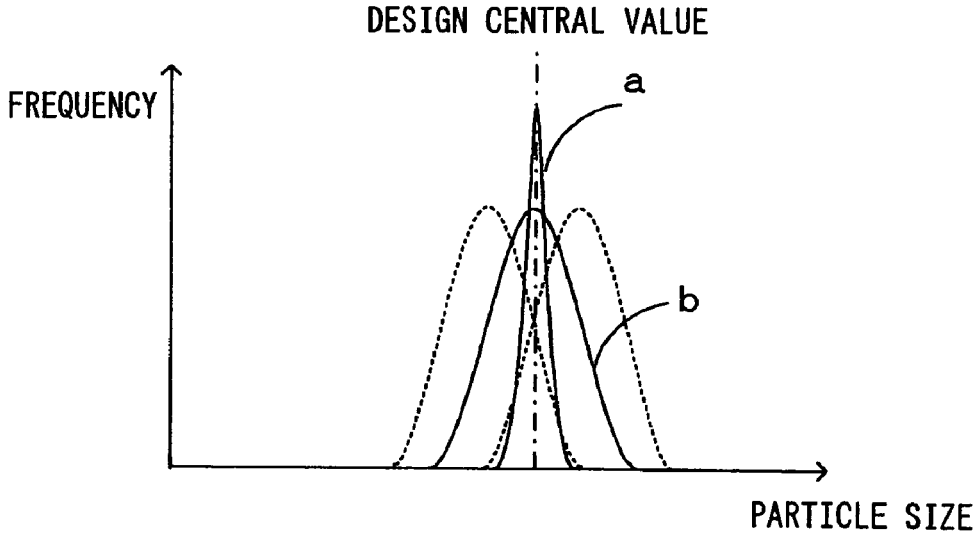
FIG. 15B: VARIATIONS OF OD VALUE
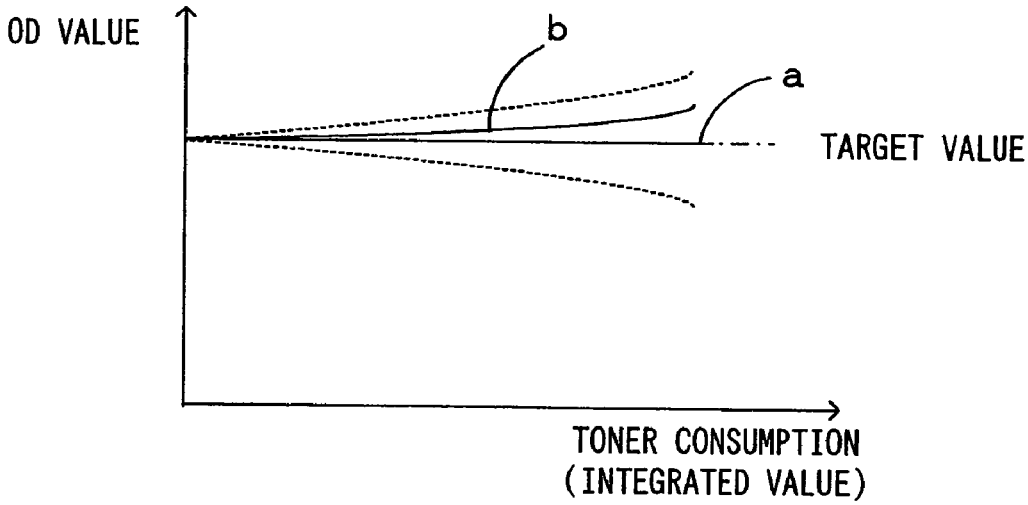

FIG. 17A:

HIGH-DENSITY PATCH IMAGE

| TONER CHARACTER INFORMATION ="0" | | DEVELOPING-ROLLER ROTATION TIME (sec) | | | |
|---|---|---|---|---|---|
| | | ~1325 | ~3975 | ~6625 | ~10600 |
| DOT COUNT VALUE | ~1000000 | 0.990 | 0.988 | 0.984 | 0.982 |
| | ~2000000 | 0.988 | 0.984 | 0.982 | 0.982 |
| | ~6666666 | 0.984 | 0.982 | 0.982 | 0.982 |
| | ~12000000 | 0.982 | 0.982 | 0.982 | 0.982 |

FIG. 17B:

LOW-DENSITY PATCH IMAGE

| TONER CHARACTER INFORMATION ="0" | | DEVELOPING-ROLLER ROTATION TIME (sec) | | | |
|---|---|---|---|---|---|
| | | ~1325 | ~3975 | ~6625 | ~10600 |
| DOT COUNT VALUE | ~1000000 | 0.185 | 0.182 | 0.181 | 0.180 |
| | ~2000000 | 0.182 | 0.181 | 0.180 | 0.180 |
| | ~6666666 | 0.181 | 0.180 | 0.180 | 0.180 |
| | ~12000000 | 0.180 | 0.180 | 0.180 | 0.180 |

FIG. 31A: CALCULATION USING INTERPOLATION (Pave2≧Dpt)
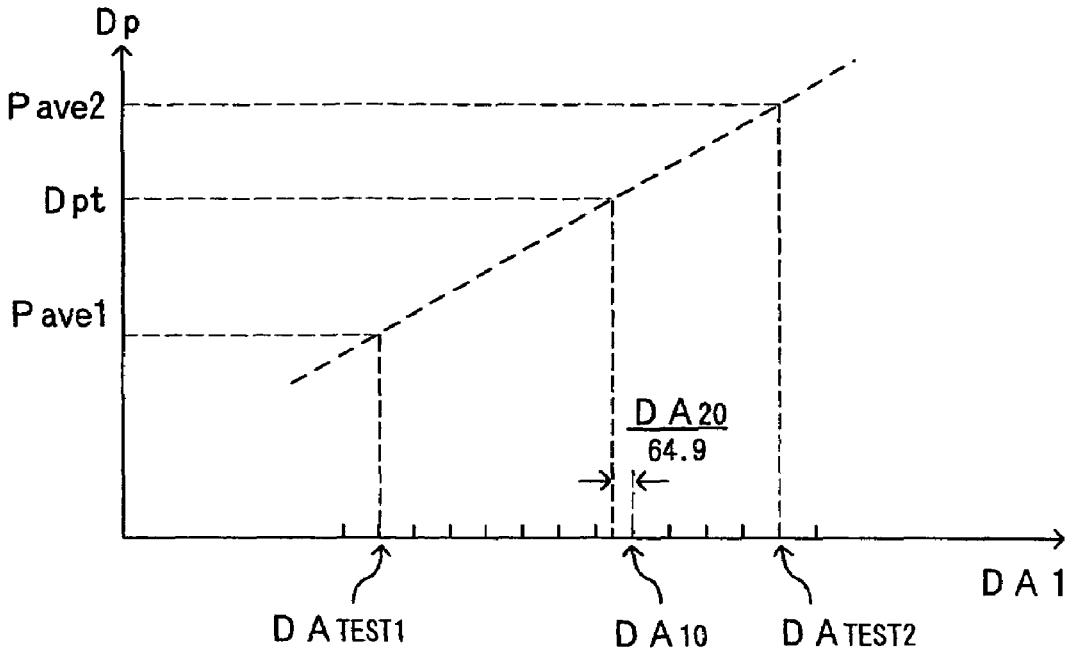
FIG. 31B: CALCULATION USING EXTRAPOLATION (Pave2<Dpt)
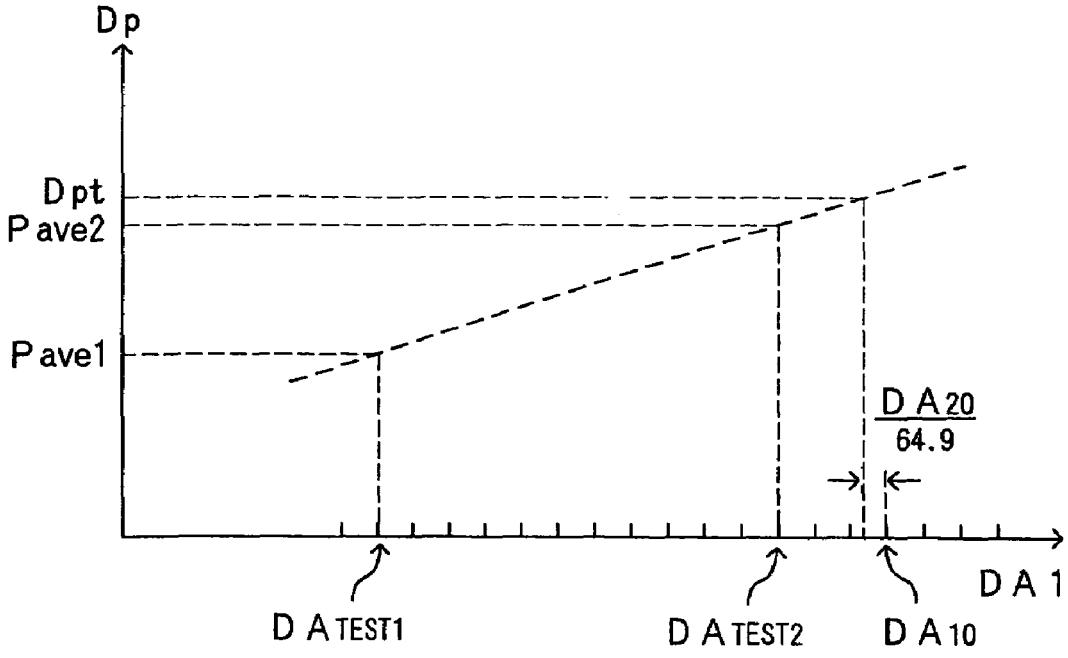

FIG. 36A: BEFORE PATCH IMAGE FORMATION
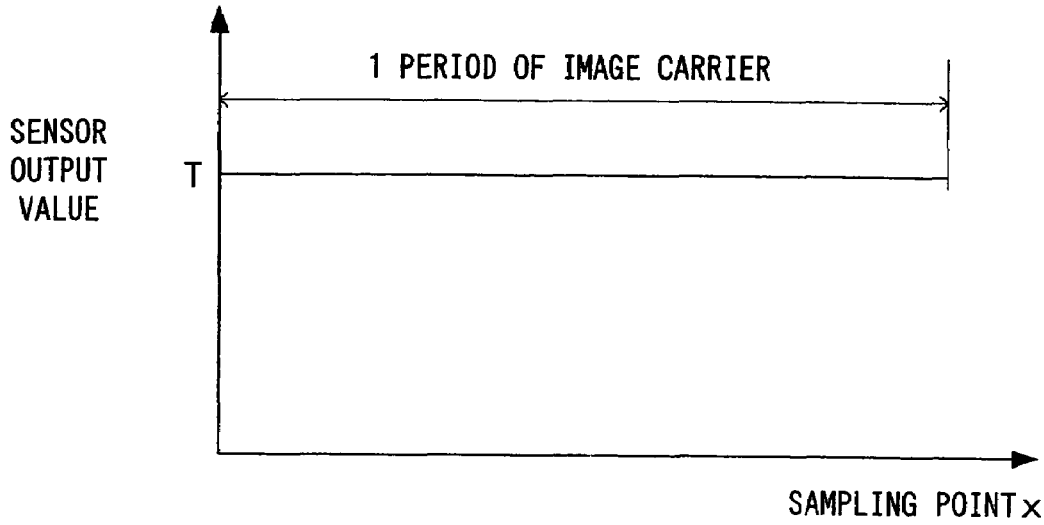
FIG. 36B: AFTER PATCH IMAGE FORMATION
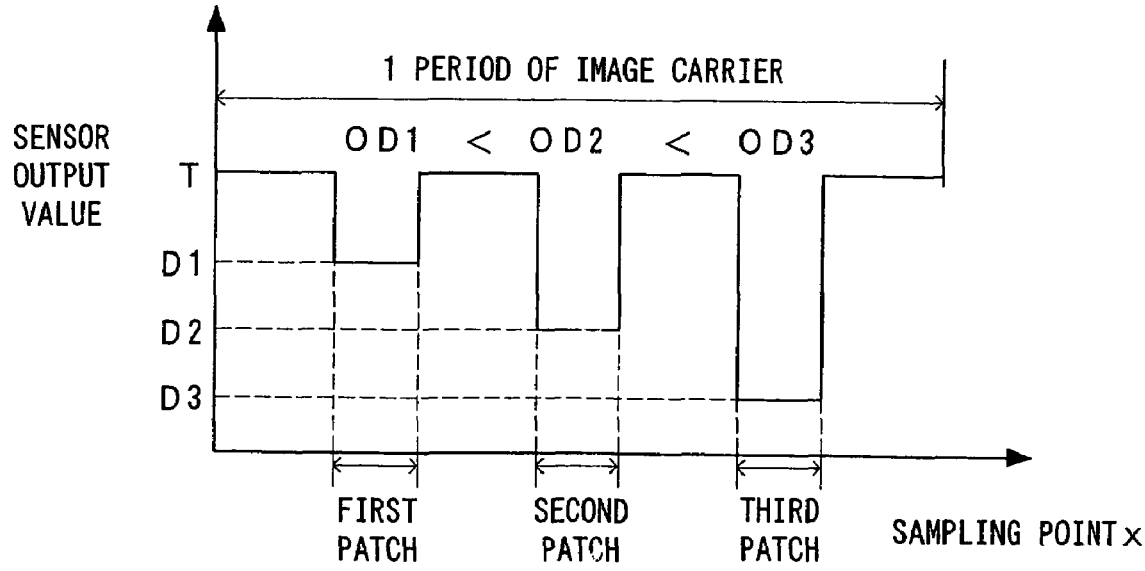

FIG. 37A: BEFORE PATCH IMAGE FORMATION
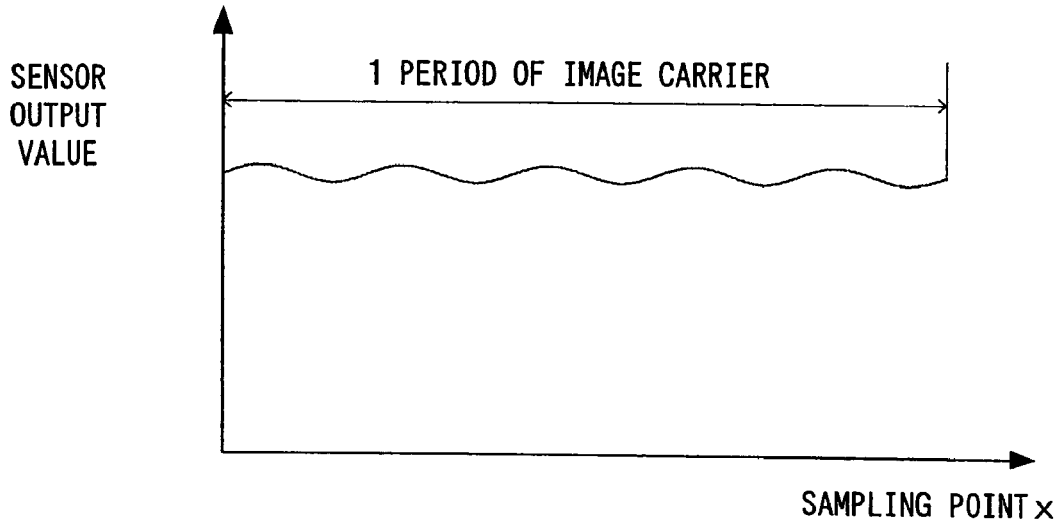
FIG. 37B: AFTER PATCH IMAGE FORMATION
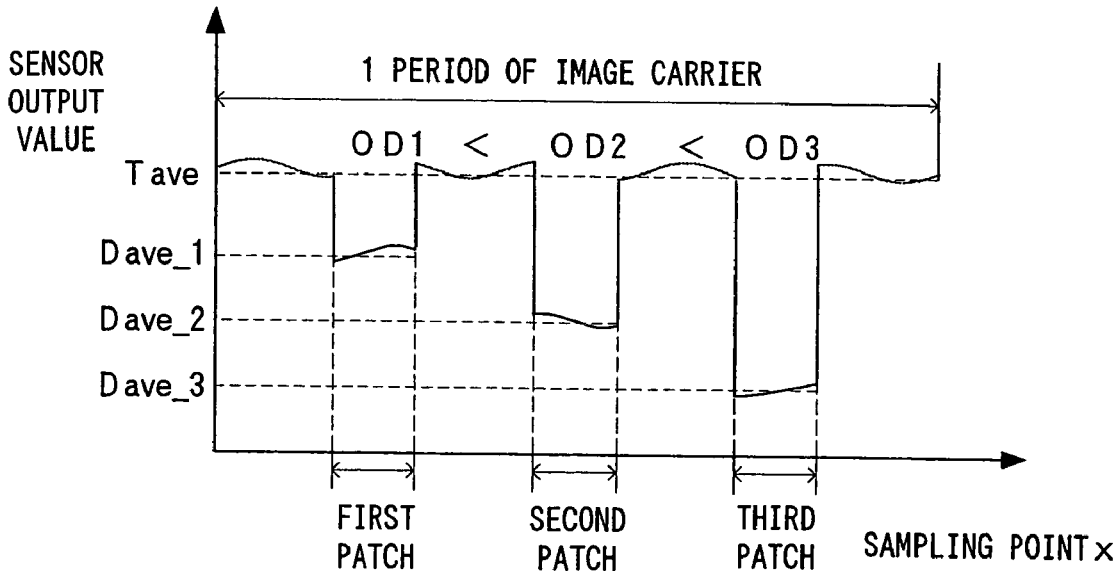

FIG. 38A: BEFORE CONSISTENT-DENSITY IMAGE FORMATION
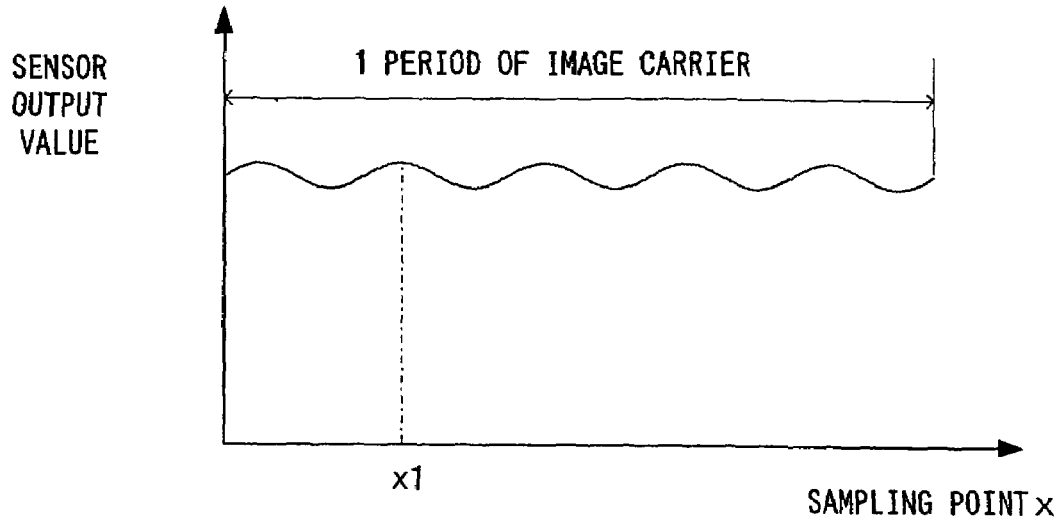
FIG. 38B: AFTER CONSISTENT-DENSITY IMAGE FORMATION
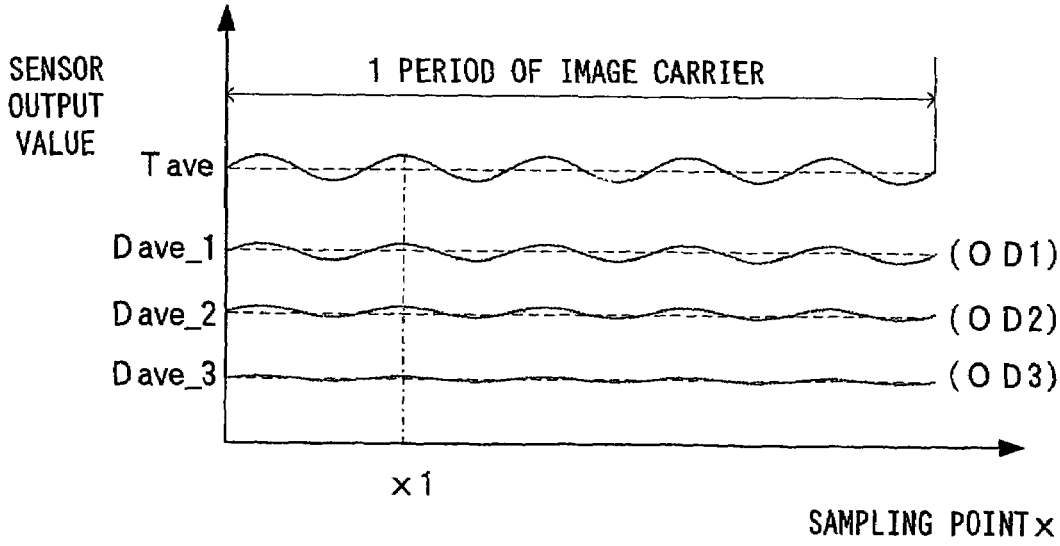

IMAGE FORMING APPARATUS AND IMAGE FORMING METHOD FOR PERFORMING DENSITY CONTROL OF TONER IMAGES

This is a divisional of application Ser. No. 10/476,222 filed Oct. 29, 2003, now U.S. Pat. No. 7,072,497 which is a national stage entry of PCT JP03/01742 filed Feb. 18, 2003. The entire disclosure of the prior application Ser. No. 10/476,222 is considered part of the disclosure of the accompanying divisional application and is hereby incorporated by reference.

TECHNICAL FIELD

The present invention relates to a technique for stabilizing an image density in electrophotographic image forming apparatuses such as printers, copy machines and facsimile machines.

BACKGROUND ART

The image forming apparatuses, such as copy machines, printers and facsimile machines, applying the electrophotographic techniques may encounter image density variations of a toner image due to individually different characters of apparatuses, variations with time, or changes of conditions surrounding the apparatus which include temperature, moisture and the like. Heretofore, there have been proposed a variety of techniques for ensuring a stable image density, which include, for example, a technique wherein a small test image (patch image) is formed on an image carrier such that a density control factor affecting the image density may be optimized based on the density of the patch image. This technique takes the following approach to attain a desired image density. That is, predetermined toner images are formed on the image carrier with the density control factor set to a different value each time while the image density of each toner image, as the patch image, borne on the image carrier or transferred onto another transfer medium such as an intermediate transfer medium is detected. Subsequently, the density control factor is adjusted so as to establish coincidence between the density of the patch image and a previously defined target density.

Heretofore, there have been proposed a variety of techniques for taking measurement of the patch image density (hereinafter, referred to as "patch sensing technique"). Above all, the technique based on optical means is most commonly used. Specifically, light is irradiated on a surface area of the image carrier or the transfer medium with the patch image formed thereon, while reflection light or transmission light from the surface area is received by an optical sensor. Then, the density of the patch image is determined based on the amount of received light.

In the image forming apparatus adapted to adjust the density control factor based on the density of the patch image, how accurately the density of the formed patch image is detected is an important point for obtaining the toner image of good image quality by way of the density control factor set to an adequate value. However, the above conventional patch sensing technique does not take direct measurement on the density of the formed image but merely provides an estimation of the image density consequentially derived from a detected result of the amount of light from the toner image as the patch image temporarily borne on the surface of the image carrier or the transfer medium. Therefore, it may not necessarily be said that the sensor output correctly represents the final image density. In addition, there may be a case where variations in the characteristics of the sensor or detection errors result in inconsistency between the sensor output and the final image density.

Where the image density of the toner image formed on the image carrier such as a photosensitive member or the transfer medium is measured by means of a density sensor as described above, the measurement result does not simply depend upon the amount of toner adhered to the image carrier but may be varied depending upon surface conditions of the image carrier which include reflectivity, surface roughness and the like. If the surface color of the image carrier is altered as the cumulative sum of prints produced by the image forming apparatus increases, for example, the output from the density sensor is varied in accordance with the change in the surface color of the image carrier even though the same amount of toner is adhered thereto. This results in disability to take accurate density measurements. In addition, where the image carrier has inconsistent surface conditions, influences of such surface conditions cannot be ignored.

If the sensor output does not accurately represent the final image density as described above, the density control factor is adjusted based on the image density erroneously estimated from such a sensor output. As a result, the density control factor is set to a value deviated from its optimum value. Particularly in a state where the toner is adhered to the image carrier in a relatively high density like when a solid image is formed thereon, for example, the final image density is varied less relative to the degree of increase or decrease of the amount of toner adhesion. Accordingly, even a minor deviation of the sensor output entails a significant deviation of the value of the density control factor defined based on such a sensor output. Consequently, the density control factor is set to a value significantly deviated from its optimum value so that the image quality is degraded and the following problems may also occur in cases.

In a case where, for example, the image density of a high-density image like a solid image is estimated from the sensor output to be a value lower than an actual image density thereof, the apparatus adjusts the density control factor in a manner to further increase the image density. As a result, an excessive amount of toner is made to adhere to the image carrier so as to cause a transfer/fixing failure or to increase toner consumption abnormally. In addition, while the image forming process is repeated under the condition that the amount of toner adhesion is increased more than necessary, the preceding image forming processes will leave cumulative adverse effects on an image to be formed subsequently or the service life of the apparatus may be shortened notably.

In addition, the image density of the patch image to be formed depends upon a combination of various factors and hence, complicated processings are required for discretely optimizing the plural density control factors affecting the image density based on the image density of the patch image. The conventional density control techniques have problems associated with the increased cost of the apparatus burdened with such complicated processings and the decreased throughput of the image formation suffering the time-consuming processings. In this connection, demand exists for the establishment of a technique for reliably optimizing the density control factor in a more simplified manner.

It is a first object of the present invention to provide an image forming apparatus and method adapted to set the density control factor in a proper state as excluding the influence of detection errors of the patch image density which result from the variations of the characteristics of the sensor or the like.

It is a second object of the present invention to provide an image forming apparatus and method adapted to optimally set the density control factor based on the image density of the toner image thereby ensuring stable formation of the toner image of good image quality.

It is a third object of the present invention to provide a density control technique suitable for an image forming apparatus of a non-contact development system.

DISCLOSURE OF THE INVENTION

For achieving the first object, the present invention is arranged such that a patch image is formed under each different image forming condition varied stepwise by varying stepwise a density control factor affecting an image density and then, the density control factor is optimized based on the detection results of the toner densities of the patch images given by density detecting means and a variation rate of the detection results against the density control factor.

According to the invention thus arranged, the density control factor is optimized taking into account not only the absolute toner densities of the patch images detected by the density detecting means but also the variation rate of the toner densities against the density control factor. Therefore, even if the detected toner densities of the patch images are deviated from the true values thereof because of the detection errors, the density control factor is prevented from being set to a value significantly deviated from its optimum value. The reason is given as below.

As mentioned supra, the toner densities of the patch images detected by the density detecting means may potentially include detection errors associated with the variations of the sensor characteristics and the like. Accordingly, if the density control factor is adjusted solely based on the detected toner densities of the patch images, the detection errors causes the density control factor to be set to a value deviated from its optimum value. In general, such detection errors are encountered by individual patch images in a similar manner. That is, a series of detection results of the patch images represent either higher or lower values than the true densities thereof. It rarely occurs that the series of detection results contain both higher and lower values than the true densities. Therefore, while the absolute toner densities determined for the patch images are deviated due to the detection errors, a relative density difference between the patch images varies little. That is, the variation rate of the toner densities against the density control factor is less susceptible to the influence of the detection errors, the variation rate determined from the detected toner densities of the patch images. An ideal correlation between the density control factor and the toner density or the correlation free from the detection errors can be empirically or theoretically derived in advance.

Thus, if a procedure is taken which includes the steps of determining the variation rate of the toner densities, which is less susceptible to the detection errors and then, optimizing the density control factor based on both the variation rate thus determined and the absolute toner densities, the influence of the detection errors can be canceled so that the density control factor may be set close to its optimum value. By performing the image formation under the image forming condition thus defined, toner images of good image quality may be formed in a stable manner. It is noted here that the "toner density" of the patch image means an estimated value from the detection result given by the density detecting means and does not always coincide with the "true" toner density of the formed patch image.

In the present invention, it goes without saying that if a condition to achieve coincidence between the toner density and a density target value is found, a value of the density control factor associated with the toner density may be used as the optimum value thereof. It is noted, however, that the value of the density control factor thus defined does not necessarily represent its optimum value because the toner density thus determined potentially contains an error. Particularly, in the case of the formation of the high-density patch image where the variations of the toner density are small relative to the variations of the density control factor, for example, even a minor detection error results in a significant deviation of the set value of the density control factor. In this case, it may be rather preferred to define the density control factor based on the variation rate of the toner densities in a manner that a value of the density control factor associated with a value of the variation rate substantially equal to an effective variation rate is selected as the optimum value thereof.

For achieving the second object, the present invention adopts an approach wherein information on an image carrier, as correction information, is previously stored prior to the determination of the image density of the toner image on the image carrier and wherein instead of directly using an output from a density sensor for determination of the image density, the sensor output is corrected based on the correction information before the image density of the toner image is determined. This cancels out the influence of the surface conditions of the image carrier, permitting the determination of a correction value reflecting only the image density of the toner image. By determining the image density of the toner image based on the correction value, the image density of the toner image can be measured with high accuracies, so that the images of consistent densities can be formed based on the resultant measurement results.

On the other hand, the influence of the surface conditions of the image carrier on the output from the density sensor is varied according to the degree of the density of the toner image formed on the image carrier, as will be described hereinlater. Where a toner image of a relatively low density is formed on the image carrier, a part of the light from the light emitter element passes through the toner image to be reflected by the image carrier and then passes again through the image carrier to be received by the light receiver element. Therefore, the output from the density sensor varies to a relatively large degree according to the surface conditions of the image carrier. On the other hand, with increase in the density of the toner image, not only the light through the toner image to become incident on the image carrier but also the reflection light from the image carrier passing through the image carrier to become incident on the light receiver element are decreased, so that the output from the density sensor is less affected by the surface conditions of the image carrier. Therefore, the accuracy is limited to a certain degree if the image density of the toner image is regularly determined based on the correction information disregarding the degree of density of the toner image. In contrast, the accuracies of the image density measurement are further improved by correcting the correction information according to the degree of the density of the toner image on the image carrier, as taught by the present invention.

It is noted here that the correction information may also be acquired from a signal outputted from the density sensor prior to the formation of the toner image on the image carrier. The correction information thus acquired may be stored in a storage section. As to the acquisition of the correction information, sample data constituting the signal outputted from the density sensor prior to the formation of the toner image on the image carrier may be used as they are as the correction information. However, there may be a case where spike-like noises are superimposed on the sample data. From the standpoint of removing such spike-like noises, it is effective to take a procedure of canceling some sample data pieces of higher order and/or of lower order out of the sample data pieces and replacing each of the canceled data pieces with an average value of the remaining sample data pieces.

As described above, as the density of the toner image increases, the surface conditions of the image carrier have correspondingly decreased influence on the output from the density sensor. Hence, the amount of correction based on the correction information may be defined to decrease correspondingly to the increase in the density of the toner image, thereby ensuring that the image density of the toner image is determined with high accuracies.

For achieving the third object, the present invention is arranged such that a developing bias is applied to a toner carrier spaced away from a latent image carrier bearing an electrostatic latent image thereon for forming the toner image, that each high-density patch image is formed at each different bias value of the developing bias varied stepwise and then, the developing bias is optimized based on the density of the image, and that each low-density patch image is formed at each different energy value of the energy density of the exposure light beam varied stepwise as applying the optimized developing bias to the toner carrier and then, the energy density of the exposure light beam is optimized based on the density of the image.

The invention thus arranged is adapted for discrete optimization of the developing bias applied to the toner carrier and the energy density of the light beam based on the fact that the influence of the energy variation of the exposure light beam differs in magnitude between the high-density image having a higher area percentage of dots based on the area of the image and the low-density image having a lower area percentage of the dots based on the area of the image. Specifically, the image density of the high-density image is varied in a relatively small degree when the energy of the light beam is increased or decreased. That is, the image density of the high-density image primarily depends upon the magnitude of the developing bias. Therefore, the high-density patch images may be formed at varied developing biases with the energy density of the light beam maintained at a constant level, so that the optimum value of the developing bias may first be determined based on the image densities thereof.

Subsequently, under the developing bias thus optimized, the low-density patch images may be formed at varied exposure light energies and then, the optimum value of the exposure light energy may be determined based on the image densities thereof. Thus, the two parameters of the developing bias and the energy density of the light beam can be discretely set to the respective optimum values thereof.

Furthermore, the control is simplified because the optimum value of one parameter can be determined based on the densities of the patch images formed with only the parameter in question varied. Hence, the present invention does not have a problem associated with increased costs of the apparatus due to the complicated control or time-consuming processes, as encountered by the conventional art.

BRIEF DESCRIPTION OF THE DRAWINGS

FIG. 15 are graphs showing the correlation between the particle size distribution of toner and the variation of OD value;

FIG. 17 show examples of a look-up table based on which the control target value is determined;

FIG. 31 are graphs each explaining the principles of the process for setting the reference light quantity;

FIG. 36 are graphs representing the sensor output value obtained at each sampling point on an image carrier before and after the formation of patch images (toner images) thereon, respectively, the image carrier having consistent surface conditions;

FIG. 37 are graphs representing the sensor output value obtained at each sampling point on an image carrier before and after the formation of patch images (toner images) thereon, respectively, the image carrier having inconsistent surface conditions;

FIG. 38 are graphs representing the sensor output value obtained at each sampling point on an image carrier before and after the formation of an image of a consistent density (toner image) thereon, respectively, the image carrier having inconsistent surface conditions;

BEST MODES FOR CARRYING OUT THE INVENTION

FIRST EMBODIMENT (1) Arrangement of Apparatus

Figure 1:
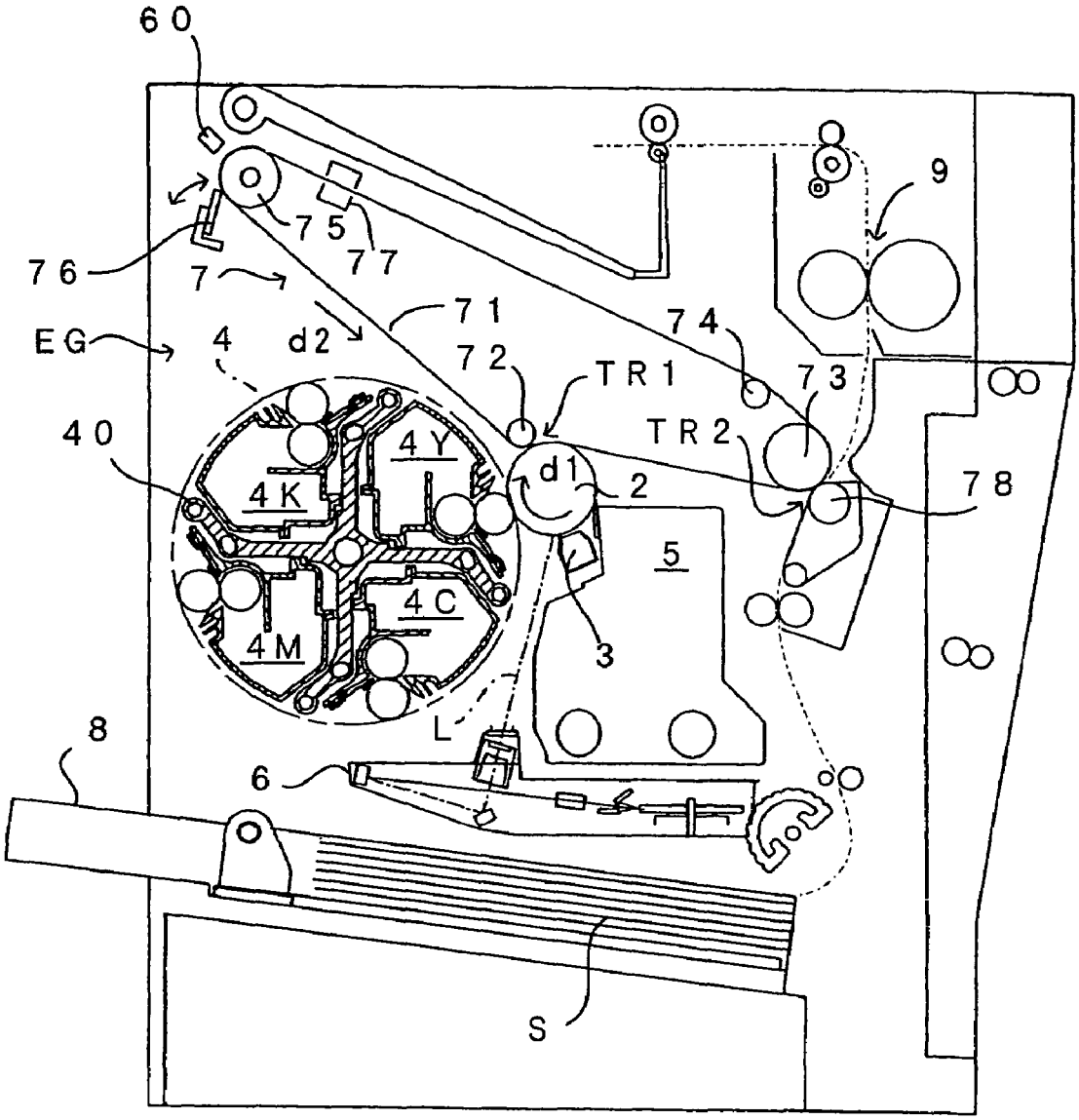
FIG. 1 is a diagram showing an image forming apparatus according to a first embodiment of the present invention.
Figure 2:
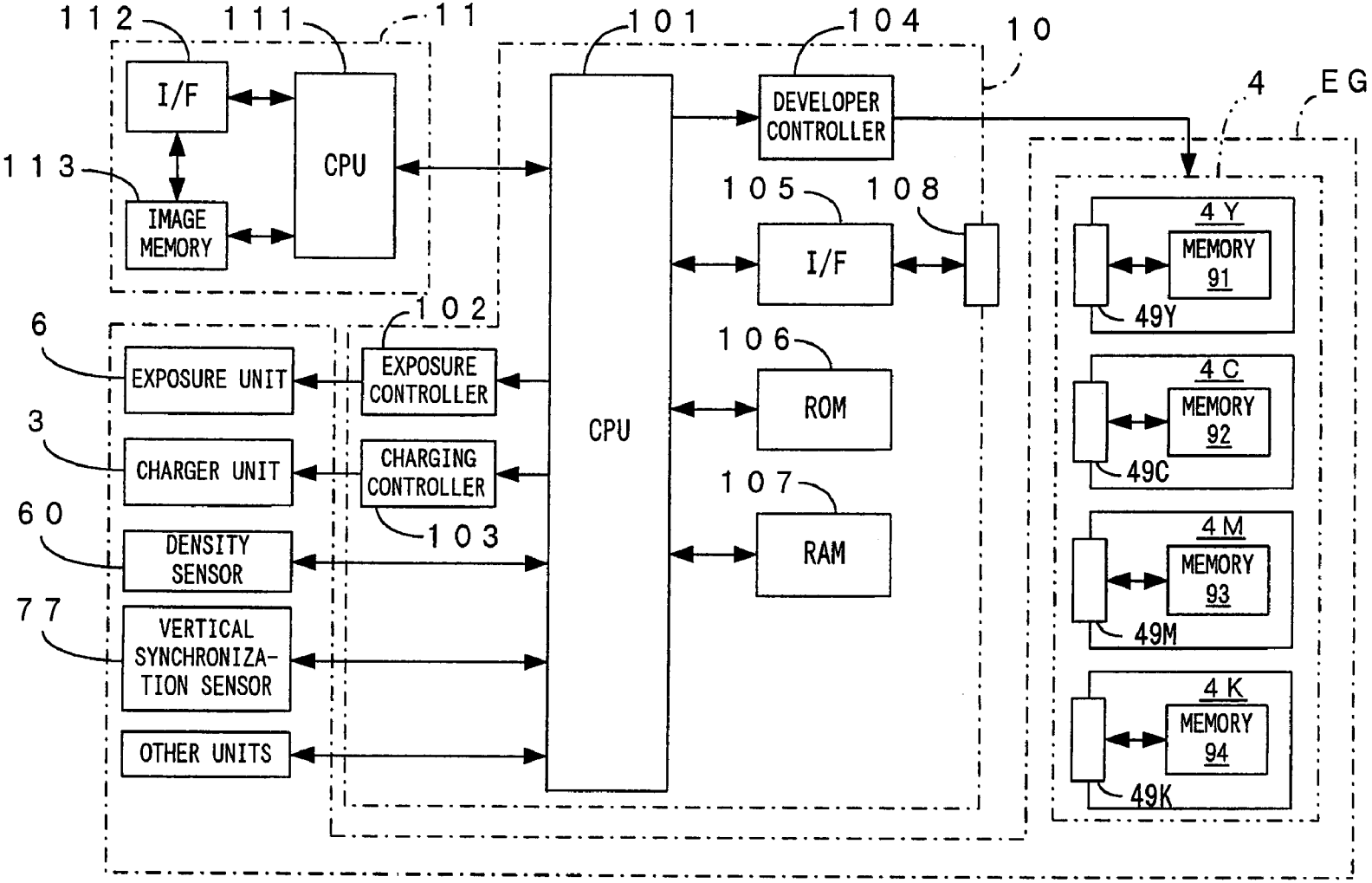
FIG. 2 is a block diagram showing an electrical arrangement of the image forming apparatus of FIG. 1.

FIG. 1 is a diagram showing an image forming apparatus according to a first embodiment of the present invention, whereas: FIG. 2 is a block diagram showing an electrical arrangement of the image forming apparatus of FIG. 1. The image forming apparatus is adapted to form a full-color image by superimposing toner images of four colors, including yellow (Y), cyan (C), magenta (M) and black (K), on one another or to form a monochromatic image using a black (K) toner alone. The image forming apparatus operates as follows. When an external apparatus such as a host computer supplies an image signal to a main controller 11 in response to a user demand for forming an image, an engine controller 10 functioning as "image forming means" of the present invention responds to the command from the main controller 11. The engine controller 10 controls individual portions of an engine EG whereby an image corresponding to the image signal is formed on a sheet S.

The engine EG is provided with a photosensitive member 2 rotatable along a direction of arrow d1 as seen in FIG. 1. A charger unit 3, a rotary developing unit 4 and a cleaning section 5 are disposed around the photosensitive member 2 and along the rotation direction d1. The charger unit 3 is applied with a charging bias from a charging controller 103 so as to uniformly charge an outer periphery of the photosensitive member 2 to a predetermined surface potential.

An exposure unit 6 irradiates a light beam L onto the outer periphery of the photosensitive member 2 thus charged by the charger unit 3. The exposure unit 6 irradiates the light beam L on the photosensitive member 2 according to a control command given by an exposure controller 102 thereby forming on the photosensitive member 2 an electrostatic latent image corresponding to the image signal. When the external apparatus such as the host computer applies the image signal to a CPU 111 of the main controller 11 via an interface 112, for example, a CPU 101 of the engine controller 10 outputs a control signal corresponding to the image signal to the exposure controller 102 in a predetermined timing. In response to the control signal, the exposure unit 6 irradiates the light beam L onto the photosensitive member 2 for forming thereon the electrostatic latent image corresponding to the image signal. Where it is necessary to form a patch image to be described hereinlater, a control signal corresponding to a signal indicative of a patch image of a predetermined pattern is supplied to the exposure controller 102 from the CPU 101 such that an electrostatic latent image corresponding to the pattern is formed on the photosensitive member 2. As described above, according to this embodiment, the photosensitive member 2 functions as the "latent image carrier" of the present invention.

The electrostatic latent image thus formed is developed into a toner image by means of the developing unit 4. Specifically, the developing unit 4 according to this embodiment includes a support frame 40 mounted therein as allowed to rotate about an axis thereof; an unillustrated rotary drive section; and a yellow developer 4Y, a cyan developer 4C, a magenta developer 4M, and a black developer 4K which are each designed to be removably attachable to the support frame 40 and each contain therein a toner of a respective color. As shown in FIG. 2, the developing unit 4 is controlled by a developer controller 104. The developing unit 4 is driven into rotation based on a control command from the developer controller 104, whereas any of the developers 4Y, 4C, 4M and 4K is selectively positioned at a predetermined development position opposite the photosensitive member 2 for applying a toner of a selected color to a surface of the photosensitive member 2. Thus, the electrostatic latent image on the photosensitive member 2 is developed into a visible image of the selected toner color. Incidentally, FIG. 1 depicts the yellow developer 4Y positioned at the development position.

Figure 3:
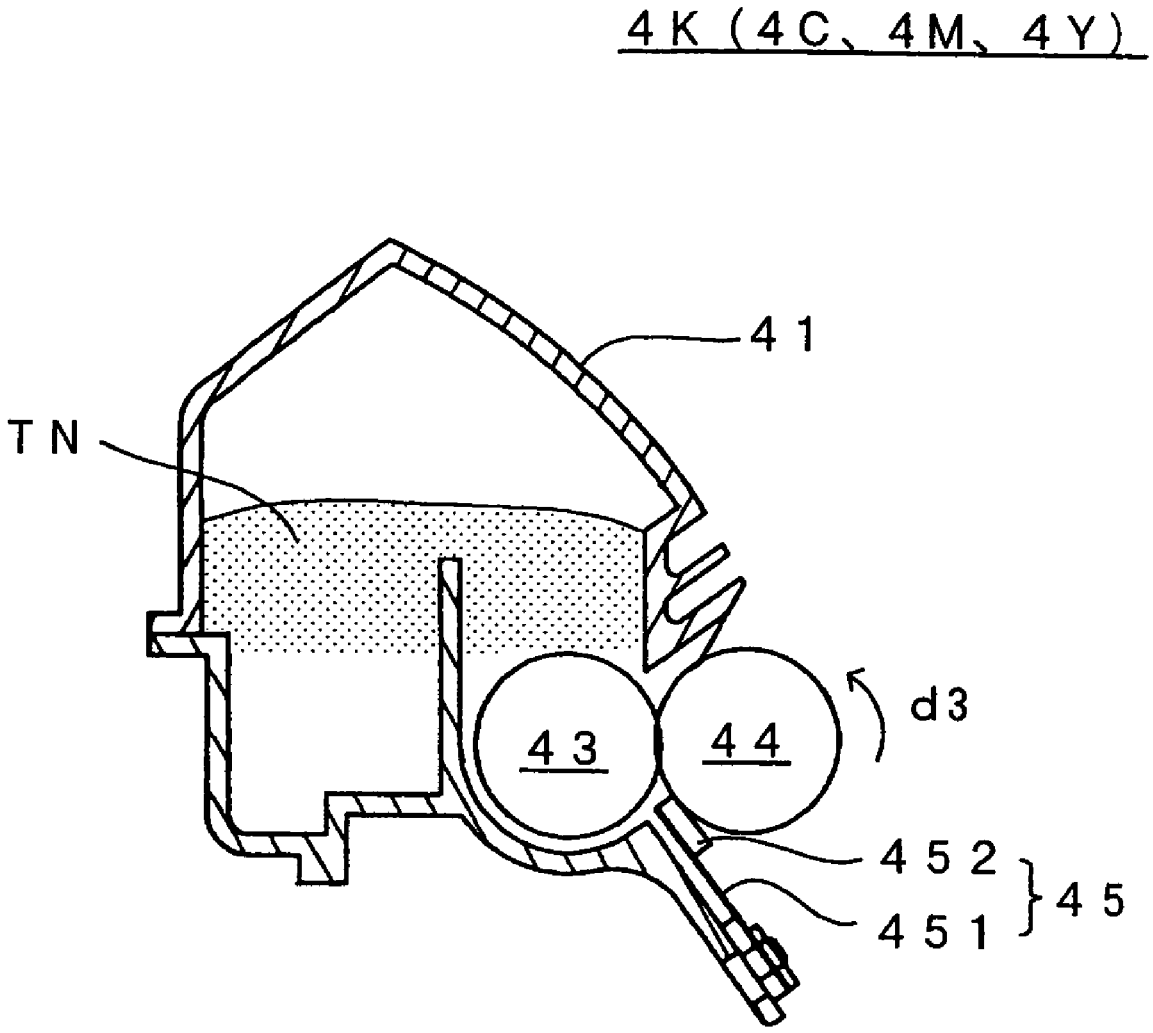
FIG. 3 is a sectional view showing a developer of the image forming apparatus.

All these developers 4Y, 4C, 4M and 4K have the same structure. Hence, the details of the structure of the developer 4K are described here with reference to FIG. 3, while it is noted that the other developers 4Y, 4C and 4M have the same structure and function. FIG. 3 is a sectional view showing the developer of the image forming apparatus. The developer 4K is arranged such that a feed roller 43 and a developing roller 44 are rotatably mounted to a housing 41 containing therein a toner TN. When the developer 4K is positioned at the aforesaid development position, the developing roller 44 functioning as the "toner carrier" of the present invention is pressed against the photosensitive member 2 or positioned at place to confront the photosensitive member 2 via a predetermined gap therebetween whereas these rollers 43, 44 are engaged with the rotary drive section (not shown) disposed on a main body of the apparatus for rotation in predetermined directions. The developing roller 44 is a cylindrical body constructed from a metal such as copper, aluminum, iron or stainless steel, or an alloy thereof such as to be applied with a developing bias to be described hereinlater. These materials may be surface treated as required (e.g., oxidizing treatment, nitriding treatment, blasting treatment or the like). These rollers 43, 44 are in rotating contact with each other whereby the black toner is rubbed onto a surface of the developing roller 44 to form a toner layer in a predetermined thickness over the surface of the developing roller 44.

The developer 4K is provided with a regulator blade 45 for limiting the toner layer formed on the surface of the developing roller 44 to a predetermined thickness. The regulator blade 45 includes a sheet member 451 such as formed of stainless steel or phosphor bronze, and an elastic member 452, such as formed of rubber or a resin member, which is attached to a distal end of the sheet member 451. The sheet member 451 has its proximal end secured to the housing 41 and is disposed in a manner that the elastic member 452 attached to the distal end thereof is located on an upstream side relative to the proximal end thereof with respect to a rotating direction d3 of the developing roller 44. The elastic member 452 resiliently abuts against the surface of the developing roller 44 thereby finally limiting the toner layer formed on the surface of the developing roller 44 to the predetermined thickness.

Individual toner particles constituting the toner layer over the developing roller 44 are charged as brought into rubbing contact with the teed roller 43 and the regulator blade 45. Although this embodiment is described with the proviso that the toner is negatively charged, the apparatus is also adapted to use a positively chargeable toner by properly changing the potentials of individual parts of the apparatus.

The toner layer thus formed on the surface of the developing roller 44 is continuously delivered to place opposite the photosensitive member 2 in conjunction with the rotation of the developing roller 44, the photosensitive member 2 having the electrostatic latent image formed on its surface. When the developer controller 104 applies the developing bias to the developing roller 44, the toner borne on the developing roller 44 is made to adhere selectively to surface portions of the photosensitive member 2 in accordance with the surface potential of the surface portions, thus developing the electrostatic latent image on the photosensitive member 2 into a visible toner image of the toner color.

The developing bias to be applied to the developing roller 44 may be a direct current voltage or a direct current voltage with an alternating current voltage superimposed thereon. Particularly in the image forming apparatus of the non-contact development system wherein the photosensitive member 2 and the developing roller 44 are disposed in a spaced relation so that the toner image is developed by causing the toner to jump between these, the direct current voltage may preferably have such a waveform as obtained by superimposing an alternating current voltage of a sine wave, triangular wave or square wave on the direct current voltage in the light of efficient jump of the toner particles. While the magnitude of the direct current voltage and the amplitude, frequencies, the duty ratio and the like of the alternating current voltage are arbitrary, a direct current component (average value) of the developing bias will hereinafter be referred to as a direct current developing bias Vavg regardless of whether the developing bias includes an alternating current component or not.

Now, a preferred example of the developing bias described above used by the image forming apparatus of the non-contact development system is given. For instance, the developing bias has a waveform generated by superimposing an alternating current voltage of a square wave on the direct current voltage, the square wave having a frequency of 3 kHz and an amplitude Vpp of 1400V As will be described hereinlater, this embodiment defines the developing bias Vavg to be variable as one of the density control factors. Taking into consideration the influence on the image density, variations of the characteristics of the photosensitive member 2 and the like, the developing bias may have a variable range of (−110)V to (−330)V, for example. It is noted that these numerical values are not limited to the above but should be varied according to the arrangement of the apparatus if deemed appropriate.

As shown in FIG. 2, the developers 4Y, 4C, 4M, 4K are provided with memories 91 to 94, respectively, for storing data on the production lot thereof, the history of use thereof, the characteristics of toner contained therein and the like. The developers 4Y, 4C, 4M, 4K further include connectors 49Y, 49C, 49M, 49K, respectively. As required, any one of these connectors is selectively connected with a connector 108 on the main body side for data communications between the CPU 101 and any one of the memories 91 to 94 via an interface 105 such that information items concerning consumable articles and the like of the developer of interest are managed. This embodiment provides the data communications between the main body and the developer through mechanical engagement between the connector 108 of the main body and the connector 49Y or the like of the developer. Alternatively, the data communications may be carried out in a non-contact fashion using electromagnetic means such as radiotelegraphic devices. The memories 91 to 94 for storing data specific to the developers 4Y, 4C, 4M, 4K may preferably be non-volatile memories such that the data can be retained during the OFF state of a power source or when the developer is dismounted/from the main body. Examples of a preferred non-volatile memory include flash memories, high dielectric memories, EEPROMs and the like.

Returning to FIG. 1, the description on the arrangement of the apparatus is continued. The toner image thus developed by the developing unit 4 is primarily transferred onto an intermediate transfer belt 71 of a transfer unit 7 in a primary transfer region TR1. The transfer unit 7 includes the intermediate transfer belt 71 entrained on a plurality of rollers 72 to 75; and a drive portion (not shown) operative to rotate the roller 73 thereby rotating the intermediate transfer belt 71 in a predetermined direction d2. The transfer unit 7 further includes a secondary transfer roller 78 opposing the roller 73 with the intermediate transfer belt 71 interposed therebetween and designed to be pressed against the surface of the belt 71 or moved away therefrom by means of an unillustrated electromagnetic clutch. Where a color image is transferred to a sheet S, individual toner images of respective colors formed on the photosensitive member 2 are superimposed on each other on the intermediate transfer belt 71 thereby forming a color image, and then the resultant color image is secondarily transferred onto the sheet S taken out from a cassette 8 and delivered to a secondary transfer region TR2 defined between the intermediate transfer belt 71 and the secondary transfer roller 78. The sheet S thus formed with the color image is transported through a fixing unit 9 to a discharge tray provided at a top surface portion of the main body of the apparatus. Thus, the intermediate transfer belt 71 according to this embodiment functions as an "intermediate member" of the present invention.

After the primary transfer of the toner image to the intermediate transfer belt 71, the photosensitive member 2 has its surface potential reset by unillustrated discharging means and is also cleaned of residual toner on its surface by means of a cleaning section 5. Thereafter, the photosensitive member 2 is subjected to the subsequent charge by the charger unit 3.

Where it is necessary to perform the image formation further more, the above operations are repeated to form a required number of images and then the sequence of image forming steps is terminated. The apparatus is placed in a standby state until a new image signal is applied thereto. However, the apparatus is shifted to a standstill state in order to reduce power consumption in the standby state. Specifically, the apparatus enters the standstill state by stopping the rotation of the photosensitive member 2, developing roller 44, the intermediate transfer belt 71 and the like, while suspending the application of the developing bias to the developing roller 44 and of the charging bias to the charger unit 3.

On the other hand, a cleaner 76, a density sensor 60 and a vertical synchronization sensor 77 are disposed in the vicinity of the roller 75. Of these, the cleaner 76 is designed to be moved to or away from the roller 75 by means of an unillustrated electromagnetic clutch. As moved to the roller 75, the cleaner 76 presents its blade against the surface of the intermediate transfer belt 71 entrained about the roller 75 thereby removing the toner remaining on the outside surface of the intermediate transfer belt 71 after the secondary transfer. The vertical synchronization sensor 77 is a sensor for detecting a reference position of the intermediate transfer belt 71, thus functioning to output a synchronizing signal or a vertical synchronizing signal Vsync in association with the drivable rotation of the intermediate transfer belt 71. In the apparatus, the individual parts are controlled based on the vertical synchronizing signal Vsync in order to establish synchronism of the operation timings of the individual parts as well as to superimpose the toner images of the different colors precisely on top of each other. The density sensor 60 functioning as "density sensing means" of the present invention is disposed to confront the surface of the intermediate transfer belt 71. The density sensor 60 is arranged in a manner to be described hereinlater for taking measurement of the optical density of a patch image formed on the outside surface of the intermediate transfer belt 71. Therefore, the intermediate transfer belt 71 according to this embodiment is equivalent to the "image carrier" of the present invention.

In FIG. 2, denoted at 113 is an image memory which is disposed to the main controller 11 to store an image signal which is fed from an external apparatus such as a host computer via the interface 112. Denoted at 106 is a ROM which stores a calculation program executed by the CPU 101, control data for control of the engine EG, etc. Denoted at 107 is a RAM which temporarily stores a calculation result derived by the CPU 101, other data, etc.

Figure 4:
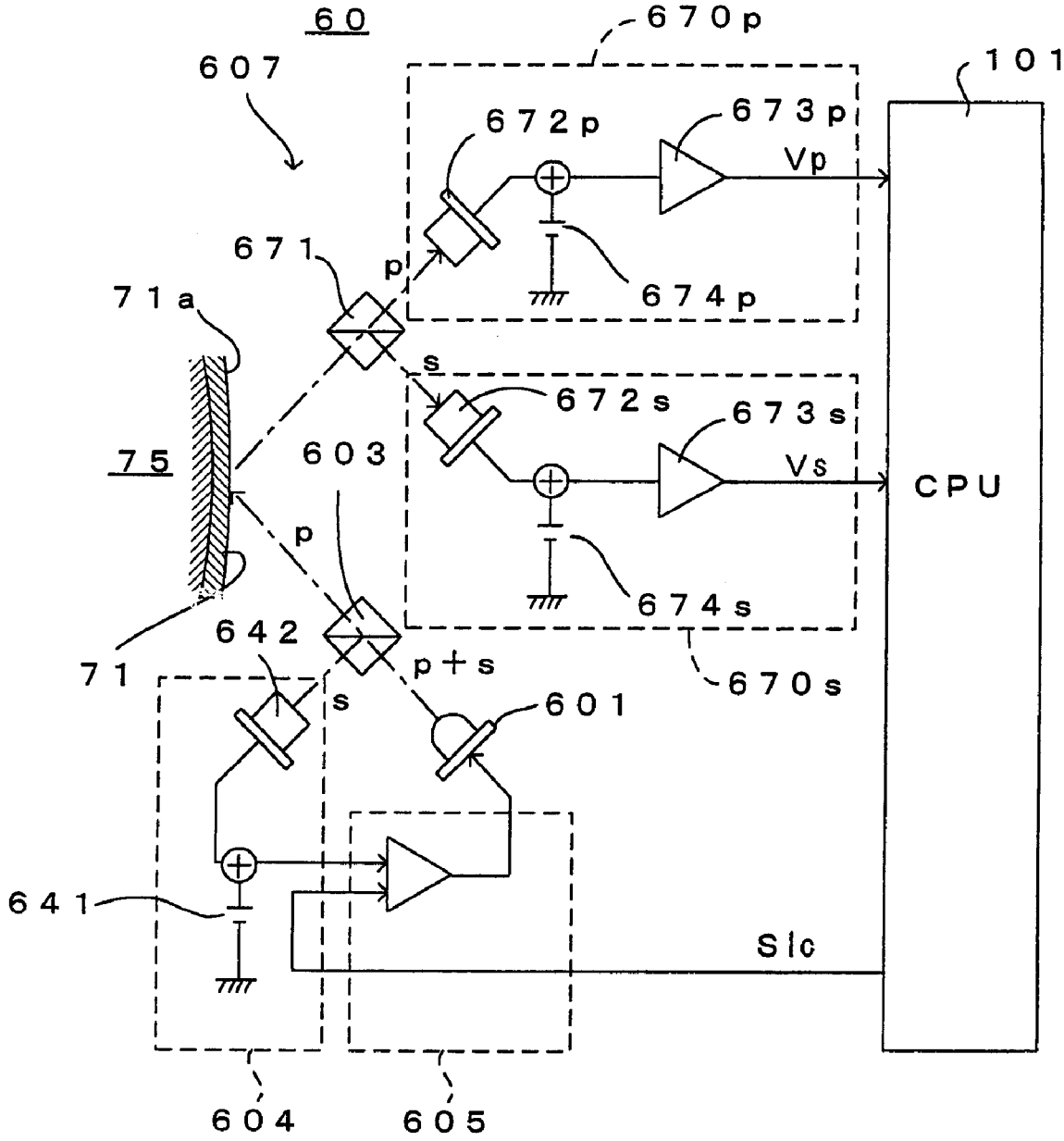
FIG. 4 is a diagram showing an arrangement of a density sensor.

FIG. 4 is a diagram showing an arrangement of the density sensor. The density sensor 60 includes a light emitter element 601, such as an LED, for irradiating light on an on-roller area 71*a* of a surface area of the intermediate transfer belt 71, the on-roller area 71*a* corresponding to a portion of the intermediate transfer belt 71 that engages the roller 75. The density sensor 60 is further provided with a polarization beam splitter 603, a light receiver unit 604 for monitoring the amount of irradiation light and an irradiation-light-quantity regulating unit 605 such that the amount of irradiation light may be controlled based on a light-quantity control signal Slc applied from the CPU 101 as will be described hereinlater.

As shown in FIG. 4, the polarization beam splitter 603 is disposed between the light emitter element 601 and the intermediate transfer belt 71 and operates to split light emitted from the light emitter element 601 into a p-polarized light having a polarization direction parallel to a plane of incidence of the irradiated light on the intermediate transfer belt 71 and an s-polarized light having a polarization direction vertical to the plane of incidence. The p-polarized light is allowed to impinge directly upon the intermediate transfer belt 71. On the other hand, the s-polarized-light is extracted from the polarization beam splitter 603 and then applied to the light receiver unit 604 for monitoring the amount of irradiation light, so that a light receiver element 642 of the light receiver unit 604 may output a signal proportional to the amount of irradiation light to the irradiation-light-quantity regulating unit 605.

The irradiation-light-quantity regulating unit 605 performs a feedback control over the light emitter element 601 based on the signal from the light receiver unit 604 and the light-quantity control signal S1*c* from the CPU 101 of the engine controller 10, thereby controlling the light emitter element 601 to irradiate the intermediate transfer belt 71 with an amount of light corresponding to the light-quantity control signal Slc . In this manner, this embodiment is adapted to properly vary and regulate the amount of irradiation light in a wide range.

Figure 5:
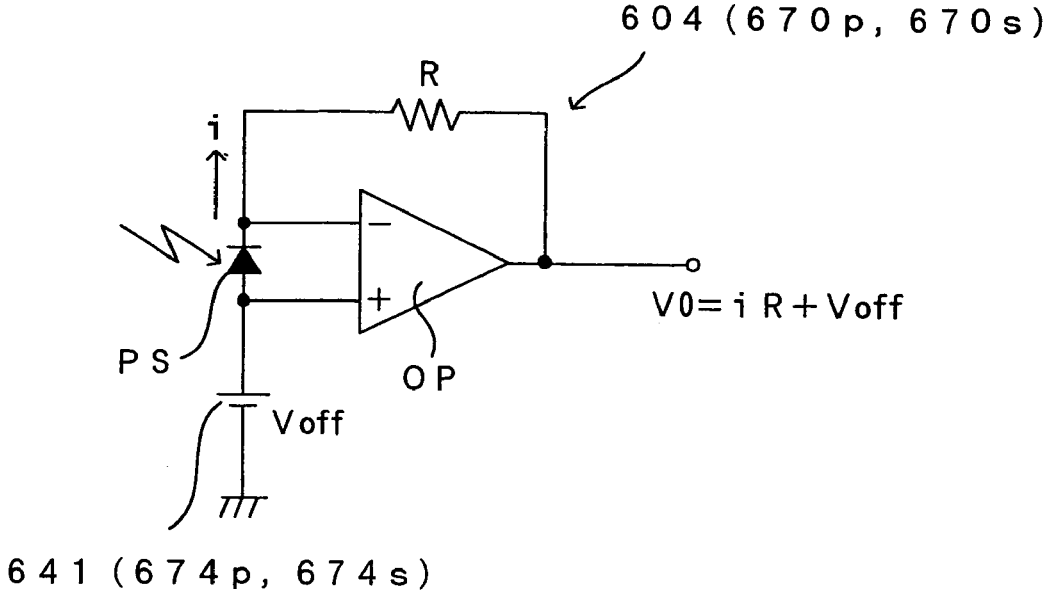
FIG. 5 is a diagram showing an electrical arrangement of a light receiver unit employed by the density sensor of FIG. 4.

According to this embodiment, an input offset voltage 641 is applied to an output side of the light receiver element 642 of the light receiver unit 604 for monitoring the amount of irradiation light such that the light emitter element 601 may be maintained in an OFF state so long as the light-quantity control signal Slc is below a given signal level. Specific electrical arrangement for this purpose is shown in FIG. 5 which illustrates the electrical arrangement of the light receiver unit 604 employed by the density sensor 60 of FIG. 4. In the light receiver unit 604, a light receiver element PS, such as a photodiode, has its anode terminal connected to a non-inverting input terminal of an operational amplifier OP constituting a current/voltage (I/V) converter circuit as well as to a ground potential via the offset voltage 641. On the other hand, a cathode terminal of the light receiver element PS is connected to an inverting input terminal of the operational amplifier OP as well as to an output terminal of the operational amplifier OP via a resistance R. Therefore, when an optical current i is caused to flow upon incidence of light on the light receiver element PS, the output terminal of the operational amplifier OP provides an output voltage VO, which is expressed as:

$$VO=i\cdot R+V\text{off} \tag{1-1}$$

where Voff denotes an offset voltage value. Thus, the light receiver unit 604 outputs a signal corresponding to the amount of reflection light. A reason for making this arrangement is given as below.

Figure 6:
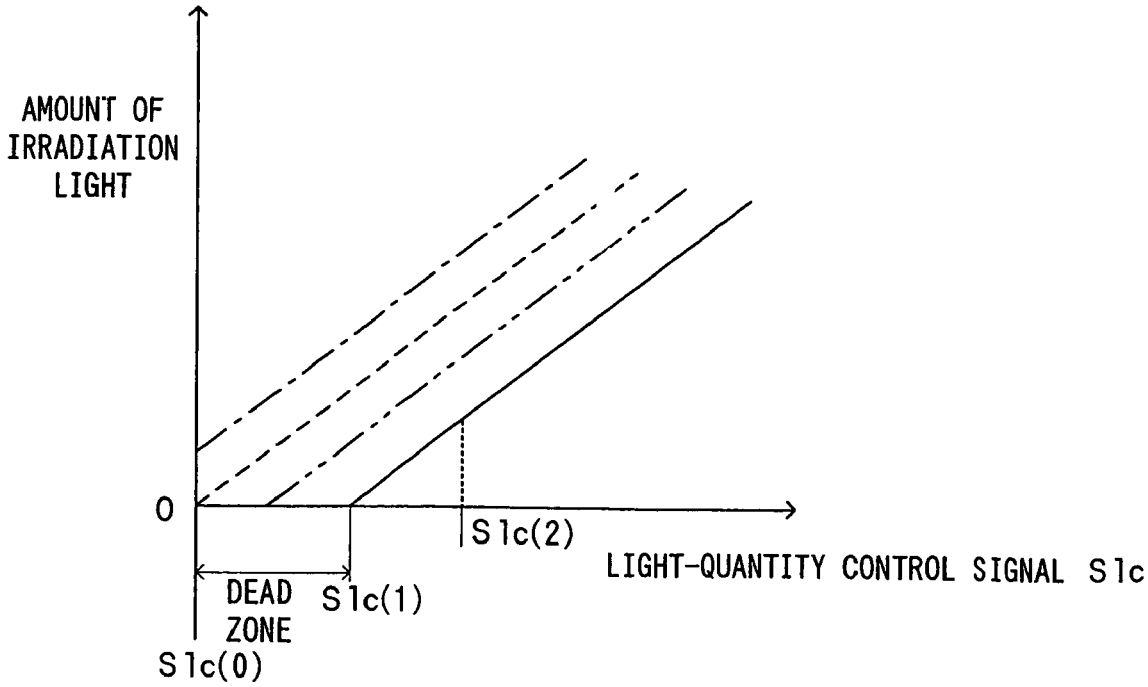
FIG. 6 is a graph representing the light-quantity control characteristic line of the density sensor of FIG. 4.

FIG. 6 is a graph representing a light-quantity control characteristic line of the density sensor of FIG. 4. Where the input offset voltage 641 is not applied, the density sensor exhibits a light-quantity characteristic represented by a broken line in FIG. 6. Specifically, when the CPU 101 applies a light-quantity control signal Slc(0) to the irradiation-light-quantity regulating unit 605, the light emitter element 601 is placed in the OFF state. When the level of the light-quantity control signal Slc is increased, the light emitter element 601 is activated while the amount of irradiated light on the intermediate transfer belt 71 is increased substantially in proportion to the increase of the signal level. However, the light-quantity characteristic line may be shifted in parallel, as indicated by alternate long and short dashed lines or a chain double-dashed line in FIG. 6, because of the influences of the ambient temperatures, the arrangement of the irradiation-light-quantity regulating unit 605 or the like. If the characteristic line is shifted as indicated by the alternate long and short dashed lines in the figure, the light emitter element 601 may be activated despite an OFF command or the light-quantity control signal Slc(0) applied from the CPU 101.

On the contrary, in a case where the input offset voltage 641 is applied to previously shift the characteristic line (represented by a solid line in the figure) to the right-hand side as seen in the figure thereby providing a dead zone (signal levels Slc(0) to Slc(1)), as implemented by this embodiment, it is ensured that the light emitter element 601 is positively deactivated by applying the OFF command or the light-quantity control signal Slc(0) from the CPU 101. Thus, the misoperation of the apparatus can be avoided.

When, on the other hand, a light-quantity control signal Slc higher than the signal level Slc(1) is applied to the irradiation-light-quantity regulating unit 605 from the CPU 101, the light emitter element 601 is activated to irradiate the p-polarized light, as the irradiation light, on the intermediate transfer belt 71. The p-polarized light, in turn, is reflected by the intermediate transfer belt 71 so that a reflection-light-quantity detecting unit 607 detects respective amounts of the p-polarized light component and the s-polarized light component of the reflection light. Thus, signals corresponding to the respective amounts of light are outputted to the CPU 101.

As shown in FIG. 4, the reflection-light-quantity detecting unit 607 includes a polarization beam splitter 671 disposed on a light path of the reflection light; a light receiver unit 670*p* for receiving a p-polarized light passing through the polarization beam splitter 671 and outputting a signal corresponding to the amount of p-polarized light; and a light receiver unit 670*s* for receiving an s-polarized light splitted by the polarization beam splitter 671 and outputting a signal corresponding to the amount of s-polarized light. In the light receiver unit 670*p*, a light receiver element 672*p* receives the p-polarized light from the polarization beam splitter 671 while an amplifier circuit 673*p* amplifies an output from the light receiver element 672*p*. Subsequently, the light receiver unit 670*p* outputs the amplified signal as the signal corresponding to the amount of p-polarized light. Likewise to the light receiver unit 670*p*, the light receiver unit 670*s* includes a light receiver element 672*s* and an amplifier circuit 673*s*. This provides for discrete determination of the respective amounts of the two different light components (p-polarized light and s-polarized light) of the reflection light.

Figure 7:
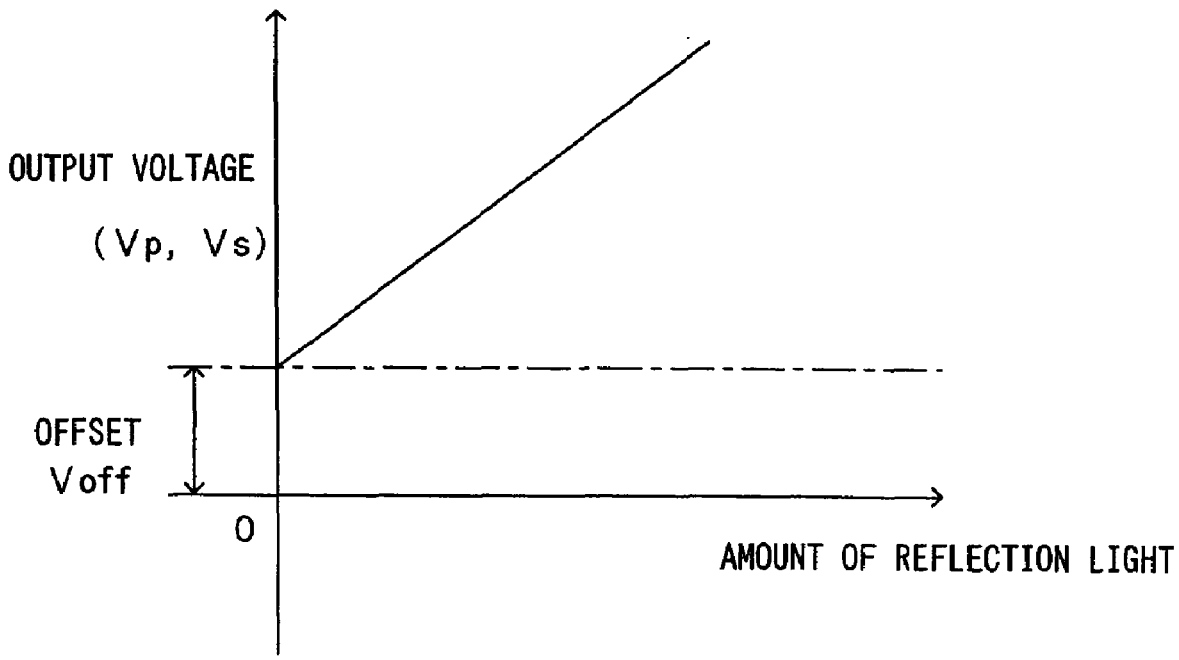
FIG. 7 is a graph showing how the output voltage is varied relative to the amount of reflection light sensed by the density sensor of FIG. 4.

In this embodiment, output offset voltages 674*p*, 674*s* are applied to respective output sides of the light receiver elements 672*p*, 672*s*, so that output voltages Vp, Vs applied to the CPU 101 from the amplifier circuits 673*p*, 673*s* are offset to the positive side, as shown in FIG. 7. FIG. 7 is a graph showing how the output voltage is varied relative to the amount of reflection light detected by the density sensor of FIG. 4. Since specific electrical arrangements of the light receiver units 670*p*, 670*s* are the same as that of the light receiver unit 604, the illustration thereof is dispensed with. In the light receiver units 670*p*, 670*s* thus arranged, as well, the output voltages Vp, Vs have values equal to or greater than zero even when the amount of reflection light is zero, just as in the light receiver unit 604. Furthermore, the output voltages Vp, Vs are increased in proportion to the increase of the reflection light. In this manner, the influences of the dead zone shown in FIG. 6 are positively eliminated by applying the output offset voltages 674*p*, 647*s*. Therefore, the light receiver units can provide the output voltages corresponding the amount of reflection light.

This embodiment is arranged such that the signals indicative of the output voltages Vp, Vs are inputted to the CPU 101 via an unillustrated A/D converter circuit and that the CPU 101 samples these output voltages Vp, Vs at predetermined time intervals (of 8 msec according to this embodiment) on an as-needed basis. At a proper time, say when the apparatus is activated or immediately after the replacement of any one of the units, the CPU 101 performs an optimization process for a density control factor, such as the developing bias or exposure energy, which affects the image density, thereby accomplishing the stabilization of the image density. More specifically, the CPU 101 performs an image forming operation for each of the toner colors, wherein based on an image signal representative of image data previously stored in a ROM 106 and corresponding to a predetermined patch image pattern, small test images (patch images) corresponding to the image signal are formed with the above-described density control factor varied stepwise. In the meantime, the image densities of the test images are detected by the density sensor 60. Based on the detection results, the CPU 11 finds a condition to attain a desired image density. The optimization process for the density control factor will be described as below.

(2) Optimization Process

Figure 8:
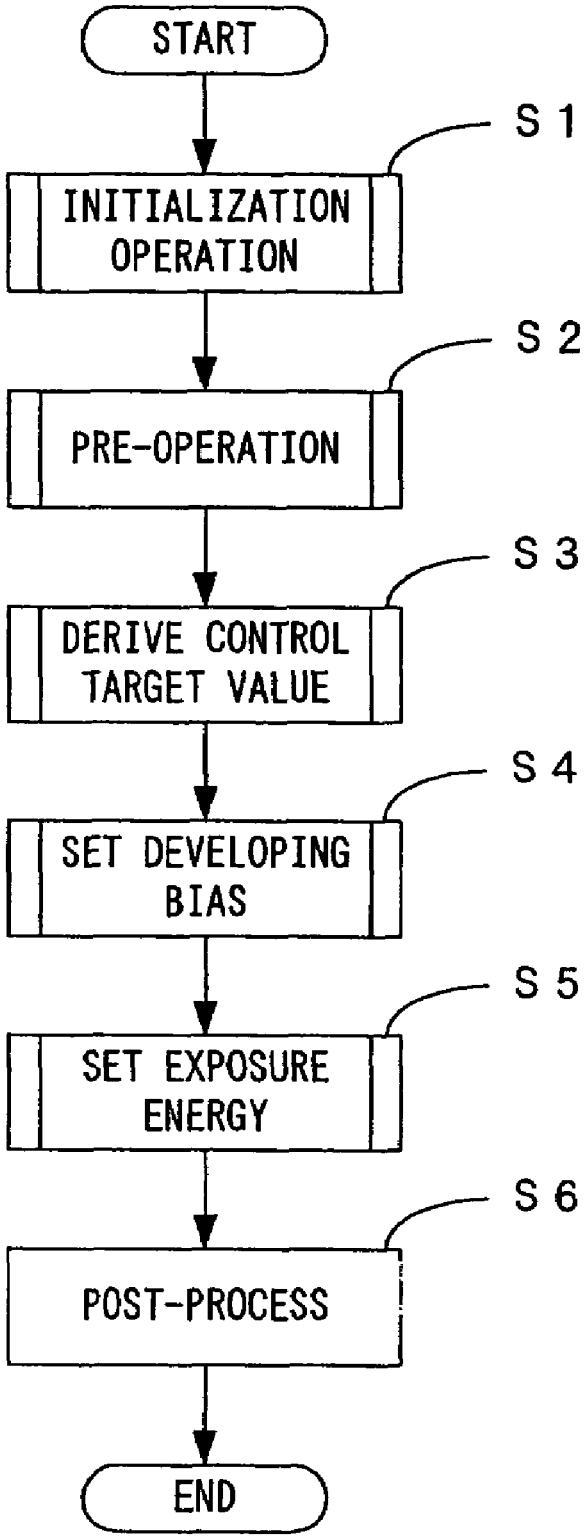
FIG. 8 is a flow chart showing the overview of an optimization process for the density control factor according to the first embodiment.

FIG. 8 is a flow chart showing the overview of an optimization process for the density control factor according to this embodiment. The optimization process includes 6 sequences: initialization operation (Step S1); pre-operation (Step S2); deriving control target value (Step S3); setting developing bias (Step S4); setting exposure energy (Step S5); and post-process (Step S6) which are carried out in the order named. The following description is made on the details of the operations on a sequence-by-sequence basis.

(A) Initialization Operation

Figure 9:
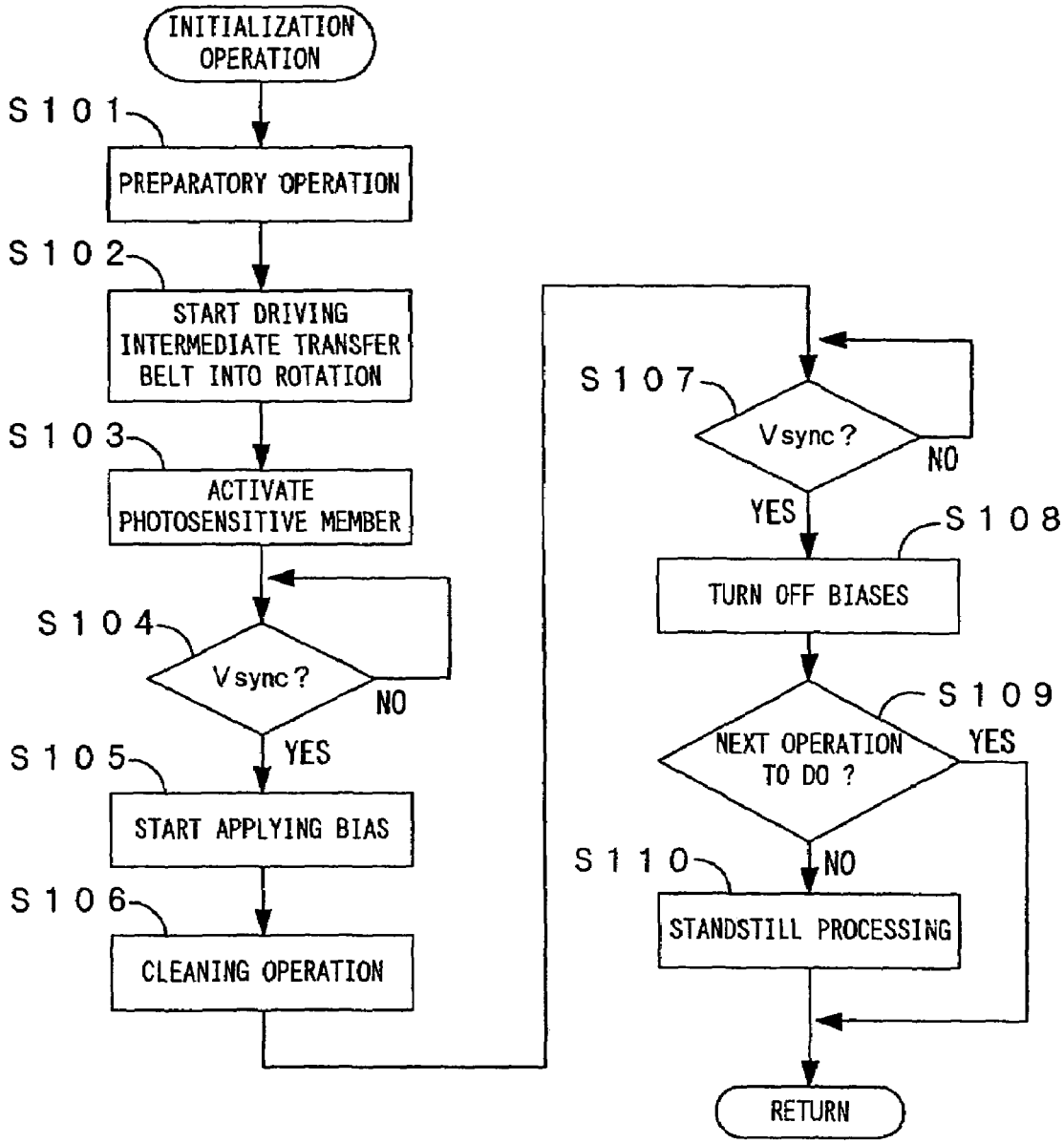
FIG. 9 is a flow chart representing the steps of an initialization operation according to the first embodiment.

FIG. 9 is a flow chart representing the steps of an initialization operation according to this embodiment. The initialization operation is started by carrying out a preparatory operation (Step S101) wherein the developing unit 4 is drivingly rotated for positioning at a so-called home position while the electromagnetic clutch is operated to move the cleaner 76 and the secondary transfer roller 78 to away positions from the intermediate transfer belt 71. In this state, the intermediate transfer belt 71 is driven into rotation (Step S102) and then, the photosensitive member 2 is activated by driving the same into rotation while subjecting the same to a discharging operation (Step S103).

Subsequently, the vertical synchronizing signal Vsync indicative of the reference position of the intermediate transfer belt 71 is detected to confirm the rotation of the belt (Step S104) and then, the application of predetermined biases to individual parts of the apparatus is started (Step S105). Specifically, the charging controller 103 applies a charging bias to the charger unit 3 for charging the photosensitive member 2 to a predetermined surface potential. Subsequently, a predetermined primary transferring bias is applied to the intermediate transfer belt 71 by means of a bias generator not shown.

In this state, a cleaning operation for the intermediate transfer belt 71 is started (Step S106). Specifically, the cleaner 76 is pressed against the surface of the intermediate transfer belt 71 which, in this state, is driven to make substantially one revolution so as to be cleaned of the toner and dirt remaining on its surface. Thereafter, the secondary transfer roller 78 applied with a cleaning bias is pressed against the intermediate transfer belt 71. The cleaning bias has the opposite polarity to that of a secondary transferring bias applied to the secondary transfer roller 78 during the execution of a normal image forming operation. Therefore, the toner remaining on the secondary transfer roller 78 is transferred to the surface of the intermediate transfer belt 71 and then, removed from the surface of the intermediate transfer belt 71 by means of the cleaner 76. When the cleaning operation of the intermediate transfer belt 71 and the secondary transfer roller 78 is completed, the secondary transfer roller 78 is moved away from the intermediate transfer belt 71 and the cleaning bias is turned OFF When the subsequent vertical synchronizing signal Vsync is given (Step S107), the charging bias and the primary transferring bias are turned OFF (Step S108).

This embodiment does not limit the execution of the initialization operation to the time when the optimization process for the density control factor is performed but permits the CPU 101 to perform the initialization operation independently from the other processes when required. Specifically, where the initialization operation is followed by the subsequent operation (Step S109), the initialization operation done up to Step S108 is terminated to proceed to the subsequent operation. Where, on the other hand, the subsequent operation is not to be performed, a standstill processing is performed (Step S110) wherein the cleaner 76 is moved away from the intermediate transfer belt 71 and the discharging operation and the rotation of the intermediate transfer belt 71 are terminated. At this time, the intermediate transfer belt 71 may preferably be stopped in a state where the reference position thereof is located at place immediately shy of a position opposite the vertical synchronization sensor 77. The reason is as follows. When the intermediate transfer belt 71 is driven into rotation in the subsequent operation, the rotating state of the belt is checked by way of the vertical synchronizing signal Vsync. Hence, the above approach allows for a quick determination as to the presence of abnormality based on whether the vertical synchronizing signal Vsync is detected immediately after the activation of the belt or not.

(B) Pre-Operation

Figure 10:
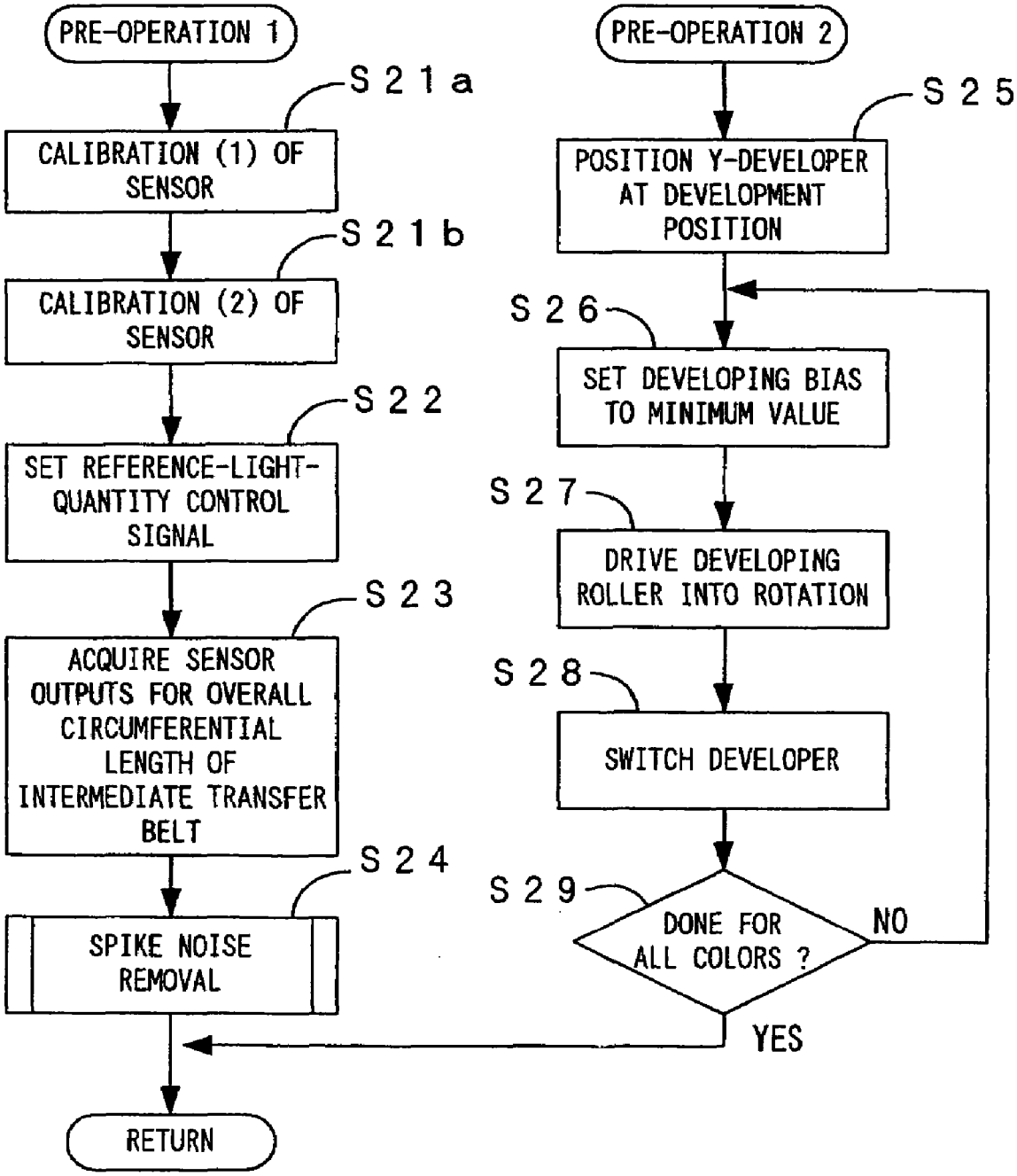
FIG. 10 is a flow chart representing the steps of a pre-operation according to the first embodiment.

FIG. 10 is a flow chart representing the steps of a pre-operation according to this embodiment. The pre-operation concurrently carries out two processings as the pre-operation to be done prior to the formation of the patch image to be described hereinlater. That is, in parallel with Pre-operation 1 for controlling operation conditions of the individual parts of the apparatus so as to ensure that the density control factor is optimized with high accuracies, Pre-operation 2 is carried out for idling the respective developing rollers 44 disposed in the developers 4Y, 4C, 4M, 4K.

(B-1) Setting Operation Conditions (Pre-Operation 1)

According to the left-hand operation flow shown in FIG. 10 (Pre-operation 1), the density sensor 60 is first calibrated (Steps S21*a*, S21*b*). In the calibration (1) at Step S21*a*, the output voltages Vp, Vs from the light receiver units 670*p*, 670*s* with the light emitter element 601 of the density sensor 60 placed in the OFF state are detected and stored as dark outputs Vp0, Vs0. In the subsequent calibration (2) at Step S21*b*, the light-quantity control signal Slc applied to the light emitter element 601 is so varied as to establish two lighting states of low light intensity and high light intensity, while output voltages Vp provided by the light receiver unit 670*p* at the respective light intensities are detected. Then based on the three values, a reference amount of light from the light emitter element 601 is determined such that an output voltage Vp provided in a toner free state may reach a predetermined reference level (a value obtained by adding the dark output Vp0 to 3V according to this embodiment). Thus, a level of the light-quantity control signal Slc is determined that provides the reference amount of light from the light emitter element 601 and then, the value thus determined is set as a reference-light-quantity control signal (Step S22). From this time on, whenever need arises for activating the light emitter element 601, the CPU 101 outputs the reference-light-quantity control signal to the irradiation-light-quantity regulating unit 605, so that the light emitter element 601 is subjected to the feedback control for emitting the reference amount of light every time.

The output voltages Vp0, Vs0 when the light emitter element 601 is in the OFF state are stored as the "dark output" of the sensor system. As will be described hereinlater, when the density of a toner image is detected, the individual dark output values are subtracted from the respective output voltages Vp, Vs thereby to eliminate the influences of the dark outputs. This permits the density of the toner image to be detected with even higher accuracies.

When the light emitter element 601 is in the ON state, the output signal from the light receiver element 672*p* depends upon the amount of reflection light form the intermediate transfer belt 71. However, the intermediate transfer belt 71 does not necessarily have an optically consistent surface condition, as will be described hereinlater and therefore, it is preferred to take an average value of outputs with respect to the overall circumferential length of the intermediate transfer belt 71 in the determination of the output in this state. When the light emitter element 601 is in the OFF state, on the other hand, there is no need for detecting the output signals with respect to the overall circumferential length of the intermediate transfer belt 71. However, output signals for some points may preferably be averaged in order to reduce detection errors.

According to this embodiment, the intermediate transfer belt 71 has a white surface, thus having a high reflectivity of light. When a toner of any of the colors adheres to the belt 71, the reflectivity thereof is decreased. In this embodiment, therefore, as the amount of toner adhered to the surface of the intermediate transfer belt 71 increases, the output voltages Vp, Vs from the light receiver unit are correspondingly decreased from the reference level. Thus, the amount of toner adhesion or the image density of the toner image can be estimated from the magnitude of these output voltages Vp, Vs.

Considering a fact that the color toners (Y, C, M) have different light reflection characteristics from that of the black toner (K), this embodiment determines the density of a patch image formed of the black toner (to be described hereinlater) based on the amount of p-polarized light of the reflection light from the above patch image, but determines the density of a patch image formed of a color toner based on a ratio between the amounts of p-polarized light and s-polarized light. Therefore, this embodiment provides accurate determination of the image density over a wide dynamic range.

Now returning to FIG. 10, the description on the pre-operation is continued. The intermediate transfer belt 71 does not necessarily have the consistent surface conditions. Furthermore, over time of service, the intermediate transfer belt 71 may suffer change in color or contamination because of the gradual accumulation of toner fused thereto or the like. In order to avoid the detection errors of the toner image density associated with such changes in the surface conditions of the intermediate transfer belt 71, this embodiment acquires a base profile of the intermediate transfer belt 71 for the overall circumferential length thereof or information on the degrees of density of the surface of the intermediate transfer belt 71 bearing no toner image thereon. Specifically, under irradiation of the previously determined reference amount of light from the light emitter element 601, the intermediate transfer belt 71 is rotated to make one revolution while the output voltages Vp, Vs from the light receiver units 670*p*, 670*s* are sampled (Step S23). Individual sample data pieces (the number of samples in this embodiment: 312) as the base profile are stored in a RAM 107. In this manner, the information on the degrees of density at individual surface portions of the intermediate transfer belt 71 is previously acquired so that the density of the toner image formed on the belt may be more accurately estimated. In this respect, details will be described in conjunction with the embodiment to be hereinafter described.

Figure 11A:
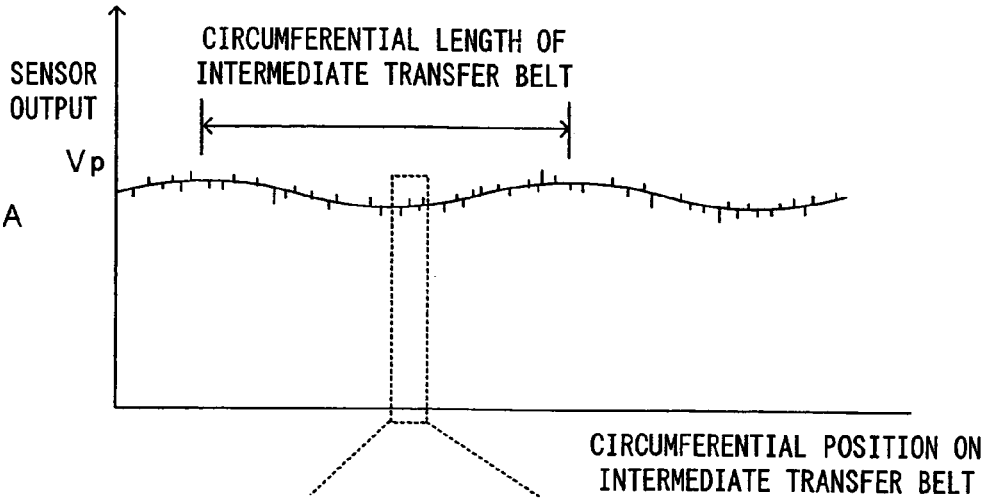
FIG. 11 are graphs illustrating an example of a base profile of an intermediate transfer belt.
Figure 11B:
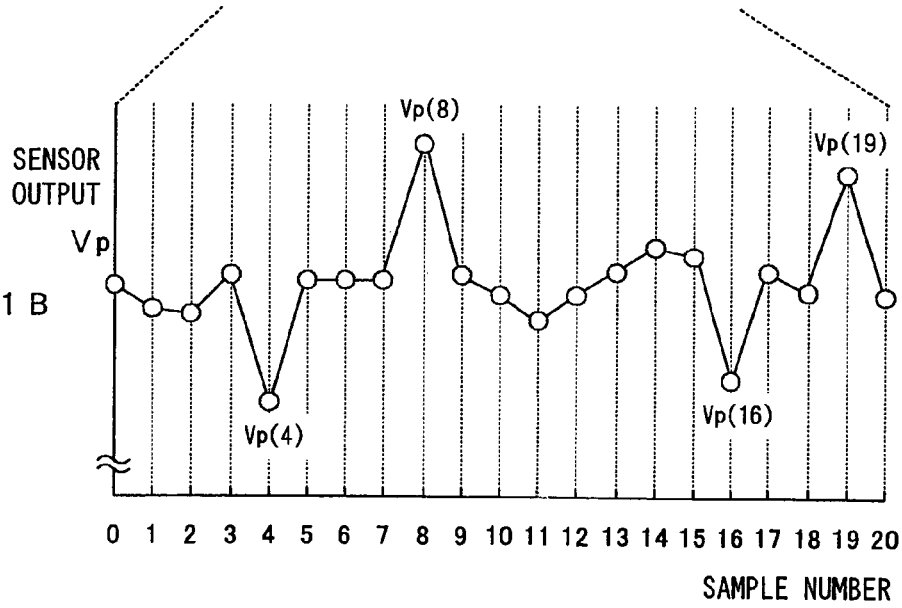

In cases, spike noises may be superimposed on the above-mentioned output voltages Vp, Vs from the density sensor 60, the spike-like noises caused by varied reflectivities by minor contamination or flaws on the roller 75 and intermediate transfer belt 71, electrical noises entering sensor circuits and the like. FIG. 11 are graphs illustrating an example of the base profile of the intermediate transfer belt. Amounts of reflection light from the surface of the intermediate transfer belt 71 are sampled for the overall circumferential length or more thereof by means of the density sensor 60 and the samples thus obtained are plotted. As shown in FIG. 11A, the output voltages Vp from the sensor 60 not only exhibit periodical variations in correspondence to the circumferential length of the intermediate transfer belt 71 or the period of rotation thereof, but also have waveforms with thin spike-like noises superimposed thereon. The noises may possibly contain both a component synchronized with the above period of rotation and an irregular component out of synchronism therewith. FIG. 11B is an enlarged view of a part of such a sample data array. According to this figure, because of superimposition of the noises, two data pieces represented by Vp(8) and Vp(19) indicate abruptly increased values from those of the others, whereas two data pieces represented by Vp(4) and Vp(16) indicate abruptly decreased values from those of the others. While the description is made on the p-polarized light component of the two sensor outputs, the same can be said as to the s-polarized light component.

A detection spot of the density sensor 60 has a diameter on the order of 2 to 3 mm. On the other hand, the color change or contamination of the intermediate transfer belt 71 is generally thought to occur in a larger area than the detection spot. Therefore, such a data piece representing a locally outstanding value can be considered to be affected by the above noises. If such sample data with the noises superimposed thereon are used to determine the base profile or the density of the patch image and then, the density control factor is defined based on the resultant base profile or the patch image density, the density control factor may not always be set to its optimum state. This may result in the degradation of the image quality.

On this account, this embodiment carries out Step S23 to sample the sensor outputs for the overall circumferential length of the intermediate transfer belt 71 and thereafter, performs a spike noise removal process (Step S24), as shown in FIG. 10.

Figure 12:
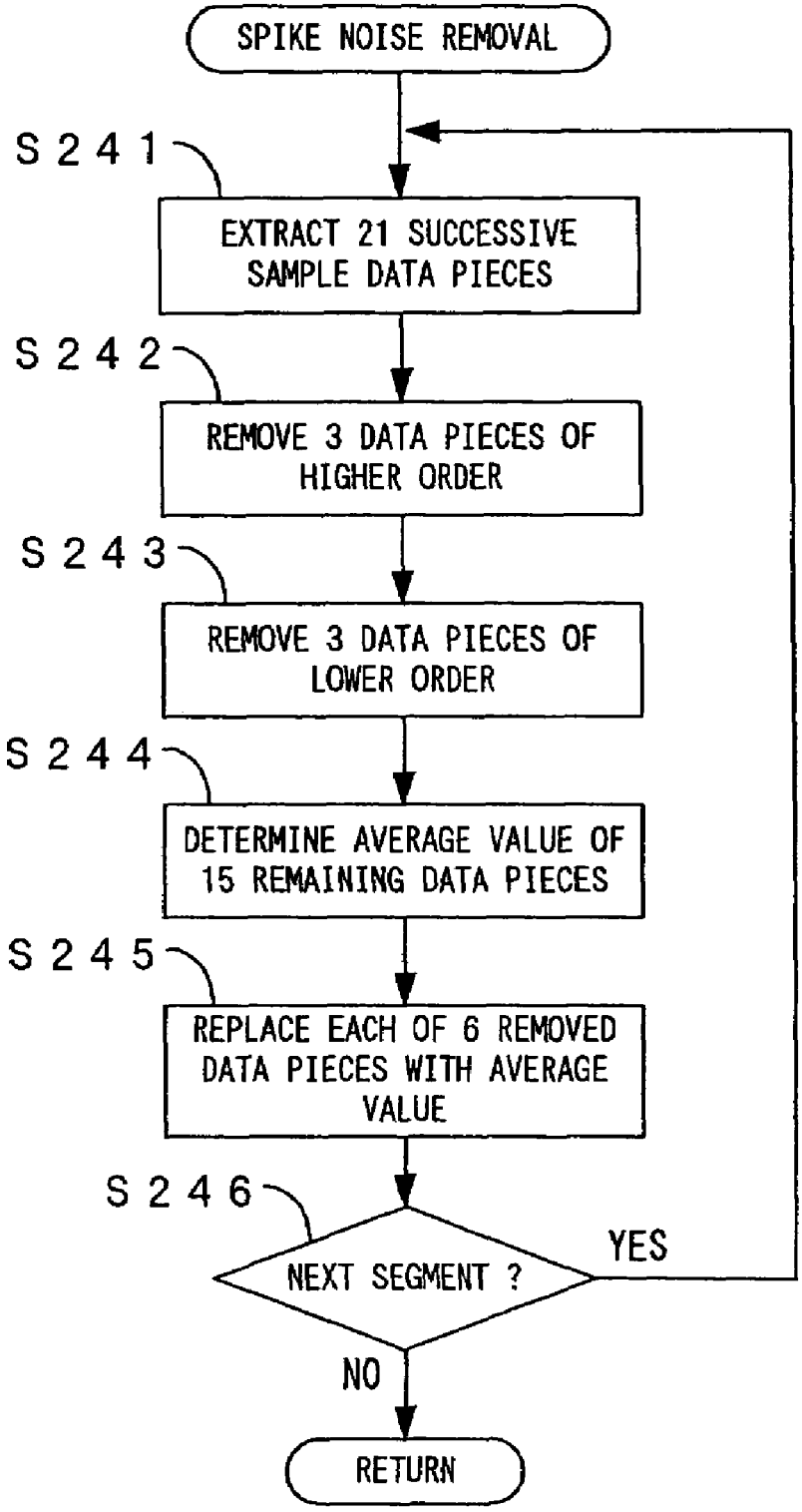
FIG. 12 is a flow chart representing the steps of a spike noise removal process according to the first embodiment.

FIG. 12 is a flow chart representing the steps of a spike noise removal process according to this embodiment. In the spike noise removal process, a segment of successive samples (of a length equivalent to 21 successive sample data pieces according to this embodiment) is extracted from a "raw" or unprocessed sample data array thus acquired (Step S241). Then, 3 data pieces at levels of higher order and 3 data pieces at levels of lower order are removed from the 21 sample data pieces of the segment of interest (Steps S242, S243). Subsequently, an arithmetic average of the remaining 15 data pieces is determined (Step S244). The resultant average value is regarded as an average level of this segment and substituted for each of the 6 data pieces removed in Steps S242 and 243 whereby a "corrected" sample data array removed of the noises is obtained (Step S245). As required, the Steps S241 to S245 are repeated on the subsequent segment to remove the spike noises therefrom in the same way (Step S246).

Figure 13:
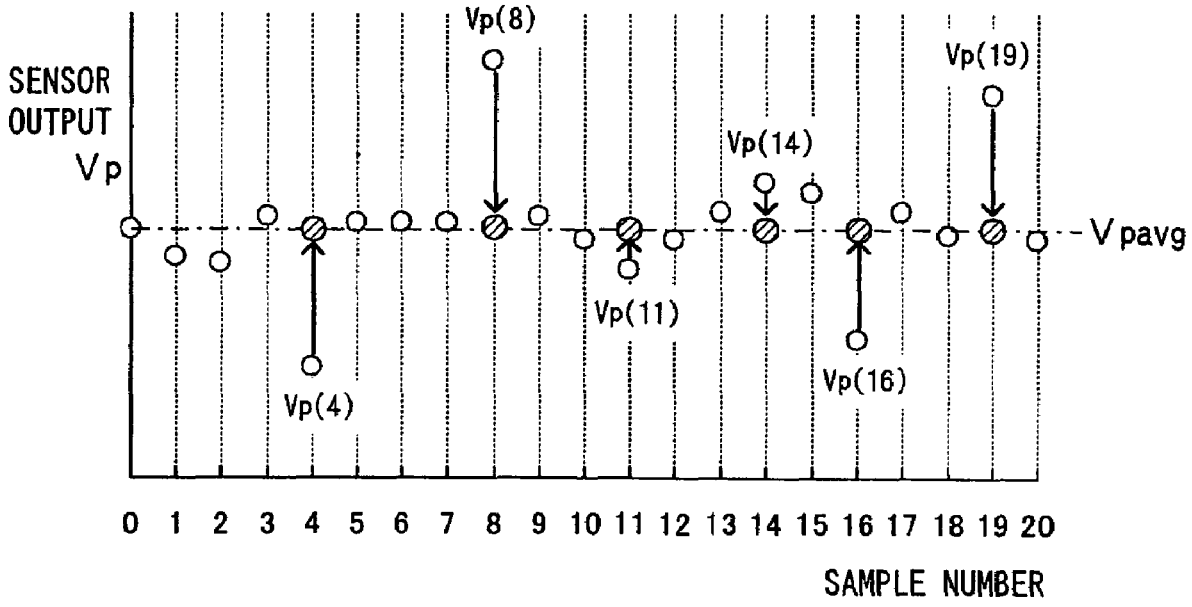
FIG. 13 is a graph showing how the spike noises are removed according to the first embodiment.

Now referring to FIG. 13, the above process for removing the spike noises is described in more details by way of example of the data array shown in FIG. 11B. FIG. 13 is a graph showing how the spike noises are removed according to this embodiment. In the data array shown in FIG. 11B, the two data pieces Vp(8) and Vp(19) of abruptly increased values and the data pieces Vp(4) and Vp(16) of abruptly decreased values from those of the other data pieces are considered to be affected by the noises. In the spike noise removal process, the three data pieces of higher order are removed from the sample data (Step S242 in FIG. 12). That is, three data pieces Vp(8), Vp(14) and Vp(19) including the two data pieces considered to contain the noises are removed from the sample data. Likewise, three data pieces Vp(4), Vp(11) and Vp(16) including the two data pieces considered to contain the noises are also removed (Step S234 in FIG. 12). As shown in FIG. 13, each of the six data pieces is replaced with the average value Vpavg (represented by cross-hatched circle) of the other 15 data pieces, whereby the spike noises contained in the original data array are removed.

In the execution of the spike noise removal, the number of samples to be extracted and the number of data pieces to be removed are not limited to the above and may be arbitrarily decided. However, there is a fear that some selected number of samples or data pieces may lead to inability to achieve an adequate effect of spike noise removal and besides to a case where the errors are rather increased. Therefore, it is desirable to carefully decide the number of samples or data pieces to be extracted or removed in view of the following points.

Where an extracted segment of data pieces is too short relative to the frequency of noise occurrence, it is more likely that the segment subjected to the noise removal process contains no noises. Furthermore, such a short subject segment of the process leads to an increased number of calculation operations and thence, to a low efficiency. Where, on the other hand, the extracted segment of data pieces is too long, significant variations of the sensor outputs or the amount of variations reflecting the density variations of sample objects are also averaged. As a result, the correct density profile as the essential object cannot be obtained.

Furthermore, the frequency of the noise occurrence is not constant. If, therefore, respective groups of a predetermined number of data pieces of higher order and of lower order are simply removed from the extracted data segment on a set basis, there is a possibility of removing even a data piece free from noises, as exemplified by the above data pieces Vp (11) and Vp(14), or of conversely failing to remove the noises fully. Even if some of the data pieces free from the noises are removed, these data pieces Vp(11) and Vp(14) each have a relatively small difference from the average value Vpavg, as shown in FIG. 13. Accordingly, the replacement of these data pieces with the average value Vpavg results in a minor error. On the other hand, where a data piece containing the noises is left unremoved, the errors may be rather increased by replacing the removed data pieces with an average value determined from data pieces including such a data piece containing the noises. Therefore, it is preferred that a ratio of the number of data pieces to be removed based on the number of extracted samples is defined to be equal to or slightly greater than the frequency of noise occurrence in the apparatus actually used.

This embodiment arranges the spike noise removal process in the aforementioned manner based on the empirical facts, as shown in FIG. 11A, that a frequency of the data pieces deviated to the higher level than the true profile due to the influences of the noises is substantially equal to that of the data pieces deviated to the lower level, and that the frequency of the noises themselves is at 25% or less (5 or less samples out of the 21 samples).

There may be contemplated various other processes than the above spike noise removal process. For instance, the spike-like noises can also be removed by subjecting the "raw" sample data acquired by sampling to a conventionally known low-pass filtering process. However, the conventional filtering process can reduce the sharpness of the noise waveforms but produces a result that not only a data piece containing the noises but also its neighboring data pieces are deviated from their true values. Hence, the conventional process involves a fear of detrimentally producing significant errors depending upon the state of occurred noises.

In contrast, this embodiment is less likely to produce such significant errors because, out of the sample data pieces, a number of data pieces of higher/lower order in correspondence to the frequency of noise occurrence are each replaced with the average value while the other data pieces are left intact.

The spike noise removal process is performed not only in the determination of the aforesaid base profile but also on sample data for acquisition of the amount of reflection light when the image density of the toner image is determined, as will be described hereinlater.

(B-2) Idling Developer (Pre-Operation 2)

It has been conventionally known that after a lapse of a long period of time during which the image forming apparatus, in the OFF state or ON state of the power source, is at a standstill, the image forming apparatus operated for image formation may sometimes produce an image sustaining periodical density variations. Such a phenomenon is referred herein as "shutdown-induced banding". The inventors of the present invention have found that the shutdown-induced banding phenomenon results from the following cause. That is, after left to stand as borne on the developing roller 44 of each developer for long hours, the toner has become less prone to leave the developing roller 44. Furthermore, the degree of the toner adhesion varies from surface portion to surface portion of the developing roller 44 so that the toner layer on the developing roller 44 is gradually varied in thickness. In the developer 4K of this embodiment shown in FIG. 3 wherein the developing roller 44 is at a standstill, for example, the feed roller 43 and the regulator blade 45 are each pressed against a part of the surface of the developing roller 44. Furthermore, the developing roller 44 is covered with a large amount of toner at its surface portion accommodated in the housing 41, whereas the other surface portion thereof that projects from the housing 41 is exposed to the atmosphere as bearing a thin toner layer thereon. In this manner, the surface conditions of the developing roller 44 are varied along the circumferential direction thereof.

In a case where the apparatus with the developing roller 44 varied in the surface conditions is placed in standstill for long hours and then, performs the optimization process for the density control factor before carrying out the subsequent image forming operation, there is a fear that the density variations of a patch image resulting from the shutdown-induced banding phenomenon will affect the optimization process.

Accordingly, the image forming apparatus of this embodiment idles the individual developing rollers 44 prior to the formation of the patch image, so as to eliminate the shutdown-induced banding phenomenon. Specifically, as indicated by the right-hand operation flow (Pre-operation 2) shown in FIG. 10, the yellow developer 4Y is first positioned at the development position opposite the photosensitive member 2 (Step S25). The direct current developing bias Vavg is set such that the absolute value thereof is at the minimum in its variable range (Step S26) and then, the rotary drive section of the main body causes the developing roller 44 to make at least one revolution (Step S27). Subsequently, the developing unit 4 is turned to switch to another developer (Step S28). Thus, the other developers 4C, 4M, 4K are positioned at the development position in turn for driving the respective developing rollers 44 thereof to make one or more revolutions. In this manner, the developing rollers 44 are each idled for one or more revolutions whereby the toner layer on the surface of each developing roller 44 is once removed and then re-formed by means of the feed roller 43 and the regulator blade 45. Accordingly, a consistent toner layer thus re-formed is committed to the subsequent patch image formation and hence, the density variations caused by the shutdown-induced banding phenomenon is less likely to occur.

In the above pre-operation 2, Step S26 sets the direct current developing bias Vavg to the absolute minimum value for the following reasons.

As will be described hereinlater, the greater the absolute value |Vavg| of the direct current developing bias Vavg as the density control factor affecting the image density, the higher the density of the resultant toner image. This is because with increase in the absolute value |Vavg| of the direct current developing bias, accordingly increased is a potential difference between a surface region of the photosensitive member 2 that is defined by an electrostatic latent image formed by irradiation with the light beam L, or the surface region allowing the toner to adhere thereto, and the developing roller 44. The increased potential difference further promotes toner transfer from the developing roller 44. However, it is undesirable that such promoted toner transfer takes place when the base profile of the intermediate transfer belt 71 is acquired. The reason is that if the toner transferred from the developing roller 44 to the photosensitive member 2 is further transferred to the intermediate transfer belt 71 in the primary transfer region TR1, the amount of reflection light from the intermediate transfer belt 71 is erroneously changed so that a correct base profile cannot be obtained.

According to this embodiment, the direct current developing bias Vavg as one of the density control factors can be varied stepwise in a predetermined variable range, as will be described hereinlater. Thus, the direct current developing bias Vavg is set to the minimum absolute value in the variable range for establishing a state where the toner transfer from the developing roller 44 to the photosensitive member 2 is least likely to occur. By doing so, the toner adhesion to the intermediate transfer belt 71 is minimized. For the same reason, the apparatus using the developing bias containing the alternating current component may preferably set the amplitude of the bias to a smaller value than that of the bias applied in normal image forming process. In the apparatus setting the amplitude Vpp of the developing bias to 1400V, for example, it is preferred to set this amplitude Vpp to 1000V or so. In an apparatus using a parameter other than the direct current developing bias Vavg as the density control factor, such as a duty ratio of the developing bias or charging bias, as well, it is preferred to set the density control factor in a proper manner to establish a state where the toner transfer is less likely to occur.

This embodiment aims at reducing the process time by concurrently carrying out the aforementioned pre-operation 1 and the pre-operation 2. Specifically, the pre-operation 1 requires the intermediate transfer belt 71 to make 3 revolutions in total, of which at least 1 revolution is for acquiring the base profile and 2 revolutions are for sensor calibration. On the other hand, the pre-operation 2 preferably causes the individual developing rollers 44 to make as many revolutions as possible. These operations can be performed independently from each other. Therefore, the concurrent execution of these operations makes it possible to reduce the time taken to perform the all steps of the optimization process while dedicating required time to each of the operations.

(C) Deriving Control Target Value

As described later, the image forming apparatus of this embodiment is designed to form two types of toner images as the patch image and controls the individual density control factors in a manner that each patch image may accomplish a predetermined density target value. It is noted that the target value is not fixed but variable according to working conditions of the apparatus. The reason is as follows.

As mentioned supra, the image forming apparatus of this embodiment estimates the image density by detecting the amount of reflection light from a toner image primarily transferred onto the surface of the intermediate transfer belt 71 after developed into a visible image on the photosensitive member 2. While such a technique for determining the image density from the amount of reflection light from the toner image has heretofore been used widely, a consistent correlation (to be described in details hereinlater) is not established between the amount of reflection light from the toner image borne on the intermediate transfer belt 71 (or the corresponding sensor outputs Vp, Vs from the density sensor 60) and the optical density (OD value) of a toner image formed on the sheet S as the final receiving material but the correlation is delicately varied depending upon the conditions of the apparatus or the loner. Accordingly, even if the individual density control factors are so controlled as to ensure a given amount of reflection light from the toner image just as practiced in the prior art, the density of the image finally formed on the sheet S will be varied according to the conditions of the toner.

Figure 14A:
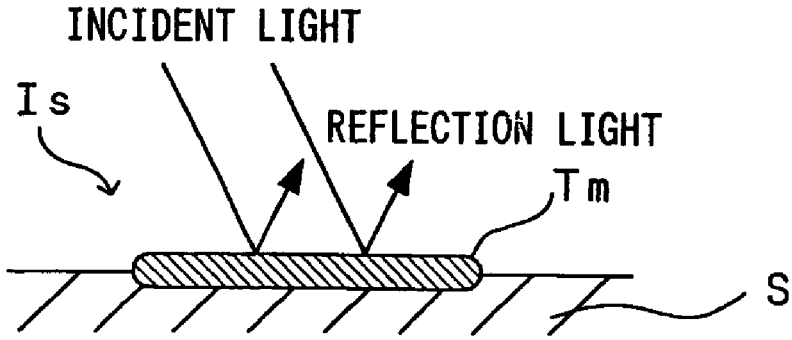
FIG. 14 are schematic diagrams each showing a relation between the toner particle size and the amount of reflection light.

One of the causes of the inconsistency between the sensor output and the OD value on the sheet S is that the toner fused onto the sheet S by a fixing process has a different reflective state from that of the toner unfixed to but simply adhered to the surface of the intermediate transfer belt 71. FIG. 14 are schematic diagrams each showing a relation between the toner particle size and the amount of reflection light. In an image Is finally formed on the sheet S, as shown in FIG. 14A, a toner Tm is fused to the sheet S due to heat and pressure applied in the fixing process. Thus, while the optical density (OD value) of the above image represents the amount of reflection light from the fused toner, the value of the optical density is mainly dependent upon the density of the toner on the sheet S (e.g., the mass of toner per unit area).

Figure 14B:
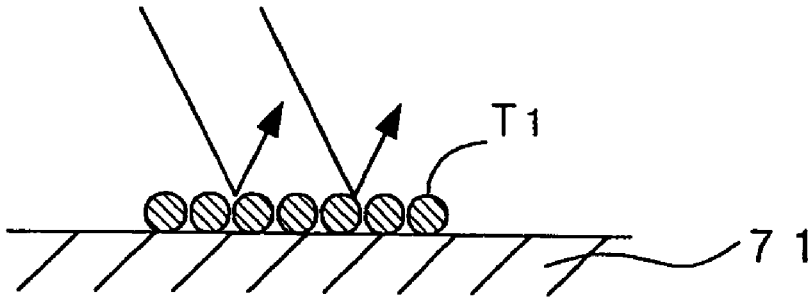
Figure 14C:
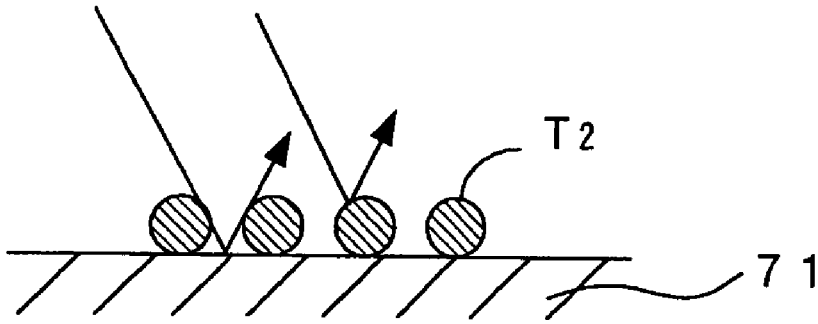

In a toner image formed on the intermediate transfer belt 71 and not subjected to the fixing process, on the other hand, individual toner particles are simply adhered to the surface of the intermediate transfer belt 71. Therefore, even in the same toner density (that is, post-fixing OD values are equal), a state where a toner T1 of a smaller particle size is adhered in higher density, as shown in FIG. 14B for example, does not always present the same amount of reflection light as a state where a toner T2 of a greater particle size is adhered in a lower density to the surface of the intermediate transfer belt 71 partially exposing the surface thereof, as shown in FIG. 14C. In other words, two toner images presenting the same pre-fixing amount of reflection light do not always present the same post-fixing image density (OD value). The inventors of the present invention have empirically found that given that the amount of reflection light is the same, the image density of the fixed toner image generally tends to increase with increase in the proportion of larger toner particles based on the overall toner particles constituting the toner image.

Thus, the correlation between the OD value on the sheet S and the amount of reflection light from the toner image on the intermediate transfer belt 71 varies depending upon the state of the toner or particularly the particle size distribution thereof. FIG. 15 are graphs showing the correspondence between the particle size distribution of toner and the variation of the OD value. It is ideal that all the toner particles contained in each developer for forming the toner image have a particle size at a design central value. In actual fact, however, the toner particle sizes are distributed in various manners as shown in FIG. 15A. While the particle size distribution naturally varies depending upon the type or the production method of the toner, even a toner produced based on the same specifications have the particle size distribution delicately varied from production lot to lot, or from product package to package.

Such toner particles of different sizes have different masses or charge amounts. When the image formation is performed using the toner of such a particle size distribution, the toner particles are not uniformly consumed but toner particles of a particle size suited to the apparatus are selectively consumed whereas the other toner particles are consumed less so as to remain in the developer. Therefore, as the toner is consumed more, the particle size distribution of the toner remaining in the developer is varied accordingly.

As mentioned supra, the amount of reflection light from a pre-fixing toner image varies depending upon the particle size of the toner constituting the image. Hence, if each density control factor is so controlled as to ensure a constant amount of reflection light, the density of the image fixed to the sheet S does not always present a constant value. FIG. 15B shows how the optical density (OD value) of the image on the sheet S varies when the image formation is carried out with the density control factors so controlled as to ensure a constant amount of reflection light from the toner image or a constant output voltage from the density sensor 60. In a case where the toner particle sizes approximate to the design central value as indicated by a curve 'a' in FIG. 15A, the OD value is substantially maintained at a target value, as indicated by a curve 'a' in FIG. 15B, despite the increase in the amount of consumed toner in the developer. In contrast, in a case where a toner having a broader particle size distribution is used, as indicated by a curve 'b' in FIG. 15A, the OD value is initially maintained in proximity of the target value because toner particles of a size near the design central value are primarily consumed. However, the OD value is progressively increased as indicated by a curve 'b' in FIG. 15B, because with increase in the amount of consumed toner, the proportion of such toner particles is progressively decreased and in stead, toner particles of larger sizes are used for the image formation. As indicated by each dot line in FIG. 15A, there may be a case where in association with a certain toner or a developer of a certain production lot, the central value of the distribution is deviated from the design central value from the beginning. In correspondence to this, the OD value on the sheet S is also varied in various ways as the amount of consumed toner increases, as indicated by individual dot lines in FIG. 15B.

Such factors affecting the characteristics of the toner include not only the aforementioned particle size distribution of the toner but also, for example, a state of pigment dispersed in toner mother particles, change in toner chargeability due to mixture state of the toner mother particles and a material externally added thereto, and the like. Since the toner characteristics delicately vary from product package to package, the image density on the sheet S is not necessarily at a constant value while the degree of density variations differs depending upon the used toner. Therefore, in the conventional image forming apparatus designed to control the density control factors in a manner to ensure a constant output voltage from the density sensor, the variations of the image density associated with the varied toner characteristics are unavoidable. As a result, it is not always ensured that a satisfactory image quality is attained.

Figure 16:
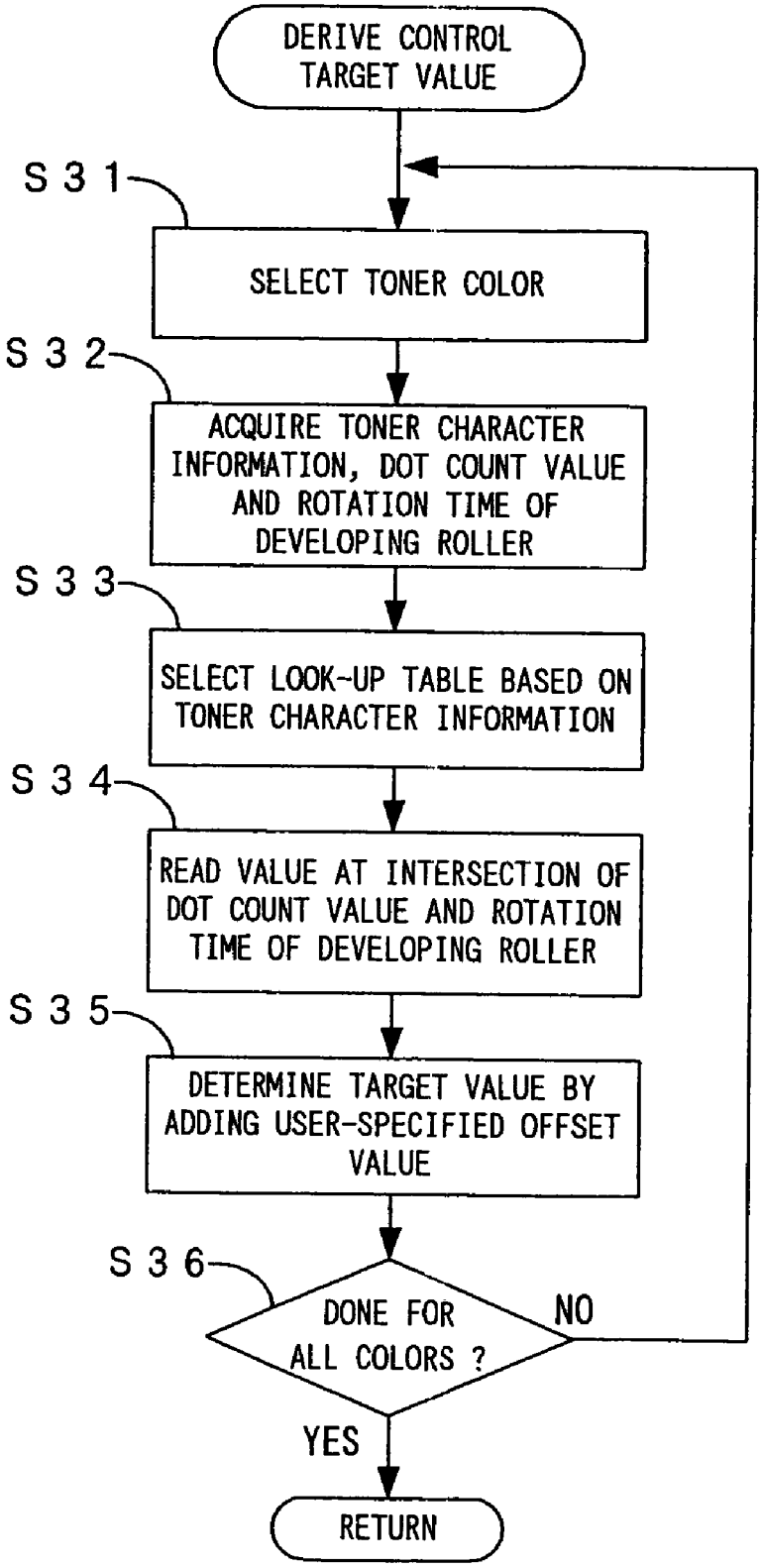
FIG. 16 is a flow chart representing the steps of a process for deriving a control target value according to the first embodiment.

In this connection, this embodiment takes the following approach to ensure a constant image density on the sheet S. That is, a control target value of an evaluation value (described later) for image density is defined for each of two types of patch images (to be described hereinlater) according to the working conditions of the apparatus, the evaluation value determined from the output from the density sensor 60 and serving as a yardstick representing the image density. Then, the individual density control factors are so controlled as to provide an evaluation value of each patch image which is equivalent to the control target value, thereby achieving the constant image density on the sheet S. FIG. 16 is a flow chart representing the steps of a process for deriving the control target value according to this embodiment. The process determines a suitable control target value for each of the toner colors according to the conditions of use of the toner or more specifically, initial characteristics, such as particle size distribution of the toner charged in each developer, and the amount of toner remaining in the developer. First, one of the toner colors is selected (Step S31). Then, the CPU 101 acquires toner character information on the selected toner color, a dot count value indicative of the number of dots formed by the exposure unit 6, and information on a rotation time of the developing roller, as the information used for estimating the conditions of use of the selected toner (Step S32). While the description is given here by way of example of a case where a control target value for the black color is determined, the same procedure may be taken to determine the target control values for the other toner colors.

The "toner character information" means the characteristics of the toner charged in the developer 4K. Taking it into consideration that the various characteristics, such as the particle size distribution, of the toner vary depending upon the production lot and the like, the apparatus classifies the character of the toner into 8 types. Based on which of these types the toner in the developer belongs to, the apparatus selects one of plural look-up tables (to be described hereinlater) to refer to in the determination of the control target value.

The "dot count value" is an information item, from which the amount of toner remaining in the developer 4K is estimated. The most convenient method for estimating the amount of remaining toner is to calculate from the integrated value of the number of formed images. However, it is difficult for this method to give a correct amount of remaining toner because the amount of toner consumed for forming one image is not constant. On the other hand, the number of dots formed on the photosensitive member 2 by means of the exposure unit 6 indicates the number of dots to be visualized with the toner on the photosensitive member 2, thus reflecting the toner consumption more accurately. Therefore, this embodiment keeps count of the number of dots formed by the exposure unit 6 to produce the electrostatic latent image on the photosensitive member 2, the latent image to be developed by the developer 4K, and then stores the resultant dot count value in the RAM 107. The dot count value is used as a parameter indicative of the amount of toner remaining in the developer 4K.

The "rotation time of the developing roller" is an information item used for more specific estimation of the characteristics of the toner remaining in the developer 4K. As mentioned supra, the toner layer is formed on the surface of the developing roller 44 and the developing process is effected by transferring a part of the toner to the photosensitive member 2. In this process, the toner not subjected to the development remains on the surface of the developing roller 44 to be transported to place where the developing roller 44 abuts against the feed roller 43 which, in turn, scrapes off the remaining toner while forming a new toner layer. As repeatedly made to adhere to or scraped off from the developing roller 44, the toner is fatigued so that the characteristics thereof are gradually changed. Such a change in the toner characteristics proceeds with the increase in the number of rotations of the developing roller 44. Thus, even though the amount of toner remaining in the developer 4K is unchanged, for example, the fatigued toner repeatedly subjected to the adhesion and scraping may have different characteristics from those of a fresh toner. Hence, images formed from these toners do not necessarily have the same density.

Therefore, this embodiment estimates the state of the toner contained in the developer 4K based on a combination of two parameters including the dot count value indicative of the amount of remaining toner and the developing-roller rotation time indicating the degree of change in the toner characteristics. This embodiment defines a more specific control target value conforming to the state of the toner, thereby ensuring the consistent image quality.

These information items are also used for managing the damage and wear of the individual parts of the apparatus thereby enhancing the quality of maintenance services. Specifically, 1 dot count is equivalent to 0.015 mg of toner, while a dot count of 12000000 is substantially equivalent to a toner consumption of 180 g which means that the most of the toner contained in each developer is used up. As to the developing-roller rotation time, an integrated value of 10600 sec is equivalent to continuous printing on 8000 sheets of A-4 size. From the viewpoint of the image quality, it is undesirable to continue the image forming operation from this time onward. When either of these information items reaches the corresponding value mentioned above, this embodiment causes an unillustrated indicator portion to display a message indicative of "Toner End" for suggesting a user to replace the developers.

Based on the information items on the working conditions of the apparatus thus acquired, the control target value is decided in accordance with the present conditions. This embodiment requires to calculate in advance through experiments optimum control target values which are proper to the toner character information which expresses the toner type and to the characteristics of the remaining toner estimated based on the combination of the dot count value and the developing-roller rotation time. These values are stored in the ROM 106 of the engine controller 10 in the form of the look-up table for each toner type. Based on the toner character information, the CPU 101 selects one of the look-up tables that corresponds to the toner type and is used for reference purpose (Step S33). Then from the selected look-up table, the CPU 101 reads out a value corresponding to a combination of a dot count value and a developing-roller rotation time at this point of time (Step S34).

The image forming apparatus of this embodiment is arranged to permit the user to perform predetermined input operations via an unillustrated operation portion thereby to increase or decrease the density of an image to be formed to a desired or required degree within a given range. In short, every time the user increases or decreases the image density by one notch in response to the value thus read out from the look-up table described above, a predetermined offset value which may be 0.005 per notch for instance is added or subtracted, and the result of this is set as a control target value Akt for the black color at that time and stored in the RAM 107 (Step S35). The control target value Akt for the black color is determined in this manner.

FIG. 17 show examples of the look-up table based on which the control target value is determined. These look-up tables are referred to when a toner having a black color and characteristics classified as "type 0" is used. In this embodiment, eight kinds of tables corresponding to the eight types of toner characteristics of each toner color are prepared for each of the two types of patch images of high density and low density described later. The look-up tables are stored in the ROM 106 of the engine controller 10. FIG. 17A illustrates an example of the table corresponding to the high-density patch image, whereas FIG. 17B illustrates an example of the table corresponding to the low-density patch image.

Where the toner character information indicates "type 0", for example, Step S33 selects the table shown in FIG. 17 corresponding to the toner character information "0" from the eight kinds of look-up tables. Then, based on the acquired dot count value and developing-roller rotation time, the control target value Akt is determined. Where the dot count value is at 1500000 counts and the developing-roller rotation time is at 2000 sec, for example, 0.984 corresponding to the combination of these values is selected from the table of FIG. 17A, as a control target value Akt for the high-density patch image. Where the user sets the image density to a value 1 level higher than the standard density, 0.005 is added to the selected value to give a control target value Akt of 0.989. The control target value for the low-density patch image may be determined in the same way.

The control target value Akt thus determined is stored in the RAM 107 of the engine controller 10 such that, in the subsequent steps, the individual density control factors may be so defined as to provide an evaluation value equivalent to the control target value, the evaluation value determined based on the amount of reflection light from the patch image.

While the control target value for one of the toner colors is determined by carrying out the above Steps S31 to S35, the above procedure may be repeated on each of the other toner colors (Step S36), thereby obtaining the control target values Ayt, Act, Amt and Akt for all the toner colors. It is noted that the respective subscripts y, c, m and k represent the toner colors of yellow, cyan, magenta and black, respectively, whereas the subscript t represents the control target value.

(D) Setting Developing Bias

According to this image forming apparatus, the direct current developing bias Vavg applied to the developing roller 44 and the per-unit-area energy E of exposure light beam L (hereinafter, referred to simply as "exposure energy") irradiated on the photosensitive member 2 are defined to be variable. Thus, the apparatus is adapted to control the image density by adjusting these parameters. Now, description is made on a case where respective optimum values of the direct current developing bias Vavg and of the exposure energy E are determined, provided that the direct current developing bias Vavg may be varied in 6 steps of level V0 to level V5 in the order of increasing magnitude, whereas the exposure energy E may be varied in 4 steps of level 0 to level 3 in the order of increasing energy. It is noted that the variable range and the number of levels of these parameters may be properly changed according to the specification of the apparatus. In the aforesaid apparatus adapted to vary the direct current developing bias Vavg in the range of (−110)V to (−330)V, it is noted that the lowest level V0 is equivalent to (−110)V of the smallest absolute value whereas the highest level V5 is equivalent to (−330)V of the greatest absolute value.

Figure 18:
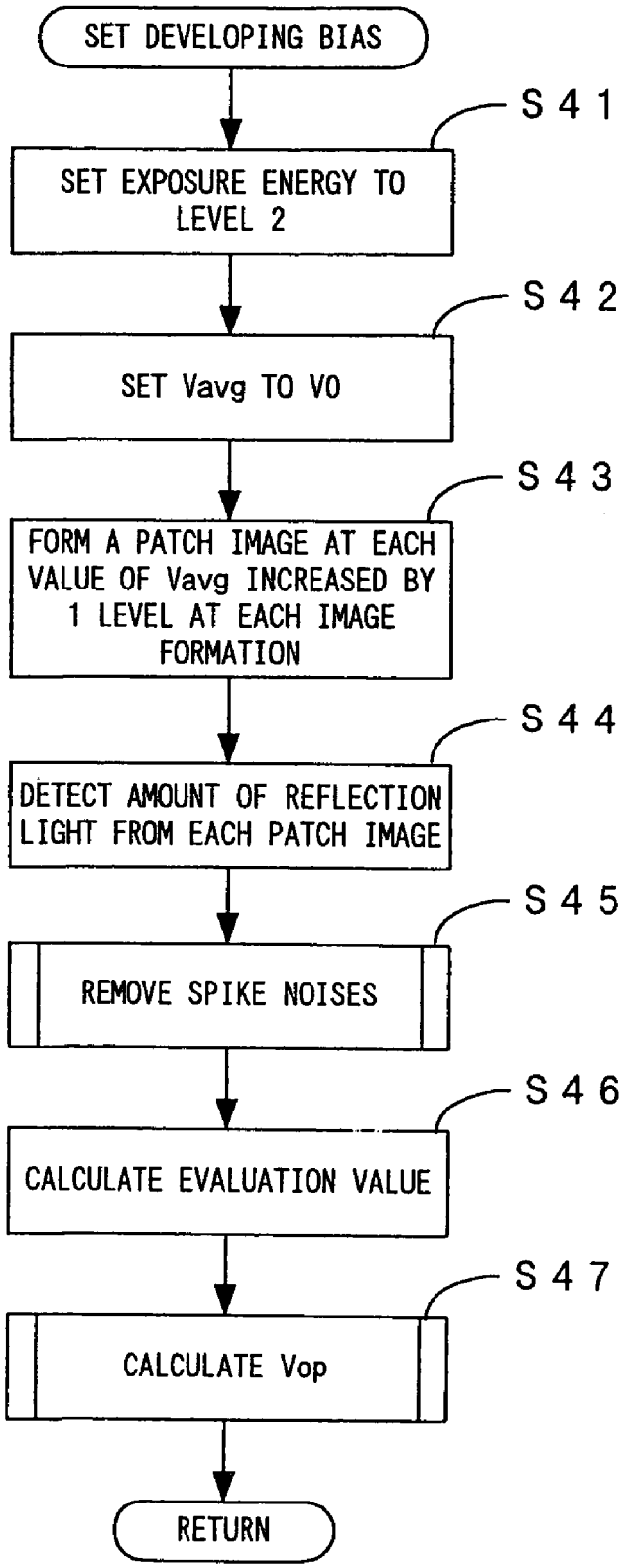
FIG. 18 is a flow chart representing the steps of a developing-bias setting process according to the first embodiment.
Figure 19:
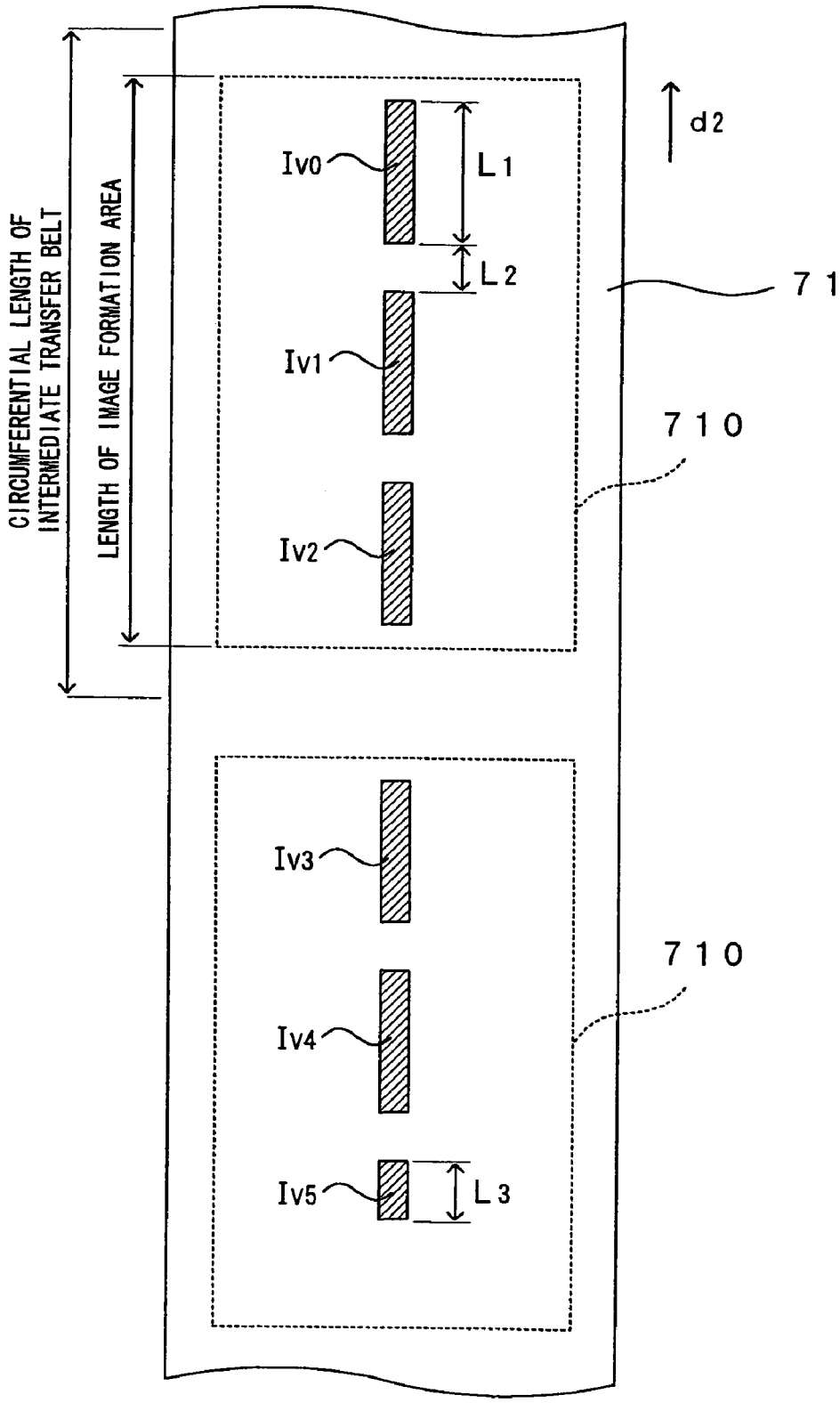
FIG. 19 is a diagram showing high-density patch images.

FIG. 18 is a flow chart representing the steps of a developing-bias setting process according to this embodiment. FIG. 19 is a diagram showing high-density patch images. This process is started by setting the exposure energy E to level 2 (Step S41). Subsequently, a solid image as the high-density patch image is formed at each value of the direct current developing bias Vavg which is increased from the minimum level V0 by 1 level at each image formation (Steps S42, S43).

In correspondence to the direct current developing bias Vavg variable in 6 steps, 6 patch images Iv0 to Iv5 are sequentially formed on the surface of the intermediate transfer belt 71, as shown in FIG. 19. The first 5 patch images Iv0 to Iv4 are formed in a length L1, which is arranged to be longer than a circumferential length of the cylindrical photosensitive member 2. On the other hand, the last patch image Iv5 is formed in a length L3, which is shorter than the circumferential length of the photosensitive member 2. The reason for this arrangement will be specifically described hereinlater. When the direct current developing bias Vavg is set to a varied value, there is some time lag before the potential of the developing roller 44 becomes uniform. Hence, taking this time lag into account, the individual patch images are formed at space intervals of L2. In the surface of the intermediate transfer belt 71, an area practically capable of bearing the toner image is defined as an image formation area 710 as shown in FIG. 19. Because of the aforesaid configuration and layout of the patch images, no more than 3 patch images can be formed in the image formation area. Accordingly, the 6 patch images are formed on an area of a length twice the circumferential length of the intermediate transfer belt 71, as shown in FIG. 19.

Now referring to FIGS. 1 and 20, the reason for defining the lengths of the patch images as the above is given. FIG. 20 are graphs illustrating the image density variations appearing in the period of the photosensitive member. As shown in FIG. 1, the photosensitive member 2 is formed in a cylindrical shape (L0 denoting the circumferential length thereof). In some cases, the photosensitive member may not have a true cylindrical shape or may have eccentricity as a result of the variations in the production process, thermal deformation or the like. In this case, the resultant toner image may be periodically varied in the image density in correspondence to the circumferential length L0 of the photosensitive member 2. This is because varied contact pressures between the photosensitive member 2 and the developing roller 44 are encountered by the image forming apparatus of the contact development system wherein the toner image is developed by these members contacting against each other, or because varied magnitudes of the electric field for causing toner jump between these members are encountered by the image forming apparatus of the non-contact development system wherein the toner image is developed with these members spaced away from each other. In either apparatuses, the probability of toner transfer from the developing roller 44 to the photosensitive member 2 is varied based on the period of rotation of the photosensitive member 2.

Figure 20A:
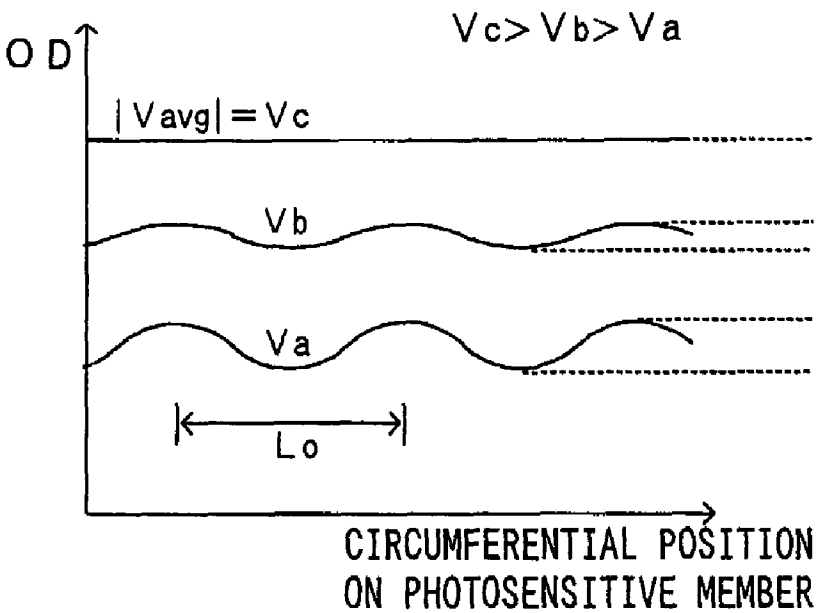
FIG. 20 are graphs illustrating image density variations appearing in a period of a photosensitive member.
Figure 20B:
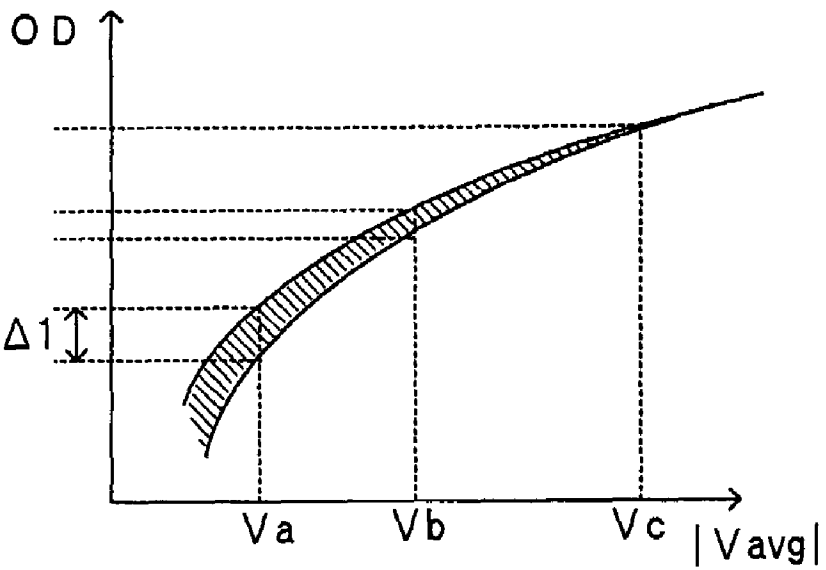

As shown in FIG. 20A, in particular, the width of the density variations is great when the absolute value |Vavg| of the direct current developing bias Vavg is relatively low. As the absolute value |Vavg| increases, the width of the density variations is correspondingly decreased. Where a patch image is formed with the absolute value |Vavg| of the direct current developing bias set to a relatively low value Va, for example, the image density of the patch image varies in the range of a width Δ1 from position to position on the photosensitive member 2, as shown in FIG. 20B. Where a patch image is formed at any other value of the direct current developing bias, as well, the image density thereof is similarly varied in a given range as indicated by a cross-hatched area in FIG. 20B. Thus, the density OD of the patch image depends not only upon the magnitude of the direct current developing bias Vavg but also upon the image formation position on the photosensitive member 2. In order to determine the optimum value of the direct current developing bias Vavg from the image density, therefore, it is necessary to eliminate the influence of the density variations on the patch image, the density variations corresponding to the period of rotation of the photosensitive member 2 described above.

According to this embodiment, therefore, the patch image is formed in the length L1 greater than the circumferential length L0 of the photosensitive member 2. Then, as will be described hereinlater, an average value of the densities determined for the length L0 is defined as the image density of the patch image. This is effective to prevent the density of each patch image from being affected by the density variations occurring in correspondence to the period of rotation of the photosensitive member 2. As a result, the optimum value of the direct current developing bias Vavg can be correctly determined based on the density.

According to this embodiment, the last one Iv5 of the patch images Iv0 to Iv5 that is formed at the maximum of the direct current developing bias Vavg has the length L3 shorter than the circumferential length L0 of the photosensitive member 2, as shown in FIG. 19. The reason is that the patch image formed at the great absolute value |Vavg| of the direct current developing bias sustains small density variations in correspondence to the rotation period of the photosensitive member 2, as shown in FIG. 20B, thus negating the need for determining the average value in the period of the photosensitive member as described above. This contributes to the reduction of time taken to form and process the patch image as well as to the reduced consumption of toner used for forming the patch image.

It is desirable to form the patch image in a greater length than the circumferential length L0 of the photosensitive member 2 for the purpose of preventing the density variations appearing in correspondence to the period of the photosensitive member from affecting the optimization of the density control factor. However, all the patch images need not be formed in such a length. The number of patch images to be formed in such a length should optionally be decided according to the degree of the density variations appearing in the apparatus or the desired level of image quality. In a case where the density variations appearing in the period of the photosensitive member have relatively small influences, for example, only the patch image Iv0 may be formed in the length L1 under the condition of the minimum direct current developing bias Vavg, whereas the other patch images Iv1 to Iv5 may be formed in the shorter length L3 than this.

Conversely, all the patch images may be formed in the length L1. However, this case involves a problem that the process time and the toner consumption are increased. In addition, that the density variations corresponding to the period of the photosensitive member appear even at the maximum direct current developing bias Vavg is undesirable from the view point of the image quality. It is essential to define the variable-range of the direct current developing bias Vavg so as to ensure that such density variations do not occur at least at the maximum value of the developing bias. If the variable range of the direct current developing bias Vavg is defined in the aforesaid manner, such density variations do not appear at least at the maximum value of the developing bias and hence, the patch image in this case need not be formed in the length L1.

Returning to FIG. 18, the description on the developing-bias setting process is continued. With respect to the patch images Iv0 to Iv5 thus formed at individually different direct current developing biases, the output voltages Vp, Vs from the density sensor 60 are sampled, the output voltages corresponding to the amount of reflection light from the surface of each patch image (Step S44). In this embodiment, sample data are obtained from 74 points (equivalent to the circumferential length L0 of the photosensitive member 2) in each of the patch images Iv0 to Iv4 having the length L1 or from 21 points (equivalent to a circumferential length of the developing roller 44) in the patch image Iv5 having the length L3 by sampling the output voltages Vp, Vs from the density sensor 60 at a sampling interval of 8 msec. Subsequently, the same procedure as in the deriving of the base profile described above (FIG. 10) is taken to remove spike noises from the sample data (Step S45). Then, the "evaluation value" of each patch image is calculated from the resultant data, the evaluation value removed of the influences of the dark output from the sensor system and the base profile (Step S46). It is noted that the data on each of the patch images Iv0 to Iv4 having the length L1 described above are subjected to the spike noise removal wherein 10 sample values of higher order and 10 sample values of lower order are removed from the 74 samples.

As mentioned supra, the density sensor 60 of the apparatus is characterized by providing the output which is at the highest level when the intermediate transfer belt 71 is free from the toner and which is progressively decreased with increase in the amount of toner. Furthermore, the output also contains the offset associated with the dark output. Therefore, the output voltage data per se provided by the sensor are not regarded as information adequate for use in the evaluation of the amount of toner adhesion. Accordingly, this embodiment processes the acquired data into data more reflecting the degree of toner adhesion or converts the acquired data into the evaluation value, thereby facilitating the subsequent processes.

The calculation method for the evaluation value will be specifically described by way of example of a patch image formed of a black toner color. Out of the 6 patch images developed with the black toner, the n-th patch image Ivn (n=0, 1, . . . , 5) is determined for the evaluation value Ak(n) based on the following equation:

$$Ak(n)=1-\{Dp_avek(n)-Vp0\}/\{Tp_ave-Vp0\} \quad (1\text{-}2)$$

The respective terms in the above equation are defined as below.

First, Dp_avek(n) is an average value of sample data pieces removed of the noises, the sample data pieces obtained by sampling output voltages Vp provided by the density sensor 60 in correspondence to p-polarized light components of the reflection light from the n-th patch image Ivn. That is, for instance, a value Dp_avek(0) for the first patch image Iv0 is an arithmetic average of the 74 sample data pieces, which are detected as the output voltages Vp from the density sensor 60 over the length L0 of this patch image and then subjected to the spike noise removal process and stored in the RAM 107. It is noted that the subscript 'k' affixed to the terms of the above equation represents a value with respect to the black color.

Vp0 is a dark output voltage from the light receiver unit 670*p* acquired by the previous pre-operation 1 in a state where the light emitter element 601 is turned OFF. Thus, the density of the toner image can be determined with higher accuracies by subtracting the dark output voltage Vp0 from the sampled output voltage, thereby eliminating the influence of the dark output.

Further, Tp_ave is an average value of sample data pieces which are included in the base profile data previously determined and stored in the RAM 107 and which are detected at the same positions on the intermediate transfer belt 71 as where the 74 sample data pieces used for the calculation of the above Dp_avek(n) are detected.

That is, the evaluation value Ak(n) for the n-th patch image Ivn of the black color is given by subtracting the dark output of the sensor from the average value of the sensor outputs Vp acquired from the surface of the intermediate transfer belt 71 prior to the toner adhesion and from the average value of the sensor outputs Vp acquired from the patch image Ivn defined by the adhered toner, respectively; calculating a ratio between the resultant average values; and subtracting the resultant ratio value from 1. Therefore, in a state where the intermediate transfer belt 71 is totally free from the toner forming the patch image, Dp_avek(n)=Tp_ave and hence, the evaluation value Ak(n) is zero. On the other hand, in a state where the surface of the intermediate transfer belt 71 is covered up with the black toner to exhibit a reflectivity of zero, Dp_avek(n)=Vp0 and hence, the evaluation value Ak(n) is 1.

By using the evaluation value Ak(n) in stead of using the sensor output voltage Vp as it is, the influences associated with the surface conditions of the intermediate transfer belt 71 can be canceled so that the image density of the patch image can be determined with high accuracies. Furthermore, because of the correction according to the degree of the density of the patch image on the intermediate transfer belt 71, the measurement accuracies for the image density can be further increased. In addition, the density of the patch image Ivn can be represented in a normalized numerical form ranging from the minimum value 0 indicative of the state free from the toner adhesion to the maximum value 1 indicative of the state where the surface of the intermediate transfer belt 71 is covered with the toner in high density.

This representation form provides convenience in estimating the density of the toner image in the subsequent processes.

The toners of the other colors of yellow (Y), cyan (C) and magenta (M) than black have higher reflectivities than the black color so that the amount of reflection light from the intermediate transfer belt 71 covered by such a toner is not zero. Therefore, the evaluation value determined in the above method may not provide the accurate density. In this connection, this embodiment takes the following approach to estimate the image density in these toner colors with high accuracies. In the determination of an evaluation value for each of such toner colors Ay(n), Ac(n) and Am(n), the output voltages Vp corresponding to the p-polarized light components are not used as the sample data for the estimation thereof. Instead, a value given by subtracting the dark output Vp0 from the output voltage Vp is divided by a value given by subtracting the dark output Vs0 from the output voltage Vs corresponding to the s-polarized light component thereby to obtain a value Dps. That is, the value Dps given by the following equation is used as the sample data for the respective measurement points:

$$Dps=(Vp-Vp0)/(Vs-Vs0) \quad (1\text{-}3)$$

Similarly to the case of the black color, the sensor output obtained from the surface of the intermediate transfer belt 71 prior to the toner adhesion is taken into account whereby the influences associated with the surface conditions of the intermediate transfer belt 71 are canceled. In addition, because of the correction according to the degree of the density of the patch image on the intermediate transfer belt 71, the measurement accuracies for the image density can be improved. An evaluation value Ac(n) for the cyan color (C), for example, may be determined using the following equation:

$$Ac(n)=1-\{Dps_avec(n)-Dps(\text{color})\}/\{Tps_ave-Dps(\text{color})\} \quad (1\text{-}4)$$

It is noted here that Dps_avec(n) is an average value of the values Dps removed of the noises, the values determined based on the sensor outputs Vp, Vs for the individual positions in the n-th patch image Ivn formed in the cyan color and given by the above equation (1-3). On the other hand, Dps(color) denotes the aforementioned value Dps corresponding to the sensor outputs Vp, Vs obtained in the state where the surface of the intermediate transfer belt 71 is completely covered with the color toner, and represents the minimum value that the value Dps can take. Tps_ave is an average value of the aforementioned values Dps determined from the sensor outputs Vp, Vs sampled at the respective positions on the intermediate transfer belt 71 for acquisition of the base profile.

Likewise to the aforementioned case of the black color, the above definition of the evaluation value for each color toner provides the representation of the density of the patch image Ivn in the normalized numerical form ranging from the minimum value 0 indicative of the state where the intermediate transfer belt 71 is absolutely free from the toner adhesion (Dps_avec(n)=Tps_ave) to the maximum value 1 indicative of the state where the belt 71 is completely covered with the toner (Dps_avec(n)=Dps(color)).

Figure 21:
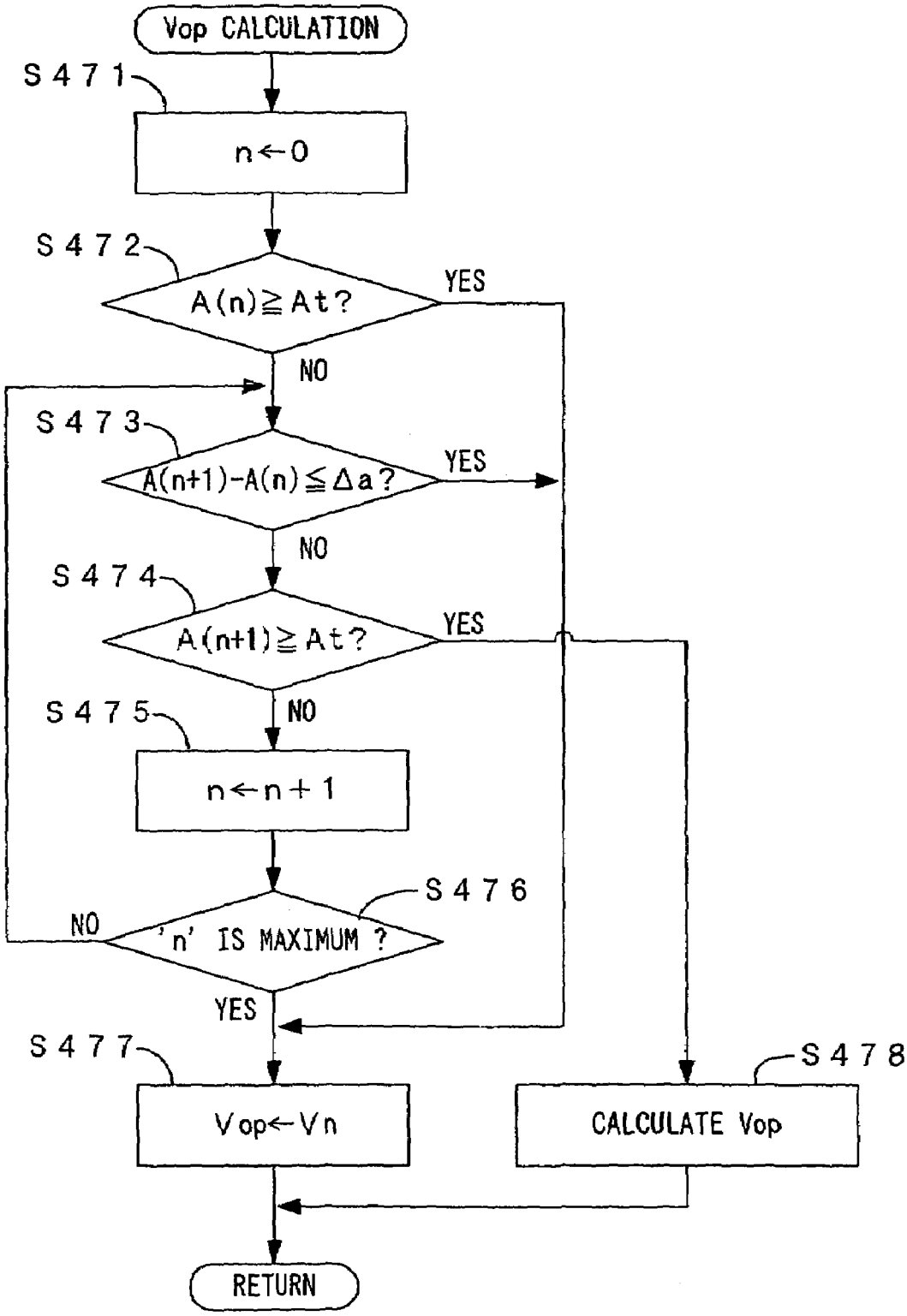
FIG. 21 is a flow chart representing the steps of a process for calculating the optimum value of a direct current developing bias according to the first embodiment.

When the density of each patch image (more precisely, the evaluation value therefor) is determined in this manner, an optimum value Vop of the direct current developing bias Vavg is calculated based on the resultant value (Step S47). FIG. 21 is a flow chart representing the steps of a process for calculating the optimum value of the direct current developing bias according to this embodiment. It is noted that FIG. 21 and the following description dispense with the subscripts (y, c, m and k) associated with the toner colors because the contents of the steps performed on the toners of the individual colors are the same. As a matter of course, however, the evaluation value and the target value vary from toner color to toner color.

First, the variable 'n' is set to 0 (Step S471). Then, the evaluation value A(n) or A(0) is compared with the previously determined control target value At (Akt for the black color, for example) (Step S472). If the evaluation value A(0) is equal to or greater than the control target value At, this indicates that the image density exceeding the target density is obtained at the minimum value V0 of the direct current developing bias Vavg. Thus, there is no need for further examining the higher developing biases so that this direct current developing bias V0 is selected as the optimum value Vop. Then, the process is terminated (Step S477).

If, on the contrary, the evaluation value A(0) is below the target value At, an evaluation value A(1) for the patch image Iv1 is retrieved, the patch image Iv1 formed at a 1-level higher direct current developing bias V1. A difference from the evaluation value A(0) is determined and then, whether the difference value is equal to or smaller than a predetermined value Δa or not is determined (Step S473). If the difference between these evaluation values is equal to or smaller than the predetermined value Δa, in a similar fashion to the above, the direct current developing bias V0 is used as the optimum value Vop. The reason for this will be described in details hereinlater.

If, on the other hand, the difference between these evaluation values is greater than the predetermined value Δa, the control flow proceeds to Step S474 where the evaluation value A(1) is compared with the control target value At. If the evaluation value A(1) is equal to or greater than the target value At, the target value At is greater than the evaluation value A(0) but equal to or smaller than the evaluation value A(1) or A(0)<At≦A(1) and hence, the optimum value Vop of the direct current developing bias providing the target image density exists somewhere between the direct current developing biases V0 and V1, or V0<Vop≦V1.

In this case, the control flow proceeds to Step S478 where the optimum value Vop is calculated. There may be contemplated various methods for calculating the optimum value. For example, a variation of the evaluation value with respect to the direct current developing bias Vavg between V0 and V1 may be approximated as a proper function. Then, a direct current developing bias Vavg related to a value of the function which gives the target value At may be selected as the optimum value Vop. While the easiest method is to linearly approximate the variations of the evaluation value, the optimum value Vop can be determined with adequate accuracies by selecting a proper variable range of the direct current developing bias Vavg. Of course, any other method than the above may be used. For example, a more accurate approximation function may be derived to be used for calculating the optimum value Vop. However, such a method is not always practicable considering the detection errors or variations or the like in the apparatus.

If, on the other hand, the target value At is determined to be greater than the evaluation value A(1) in Step S474, 'n' is incremented by 1 (Step S475). Until 'n' reaches the maximum value (Step S476), the above Steps S473 to S475 are repeated to determine the optimum value Vop of the direct current developing bias. However, in a case where the optimum value Vop is not determined in Step S476 when 'n' is at the maximum value (n=5), or where none of the evaluation values for the 6 patch images reaches the target value, a direct current developing bias V5 providing the maximum density is used as the optimum value Vop (Step S477).

Thus, this embodiment is arranged such that each of the evaluation values A(0) to A(5) corresponding to the respective patch images Iv0 to Iv5 is compared with the target value At and the optimum value Vop of the direct current developing bias providing the target density is determined based on which of the values is the greater. However, in Step S473 as described above, a direct current developing bias Vn is selected as the optimum value Vop when a difference between the evaluation values A(n) and A(n+1) for two successive patch images is equal to or smaller than the predetermined value Δa. The reason is described as below.

Figure 22A:
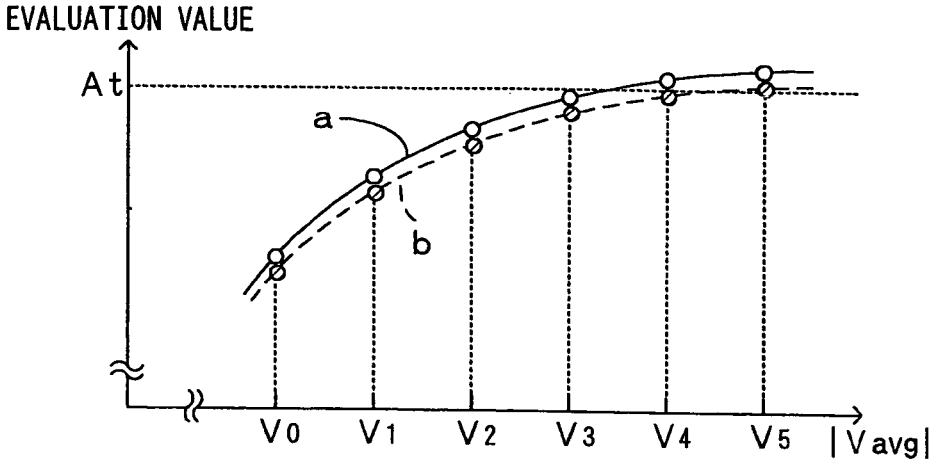
FIG. 22 are graphs representing the relation between the direct current developing bias and the evaluation value for solid image.

FIG. 22 are graphs representing the relation between the direct current developing bias and the evaluation value for solid image. A curve 'a' in FIG. 22A represents a true relation free from the detection errors. As seen in the graph, with increase in the absolute value |Vavg| of the direct current developing bias, the evaluation value for the solid image is accordingly increased. In a region where the direct current developing bias Vavg is at relatively high values, the variation rate of the evaluation value is progressively decreased to be saturated. This is because once the toner adhesion of high density reaches a certain level, further increase in the amount of toner adhesion results in little increase in the image density. As just described, in association with the decreased variation of the image density, the variation of the evaluation value also decreases, so that the gradient of the curve 'a' also decreases with increase in the direct current developing bias |Vavg|. Hereinafter, the curves 'a', 'b' and the like representing the correspondence between the direct current developing bias Vavg and the evaluation value will be simply referred to as "evaluation-value curve".

Where the evaluation value for the patch image under this relation is determined based on the sensor outputs Vp, Vs as described above, the patch images formed at the respective values V0, V1, . . . of the direct current developing bias Vavg should take respective evaluation values represented by blank dots in FIG. 22A, if the sensor outputs do not contain the detection errors. However, the sensor outputs Vp, Vs may contain the detection errors due to the characteristic variations or the like of the density sensor 60. In a case where, for example, the sensor output Vp is slightly shifted to the higher potential level than the true value, the evaluation value determined based on this output Vp is somewhat smaller than the true value, as indicated by a curve 'b' and cross-hatched blank dots in FIG. 22A. In addition, the evaluation value determined based on the sensor output may not coincide with the true image density due to the aforesaid characteristic variations of the toner. Thus, the indirect determination of the image density of the patch image based on the sensor output may encounter the inconsistency between the result and the actual image density.

Figure 22B:
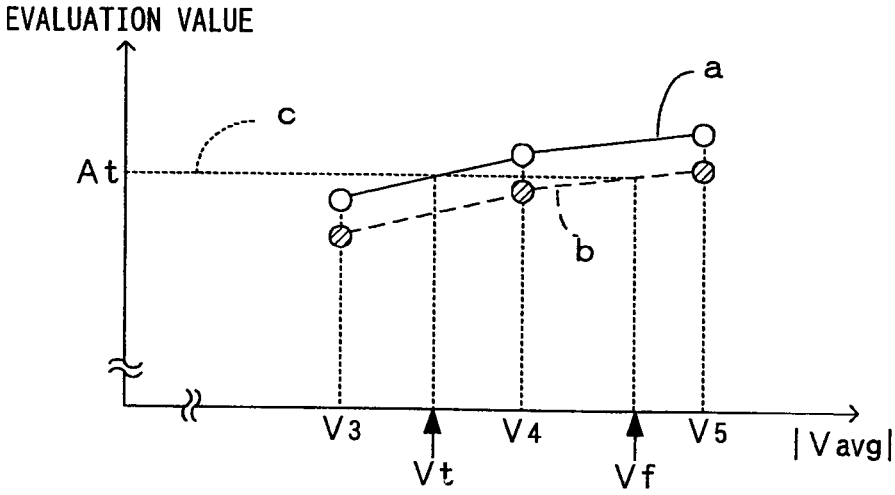

Now, description is made on a case where the optimum value Vop of the direct current developing bias Vavg is determined based on the evaluation value for the patch image thus determined. FIG. 22B shows a part of the graph of FIG. 22A on an enlarged scale. A value of the direct current developing bias Vavg which provides an evaluation value for the solid image equivalent to the control target value At may be selected as the optimum value thereof. Provided that the detection errors are not included, therefore, the optimum value of the direct current developing bias Vt may take a value corresponding to an intersection of the evaluation-value curve 'a' and a straight line 'c' representing the control target value At, as shown in FIG. 22B. In this example, the optimum value of the direct current developing bias should be a value intermediate the direct current developing biases V3 and V4.

In actual fact, however, the evaluation value based on the sensor output inevitably contains the detection errors. In the aforementioned case where the evaluation value tends to be smaller than the true value because of the characteristic variations of the sensor, for example, the evaluation-value curve is represented by the curve 'b' shown in FIG. 22B. Therefore, if a direct current developing bias Vf corresponding to an intersection of the curve 'b' and the straight line 'c' is selected as the optimum value in this case, the value Vf has a significant difference from the true optimum value Vt.

Like this, in the region where the variation of the image density relative to the direct current developing bias Vavg is small or where the evaluation-value curve has a small gradient, the optimum value of the direct current developing bias Vavg is significantly varied even by a minor detection error. That is, although such a variation does not result in a significant variation of the image density, the following problem may be encountered when the absolute value |Vavg| of the direct current developing bias is set to a higher value than required. Although the variation of the image density is small, the amount of toner adhesion is increased so that the toner contained in each developer is consumed rapidly. This leads to a more frequent cumbersome replacement of the developers as well as to an increased running cost of the apparatus. Furthermore, the amount of toner forming the toner image is increased, so that caused is a degraded image quality, such as associated with transfer failure in the transfer process for transferring from the photosensitive member 2 to the intermediate transfer belt 71 or from the intermediate transfer belt 71 to the sheet S, or with fixing failure in the fixing process failing to fuse the toner fully. In addition, the development process is carried out with the developing roller 44 applied with a higher voltage than required so that a potential remains in the surface of the developing roller 44 to interfere with the formation of a consistent toner layer. As a result, there is a possibility to cause the deterioration in image quality, such as the occurrence of the influence of the previously formed image upon the subsequent image. On this account, it is undesirable to apply the higher direct current developing bias Vavg than required to the developing roller 44 in the region where the evaluation-value curve has the small gradient.

According to this embodiment, the evaluation value for each patch image determined from the sensor output is used as an index representing the toner density thereof. In the determination of the optimum value of the direct current developing bias Vavg, not only the evaluation value itself but also its variation rate relative to the direct current developing bias Vavg are taken into consideration for eliminating the influences of the detection errors and the like on the optimization process for the direct current developing bias Vavg.

Figure 23A:
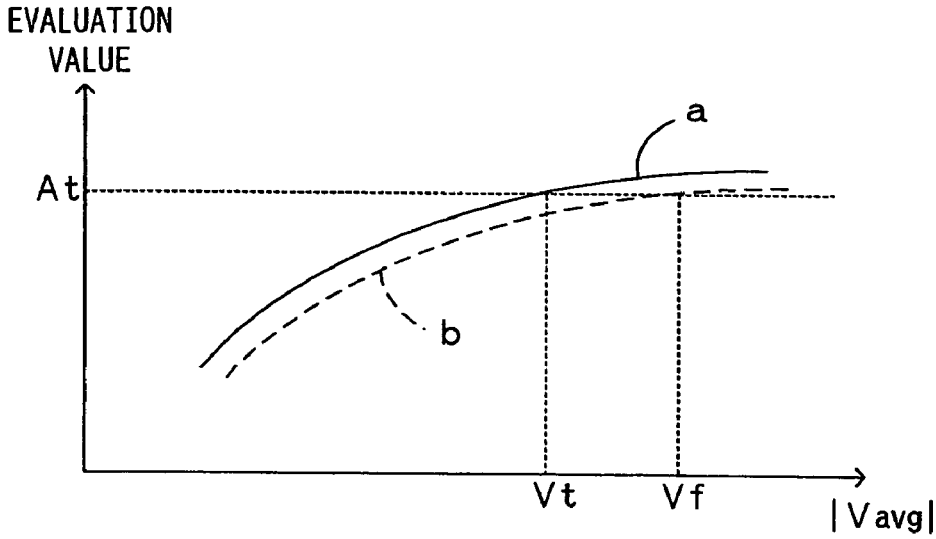
FIG. 23 are graphs representing the evaluation value relative to the direct current developing bias and the variation rate thereof relative to the direct current developing bias.
Figure 23B:
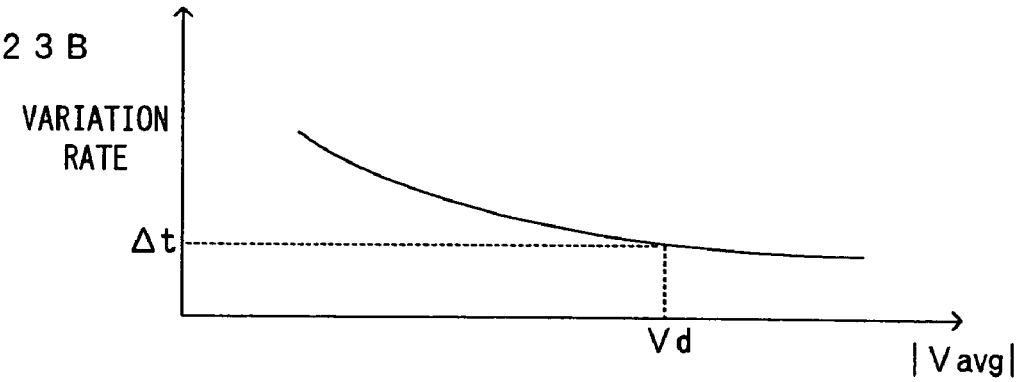

FIG. 23 are graphs representing the evaluation value relative to the direct current developing bias and the variation rate thereof. As indicated by a curve 'a' in FIG. 23A, the evaluation value is progressively saturated as the direct current developing bias |Vavg| is increased and thus, the variation rate of the evaluation value is monotonically decreased against the increase in the direct current developing bias |Vavg|, as shown in FIG. 23B. It is noted here that if the optimum value of the direct current developing bias Vavg is determined from the evaluation-value curve based on a curve 'b' containing the detection errors, the value Vf significantly different from the true optimum value Vt is given due to the detection errors, as described in the foregoing. As shown in FIG. 23B, on the other hand, a curve representing the variation rate of the evaluation value relative to the direct current developing bias Vavg (hereinafter, referred to as "variation rate curve") is varied less even if the evaluation-value curve is somewhat varied by the detection errors. The reason is as follows. The variation of the evaluation-value curve caused by the detection errors appears in the form of a shifted true evaluation-value curve in either of the directions, as shown in FIG. 23A, but is least likely to result in a drastically changed shape of the curve. Furthermore, the variation rate curve is obtained by differentiating the evaluation-value curve and hence, the variation rate curve based on such a shifted evaluation-value curve has little change in shape from that of the curve based on the true evaluation-value curve.

Thus, as shown in FIG. 23B, a given target value for the variation rate of the evaluation value, that is, a value Δt equivalent to an "effective variation rate" of the present invention may also be defined. In addition, a direct current developing bias Vd may be derived from the curve substantially in correspondence to the target value Δt of the variation rate of the evaluation value monotonically decreased against the direct current developing bias Vavg. Then based on this value Vd and the optimum value previously determined from the evaluation-value curve, the optimum value of the direct current developing bias Vavg may be determined. If, for example, a difference between the value derived from the evaluation-value curve and the value Vd derived from the variation rate curve is not so great, either one of these values or a value determined based on these values (e.g., an average value thereof) may be used as the optimum value of the direct current developing bias Vavg. In a case where the difference between these values is significant, however, the optimum value of the direct current developing bias Vavg may preferably take the value providing the smaller amount of toner adhesion or the smaller absolute value of the direct current developing bias |Vavg| from the standpoint of eliminating the aforementioned problems. This approach permits an approximate value to the true value Vt to be derived even if the detection errors deviate the value derived from the evaluation-value curve significantly from the true value Vt, as illustrated by the value Vf shown in FIG. 23A, because the value Vd derived from the variation rate curve is selected as the optimum value of the direct current developing bias Vavg.

Figure 24A:
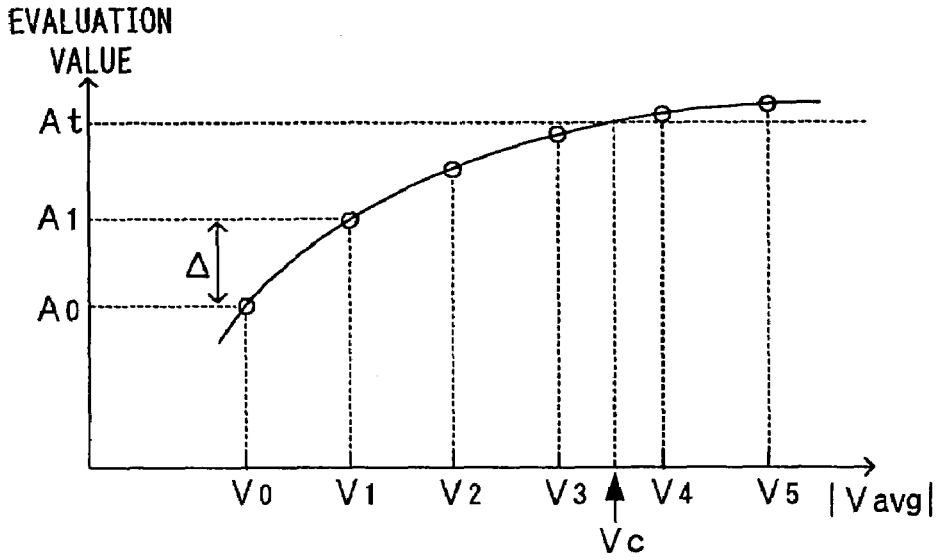
FIG. 24 are graphs representing the evaluation value curve and the variation rate thereof according to the first embodiment.

As described above, the actual apparatus does not vary the direct current developing bias Vavg in a continuous manner as described above but discretely varies the direct current developing bias Vavg in the 6 steps of V0 to V5. Accordingly, as shown in FIG. 24A, 6 evaluation values are derived in correspondence to the respective image densities of the patch images while the evaluation-value curve is obtained by linear interpolation between these values. FIG. 24 are graphs representing the evaluation-value curve and the variation rate thereof according to this embodiment. In conjunction with the discrete evaluation values thus determined, the variation rate thereof is determined in terms of a difference Δ between the evaluation values corresponding to two patch images formed at direct current developing biases Vavg differing from each other by 1 level. That is, Δ=A(n+1)−A(n) as described above.

In principle, the optimum value of the direct current developing bias is defined by a direct current developing bias Dc derived from the evaluation-value curve of FIG. 24A substantially in correspondence to the control target value At. However, in a case where the aforesaid difference Δ is equal to or smaller than the predetermined effective variation rate Δa in range of the direct current developing bias Vavg equal to or smaller than this value Vc, a direct current developing bias at the present level is selected as the optimum value Vop even though the evaluation value does not reach the control target value At. That is, Vop=V3 according to the example shown FIG. 24B. Thus, in this embodiment, the value Δa is equivalent to the "effective variation rate" of the present invention. As for the value Δa, it is desirable that when there are two images on which evaluation values are different by Δa from each other, the value Δa is selected such that the density difference between the two will not be easily recognized with eyes or will be tolerable in the apparatus.

In this manner, the direct current developing bias Vavg is prevented from being set to a higher value than required due to the detection errors of the density sensor 60 or the like when there is little increase in the image density. This embodiment provides the image density approximate to the predetermined value while effectively obviating the aforementioned problems.

In a region where the difference Δ is greater than the effective variation rate Δa, on the other hand, the evaluation-value curve has such a great gradient that the variation of the direct current developing bias Vavg associated with the evaluation-value curve shifted by the detection errors is insignificant. In this case, therefore, the optimum value Vop of the direct current developing bias Vavg may be determined from the evaluation-value curve alone. While the method has been described by way of the "evaluation value" determined from the sensor output value as the index indicative of the image density, the image density value itself or any other index indicative of the image density may be used in a similar manner.

In this manner, the optimum value Vop of the direct current developing bias Vavg for providing a predetermined solid image density is set to any value in the range of the minimum value V0 to the maximum value V5. From the standpoint of improving the image quality, this image forming apparatus is adapted to always maintain a constant potential difference (e.g., 325V) between the direct current developing bias Vavg and a surface potential at a portion (non-image line portion) of the electrostatic latent image, the portion wherein no toner adhesion is caused based on the image signal. When the optimum value Vop of the direct current developing bias Vavg is determined as described above, the magnitude of the charging bias applied to the charging unit 3 from the charging controller 103 is accordingly varied so that the above potential difference may be maintained at the constant level.

(E) Setting Exposure Energy

Figure 25:
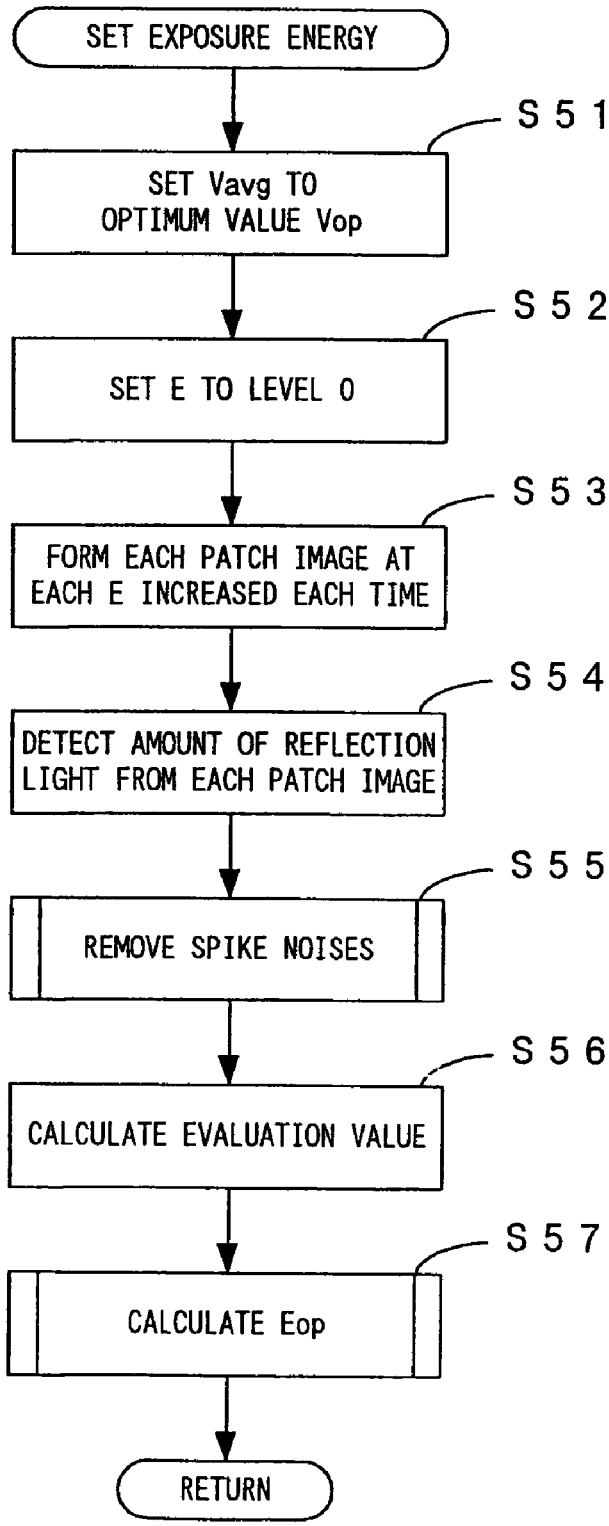
FIG. 25 is a flow chart representing the steps of an exposure-energy setting process according to the first embodiment.

Subsequently, the exposure energy E is set to its optimum value. FIG. 25 is a flow chart representing the steps of an exposure-energy setting process according to this embodiment. As shown in FIG. 25, the contents of the process are essentially the same as those of the aforementioned process for setting the developing bias (FIG. 18). That is, the direct current developing bias Vavg is first set to the previously determined optimum value Vop (Step S51). Then, patch images are individually formed at the respective levels of the exposure energy E increased from the minimum level 0 by 1 level each time (Steps S52, S53). The sensor outputs Vp, Vs corresponding to the amount of reflection light from each of the patch images are sampled (Step S54). The spike noises are removed from the sample data (Step S55), and the evaluation value indicative of the density of each patch image is determined (Step S56). Based on the resultant values, the optimum value Eop of the exposure energy is determined (Step S57).

In this process (FIG. 25), the contents of the processings differ from those of the aforementioned developing-bias setting process (FIG. 18) in the pattern of the patch images to be formed and the number thereof, and the process for calculating the optimum value Eop of the exposure energy from the evaluation value while the others are generally the same. Therefore, this section principally focuses on the differences.

This image forming apparatus is adapted to form the electrostatic latent image corresponding to the image signal by irradiating the surface of the photosensitive member 2 with the light beam L. When forming a high-density image, such as a solid image, wherein a relatively large area thereof is exposed to light, the potential profile of the electrostatic latent image is not varied so much by varying the exposure energy E. In contrast, when forming a low-density image, such as a fine-line image or halftone image, wherein spot-like exposure areas are scattered over the photosensitive member 2, the potential profile is significantly varied depending upon the exposure energy E. Such variations of the potential profile lead to the density variations of the toner image. In short, the variations of the exposure energy E do not affect the high-density image so much but significantly affect the density of the low-density image.

On this account, this embodiment takes the following approach. Firstly, a solid image, the image density of which is less affected by the exposure energy E, is formed as a high-density patch image such that the optimum value of the direct current developing bias Vavg is determined based on the density thereof. On the other hand, a low-density patch image is formed when the optimum value of the exposure energy E is determined. Therefore, the exposure-energy setting process uses a patch image of a different pattern from that of the patch image (FIG. 19) formed in the direct current developing-bias setting process.

Although the exposure energy E has a minor influence on the high-density image, an excessively broadened variable range thereof results in increased density variations of the high-density image. To prevent this, the variable range of the exposure energy E preferably ensures that a change in surface potential of an electrostatic latent image corresponding to a high-density image (which is a solid image for example) in response to a change in exposure energy from the minimum (level 0) to the maximum (level 3) is within 20 V, or more preferably, within 10 V.

Figure 26:
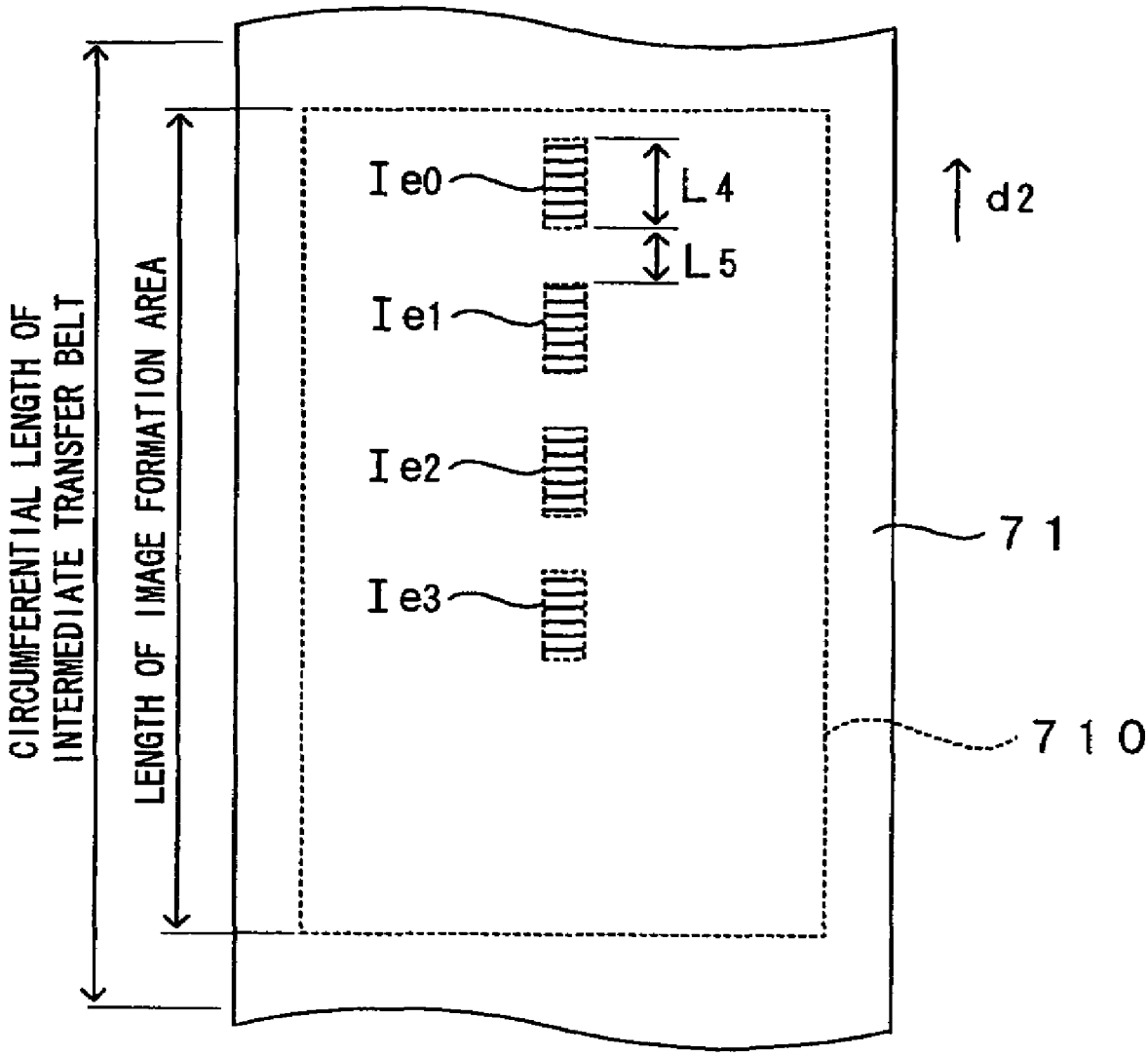
FIG. 26 is a diagram showing a low-density patch image.

FIG. 26 is a diagram showing the low-density patch image. As mentioned supra, this embodiment is adapted to vary the exposure energy E in the 4 steps. The figure shows four patch images Ie0 to Ie3, each formed at each different level. This embodiment uses the patch image having a pattern consisting of a plurality of fine lines arranged in spaced relation, as shown in FIG. 26. More specifically, the pattern is a 1-dot line pattern that one line is ON and ten lines are OFF. Although the pattern of the low-density patch image is not limited to this, the use of such a pattern of discrete lines or dots permits the variations of the exposure energy E to be more reflected on the variations of the image density, thus providing more accurate determination of the optimum value of the exposure energy.

A length L4 of each patch image is defined to be shorter than that L1 of the high-density patch image (FIG. 19). This is because the direct current developing bias Vavg is already set to its optimum value Vop by the exposure-energy setting process so that the density variations in the period of the photosensitive member 2 do not occur under the optimum condition (Conversely, if this situation encounters the density variations, the Vop does not mean the optimum value of the direct current developing bias Vavg). On the other hand, a deformed developing roller 44 may potentially produce density variations. Therefore, it is preferred that the density of the patch image is represented by an average value of its densities with respect to a length equal to the circumferential length of the developing roller 44. Thus, the circumferential length L4 of the patch image is defined to be longer than the circumferential length of the developing roller 44. In a case where the developing roller 44 and the photosensitive member 2 of the apparatus of the non-contact development system do not have the same moving velocity at their surfaces (circumferential speed), the patch image may be formed on the photosensitive member 2 in a length equivalent to the overall circumference of the developing roller 44, as determined based on a ratio between these circumferential speeds.

An interspace L5 between the patch images may be smaller than an interspace L2 shown in FIG. 19, because the energy density of the light beam L from the exposure unit 6 can be changed relatively quickly. Particularly, in a case where the light source comprises a semiconductor laser, the energy density can be changed in quite a short time. Such configuration and layout of the patch images permit all the patch images Ie0 to Ie3 to be formed on the intermediate transfer belt 71 in the range of the overall circumferential length thereof, as shown in FIG. 26. As a result, the process time is also decreased.

Figure 27:
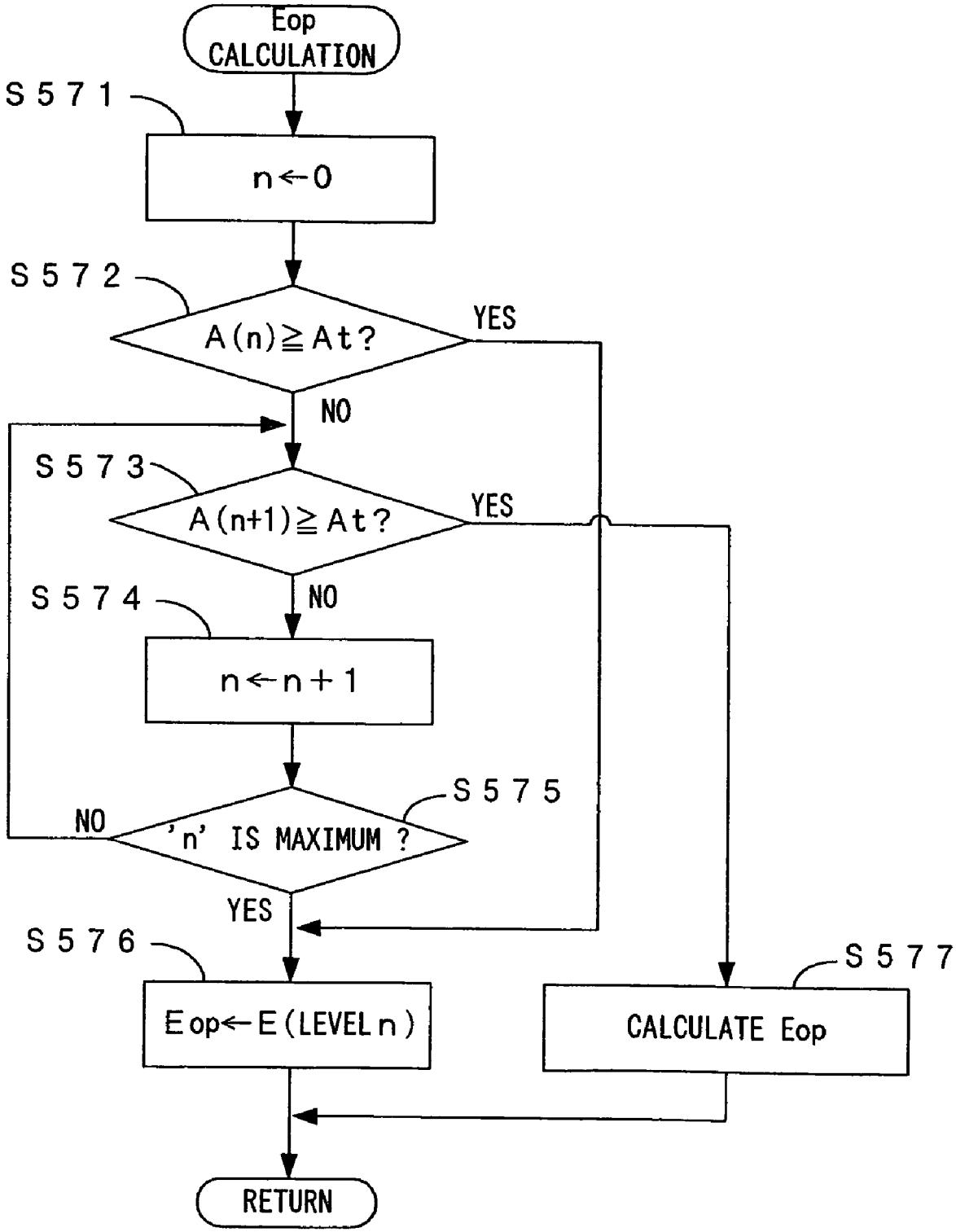
FIG. 27 is a flow chart representing the steps of a calculation process for optimum value of the exposure energy according to the first embodiment.

Thus formed low-density patch images Ie0 to Ie3 are determined for their evaluation values indicative of the image densities thereof in a similar manner to the aforementioned case of the high-density patch images. Then, the optimum value Eop of the exposure energy is calculated based on the resultant evaluation value and a control target value derived from a look-up table for low-density patch images (FIG. 17B) which is prepared independently from the aforesaid look-up table for high-density patch images. FIG. 27 is a flow chart representing the steps of a calculation process for optimum value of the exposure energy according to this embodiment. This process is also performed the same way as the calculation process for optimum value of the developing bias shown in FIG. 21. That is, the evaluation value is compared with a target value At on the patch images starting from the one formed at a low energy level, and a value of the exposure energy E which makes the evaluation value match with the target value is then calculated, thereby determining the optimum value Eop (Steps S571 top S577).

It is noted that a step equivalent to Step S473 in FIG. 21 is dispensed with because in the range of normally used exposure energy E, the relation between the fine-line image density and the exposure energy E do not present a saturation characteristic (FIG. 20B) as observed in the relation between the solid image density and the direct current developing bias. Thus is determined the optimum value Eop of the exposure energy E providing the desired image density.

(F) Post-Process

Since the respective optimum values of the direct current developing bias Vavg and the exposure energy E are determined as described above, the subsequent image forming operation can attain the predetermined image quality. Accordingly, the optimization process for the density control factors may be terminated at this point of time while the apparatus is shifted to the standby state by stopping the rotation of the intermediate transfer belt 71 and the like. Otherwise, any other adjustment operation may be carried out for controlling another density control factor. Thus, the contents of the post-process are optional and hence, the description thereof is dispensed with.

(3) Effects

As described above, this embodiment takes the approach to determine the optimum value Vop of the direct current developing bias Vavg wherein the patch images formed at 6 different levels of the direct current developing bias Vavg are determined for the evaluation values corresponding to their image densities as well as for the variation rate thereof and wherein as to a direct current developing bias providing an evaluation value substantially equivalent to the control target value At and a direct current developing bias associated with a variation rate equal to or less than the effective variation rate Δa, either one of the direct current developing biases that has the smaller absolute value |Vavg| or that provides the smaller amount of toner adhesion to the photosensitive member 2 is selected as the optimum value Vop thereof. This prevents the optimum value from being significantly deviated from the true optimum value even when the determined evaluation values contain errors associated with the characteristic variations of the density sensor 60 or of the toner.

In this manner, the direct current developing bias Vavg can be set substantially to its optimum value while reducing the influence of the detection errors. Therefore, this image forming apparatus is designed to obviate the problems such as excessive toner consumption, image transfer/fixing failure and the like, thus forming the toner image of good image quality in a stable manner.

(4) Others

The above embodiment has the arrangement wherein the density sensor 60 is disposed to confront the surface of the intermediate transfer belt 71 for detecting the density of the toner image as the patch image primarily transferred thereto but the arrangement is not limited to this. Alternatively, for example, the density sensor may be disposed to confront the surface of the photosensitive member 2 for detecting the density of the toner image developed thereon.

Figure 24B:
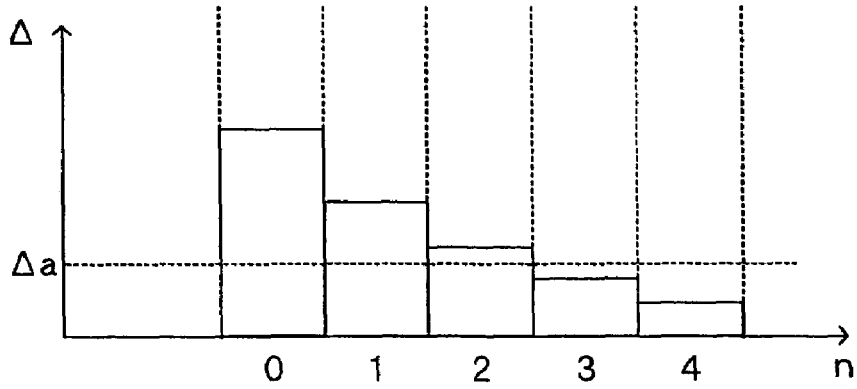

The above embodiment is arranged to select a direct current developing bias V3 as the optimum value Vop of the direct current developing bias when the direct current developing bias V3 associated with a value difference Δ equal to or smaller than the effective variation rate Δa shown in FIG. 24B is derived before a direct current developing bias Vc providing an evaluation value equivalent to the control target value At shown in FIG. 24A is derived (FIG. 21). However, in a case where the optimum value Vc determined from the evaluation-value curve has a relatively small difference from the optimum value V3 determined from the variation rate, as shown in FIG. 24 for example, either values may be used as the optimum value Vop. Therefore, the order of Steps S473 and S474 in FIG. 21 may be inverted. In this case, when Vc and V3 have the relation illustrated by FIG. 24, the optimum value Vop of the direct current developing bias is defined by Vc.

The foregoing embodiment determines the optimum value Vop of the direct current developing bias Vavg based on both the evaluation-value curve and the variation rate thereof. However, there may be a case where the optimum value Vop can be determined from the variation-rate curve alone. Specifically, there is a case where the optimum value of the density control factor can be determined simply by obtaining an image forming condition substantially establishing coincidence between the variation rate of the toner density and the predetermined effective variation rate. As shown in FIG. 23, for example, where the correlation between the evaluation value and the variation rate thereof or, in more general words, the correlation between the detected toner density of the patch image and the variation rate thereof is previously known, determining either one of the parameters allows for the determination of the other parameter. Thus, the density control factor can be optimized based on either one of the se parameters.

The conventional image forming apparatus optimizes the density control factor based on the detected toner density alone. As mentioned supra, however, the detection results may potentially contain the errors. Therefore, it is rather favorable to rely on the variation rate of the toner density, as suggested by the present invention, for more accurate optimization of the density control factor wherein the influence of the detection errors is excluded. Particularly, in the apparatus wherein the correlation between the toner density and the density control factor is previously known and wherein the variation rate of the toner density relative to the density control factor is great in proximity of the density target value of the apparatus, the density control factor can be optimized with necessary and sufficient accuracies.

The above-mentioned optimization procedure for the density control factor according to this embodiment is merely illustrative and hence, any other procedure may be used. For instance, while this embodiment performs the pre-operations 1 and 2 in parallel, these operations need not be performed in parallel at all times. Furthermore, the control target value for the image density may be determined at least before the optimum value Vop of the direct current developing bias is determined. The control target value may be determined at different time than in this embodiment or, for example, prior to the pre-operations.

The above embodiment stores, as the base profile of the intermediate transfer belt 71, the sample data pieces obtained by sampling the outputs from the density sensor 60 for the overall circumferential length of the intermediate transfer belt 71. Alternatively, there may be stored only sample data pieces obtained from places where the patch images are formed subsequently, such that the amount of data to be stored can be reduced. If, in this case, individual patch images are formed on the intermediate transfer belt 71 in the highest possible degree of registration, the calculation operation on the individual patch images may be performed based on the common base profile in a more efficient manner.

Although the above embodiment defines the direct current developing bias and the exposure energy to be variable as the density control factors used for controlling the image density, only one of these parameters may be defined to be variable and used for controlling the image density. Otherwise, any other density control factor may be used. In addition, the above embodiment is arranged such that the charging bias is varied in accordance with the variation of the direct current developing bias but the arrangement is not limited to this. The charging bias may be fixed or adapted for independent variation from the direct current developing bias.

SECOND EMBODIMENT

Figure 28:
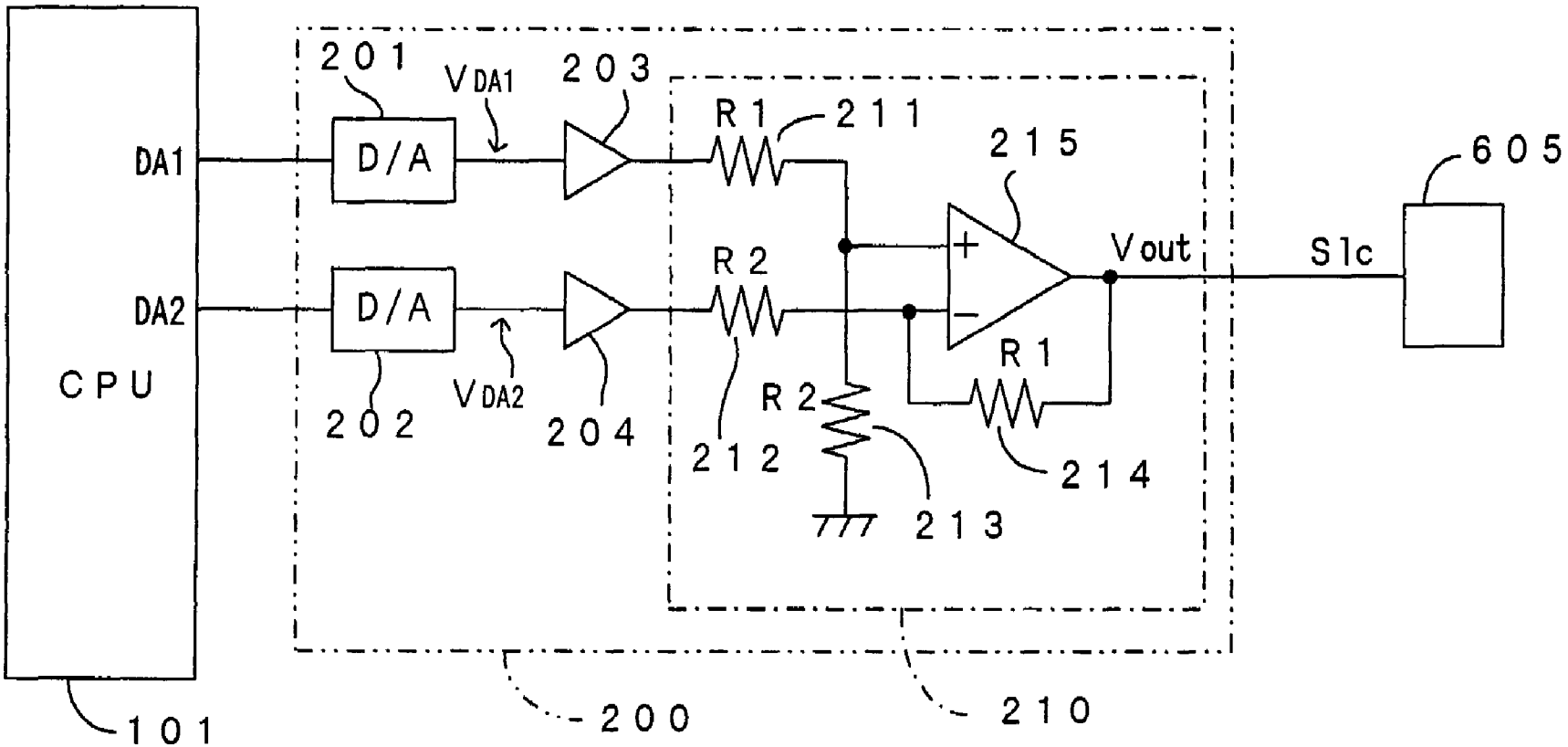
FIG. 28 is a diagram showing a light-quantity control signal conversion section according to a second embodiment.

FIG. 28 is a diagram showing a light-quantity control signal conversion section according to a second embodiment. In the apparatus of the first embodiment (FIG. 4), the CPU 101 outputs the light-quantity control signal Slc directly to the irradiation-light-quantity regulating unit 605 of the density sensor 60. In contrast, the apparatus of the second embodiment differs from that of the first embodiment in that a light-quantity control signal conversion section 200 is interposed between the CPU 101 and the irradiation-light-quantity regulating unit 605.

The light-quantity control signal conversion section 200 operates to supply a light-quantity control signal Slc to the irradiation-light-quantity regulating unit 605 of the density sensor 60, the light-quantity control signal Slc having a voltage value based on two types of digital signals DA1 and DA2 outputted from the CPU 101 for light quantity control. The light-quantity control signal conversion section 200 includes two D/A (digital/analog) converters 201, 202 converting the two digital signals DA1, DA2 from the CPU 101 into analog signal voltages VDA1, VDA2, respectively, which are inputted to an operation section 210 via buffers 203, 204, respectively.

In this embodiment, the D/A converters 201, 202 each have a resolution of 8 bits and operates from a single +5V power source. That is, the output voltage VDA1 or VDA2 can take discrete values of 256 levels ranging from 0V to +5V in accordance with a value (0 to 256) of an 8-bit digital signal DA1 or DA2 from the CPU 101. When the digital signal DA1 from the CPU 101 is at 0, for example, the output voltage VDA1 from the D/A converter 201 is at 0V At each increase in the value of the digital signal DA1 by 1, the output voltage VDA1 is increased in increments of a minimum voltage step ΔVDA=(5/255)V When the digital signal DA1 is at 255, the output voltage VDA1 from the D/A converter 201 is at +5V The same holds for the output voltage VDA2 from the D/A converter 202. In this manner, the output voltage VDA1 from the D/A converter 201 and the output voltage VDA2 from the D/A converter 201 both can take discrete values of 256 levels corresponding to the 8-bit digital signal.

It is desirable to permit the light-quantity control signal Slc to be set in a larger number of smaller steps from the standpoint of providing fine control of the amount of irradiation light from the light emitter element 601. Although increasing the number of bits of the digital signals DA1, DA2 permits the finer setting, this is not practicable from the viewpoint of the apparatus costs. That is, as the D/A converters 201, 202, it is necessary to use a device of which the number of incoming bits is greater and the resolution is high, but such a device is expensive. Particularly, as to the CPU, it is necessary to use a product of which the data bit length is 16 bits in order to handle data which is beyond 8 bits. However, such a product is much more expensive than a product of which the data bit length is 8 bits.

On this account, this embodiment is arranged such that the operation section 210 performs a predetermined operation on the output voltages from the two D/A converters 201, 202 so as to provide the operation results as the light-quantity control signal Slc. Thus, this embodiment provides for the light-quantity control at high resolution while limiting the data bit length to 8 bits for the reduced apparatus costs.

The operation section 210 is a subtracter circuit comprising four resistors 211 to 214 and an operational amplifier 215. Of the four resistors 211 to 214, two resistors 211 and 214 have the same resistance R1 whereas the other two resistors 212 and 213 have the same resistance R2 (R2>R1). Thus configured, the operation section 210 provides an output voltage Vout expressed by the following equation:

$$Vout=VDA1-(R1/R2)VDA2 \quad (2\text{-}1)$$

The output voltage Vout as the light-quantity control signal Slc is inputted to the irradiation-light-quantity regulating unit 605 of the density sensor 60.

In the above equation (2-1), when the value VDA1 is increased by ΔVDA, the output voltage Vout is also increased by ΔVDA. Conversely, when the value VDA2 is increased by ΔVDA, the output voltage Vout is decreased by (R1/R2)ΔVDA. In other words, when the value of the digital signal DA1 supplied from the CPU 101 to the D/A converter 201 is varied by 1, the output voltage Vout is varied by ΔVDA. On the other hand, when the value of the signal DA2 supplied to the D/A converter 202 is varied by 1, the output voltage Vout is varied by (R1/R2)ΔVDA. Therefore, by properly defining the combination of the signal values DA1 and DA2, the light-quantity control signal Slc can be adjusted in steps of a minimum voltage step (R1/R2)ΔVDA. If, for example, the resistances R1 and R2 are so defined as to provide (R1/R2)=¼, the light-quantity control signal Slc can be set to an arbitrary value in the range of 0 to +5V and in steps of the minimum voltage step (ΔVDA/4) by means of the combination of the signal values DA1 and DA2. This is equivalent to 2 bit increase of the resolution from the case where the setting is based only on the value of the 8-bit digital signal DA1.

Figure 29:
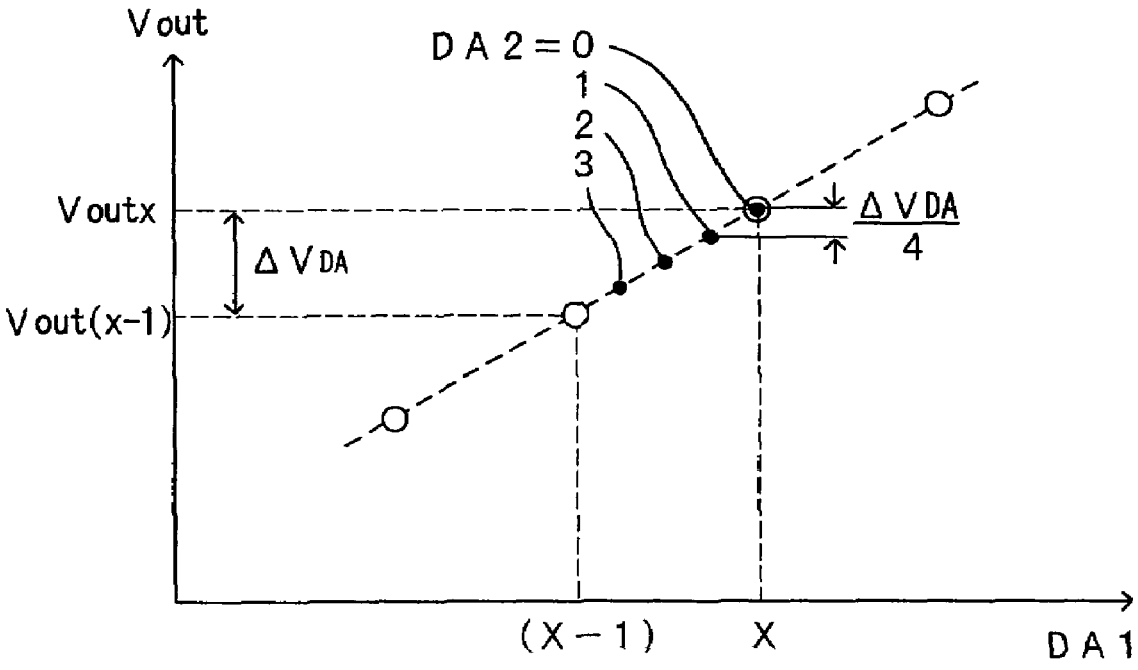
FIG. 29 is a graph explaining the principles of a method for defining the light-quantity control signal.

FIG. 29 is a graph explaining the principles of a method for defining the light-quantity control signal. The explanation is given by way of example where (R1/R2)=¼. Where only the 8-bit digital signal DA1 from the CPU 101 is used, the output voltage Vout can only be set in steps of a minimum voltage step ΔVDA, as indicated by blank dots in FIG. 29. When the signal DA1 has a value (X−1), for example, the output signal Vout assumes a value Vout(x−1), as shown in FIG. 29. When, on the other hand, the signal DA1 is increased by 1 to X, the output signal Vout is increased by ΔVDA to Voutx so that the output signal Vout cannot be set to a value intermediate these values.

Here, if the value of the signal DA2 is increased from 0 in increments of 1 provided that DA1 is at X, the value of the output signal Vout is decreased from Voutx in decrements of (ΔVDA/4). That is, the output signal Vout is allowed to assume an intermediate value between Vout(x−1) and Vout by setting the signal DA2 at a value in the range of 0 to 3, as indicated by solid dots in FIG. 29. That is, as compared with the case where only the signal DA1 is used, the light-quantity control signal Slc can be set with higher resolution (increased by a factor of 4, in this example).

Where the value of signal DA1 is fixed and the output voltage Vout is adjusted based only on the signal DA2, the output voltage can be set in small steps but conversely, the variable range of the output voltage becomes narrower. As described above, both the wide variable range and the high resolution can be achieved by using the signal DA1 for rough setting of the output voltage Vout in relatively broad steps in combination with the signal DA2 for smaller-stepwise interpolation between the voltage steps.

In this manner, the steps of the output voltage Vout can be arbitrarily defined based on the ratio (R1/R2) between the resistances R1 and R2. From the standpoint of increasing the resolution, therefore, the value (R1/R2) may preferably be set to the minimum possible value. However, it is noted that the variable range of the output voltage Vout dependent upon the signal DA2 is also decreased correspondingly to the value of this ratio. For the purpose of interpolating the voltage step ΔVDA equivalent to the minimum step 1 of the signal DA1 by way of the regulation of the signal DA2, it is undesirable that the range of the output voltage Vout to be adjusted by the signal DA2 is smaller than ΔVDA. More specifically, since the signal DA1 has the data bit length of 8 bits, defining the value (R1/R2) to be less than (1/256) results in the incapability of uniformly interpolating between the Vout(x−1) and Voutx of the output voltage Vout.

In the practically used apparatus, the resistances R1, R2 may be decided based on the bit length of the data to be handled by the apparatus and the resolution required for setting the light quantity. This embodiment defines as R1=1 kΩ, R2=64.9 kΩ, whereby a resolution substantially equivalent to 14 bits is achieved although the data bit length is 8 bits.

Figure 30:
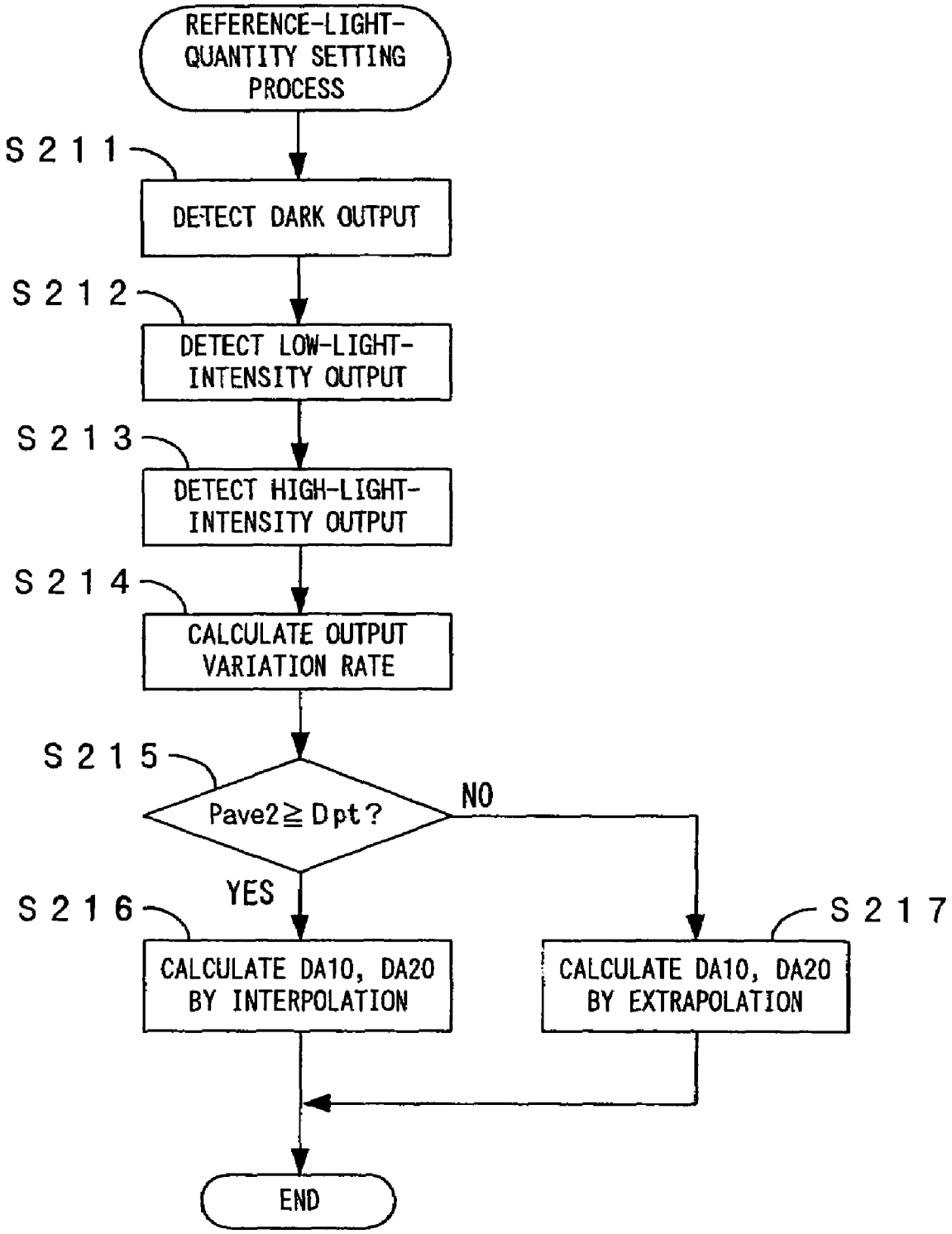
FIG. 30 is a flow chart representing the steps of a process for setting a reference light quantity according to the second embodiment.

FIG. 30 is a flow chart representing the steps of a process for setting a reference light quantity according to the second embodiment, whereas FIG. 31 are graphs each explaining the principles of the process for setting reference light quantity. The apparatus of the second embodiment performs the process for setting reference light quantity in place of "the calibrations (1), (2) of the sensor" (Steps S21*a*, S21*b*) and "the setting of reference-light-quantity control signal" (Step S22) of the pre-operation 1 of FIG. 10 which are performed in the first embodiment. More specifically, the process defines the values of the signals DA1 and DA2 such that the irradiation-light-quantity regulating unit 605 may be supplied with such a light-quantity control signal Slc as to cause the light emitter element 601 to emit light at a predetermined reference light quantity. Except for this, the apparatus of the second embodiment has the same arrangement and operations as the apparatus of the first embodiment.

As shown in FIG. 30, the reference-light-quantity setting process is started by detecting the dark output (Step S211), similarly to the first embodiment. This step detects the output voltages Vp, Vs from the light receiver elements 670*p*, 670*s* with the light emitter element 601 turned OFF. In the subsequent steps, detection values Dp, Ds are used in place of the analog values of the output voltages Vp, Vs from the two light receiver elements. The detection values Dp, Ds are obtained by converting these voltage values into 10-bit digital values by means of unillustrated A/D converter circuits, respectively.

The values Dp, Ds thus detected with the light emitter element 601 turned OFF are stored as dark output values Dp0, Ds0 which are digital values corresponding to the analog values illustrated as the dark outputs Vp0, Vs0 in the first embodiment. For reducing the detection errors, the voltage detection is executed at intervals of 8 msec to obtain 22 samples, respectively, and average values of the detected results are used as the above dark output values Dp0, Ds0, respectively.

Subsequently, the light emitter element 601 is operated to emit light of low light intensity, while a detection value Dp corresponding to the p-polarized light component is detected (Step S212). At this step, the CPU 101 sets a value DATEST1 of the signal DA1 outputted to the D/A converter 201 to 56, and a value of the signal DA2 outputted to the D/A converter 202 to 0, in order to operate the light emitter element 601 to emit light of low light intensity. In this state, detection values Dp of 312 samples are acquired and an average value thereof Pave1 is calculated.

Next, the light emitter element 601 is operated to emit light of high light intensity, while a detection value Dp corresponding to the p-polarized light component is detected (Step S213). At this step, the value DATEST2 of the signal DA1 is set to 67 so as to provide the irradiation light of higher light intensity than the previous step. The value of the signal DA2 is set to 0. In this state, detection values Dp of 312 samples are acquired and an average value thereof Pave2 is calculated in a similar manner.

The values DATEST1 and DATEST2 of the signal DA1 for causing the light emitter element 601 to emit light at low light intensity and high light intensity are not limited to the above. However, it is preferred to set these values in a region based on a relation between the quantity of light from the light emitter element 601 and the signal DA1, the region wherein the quantity of light from the light emitter element 601 is proportional to the value of the signal DA1. Such a setting permits a calculation operation to be performed based on linear interpolation.

Then, as data for use in the calculation to be described hereinlater, the variation rate of the detection value Dp relative to the value of the signal DA1 is calculated as below (Step S214):

$$\Delta Dp=(Pave2-Pave1)/(DA\text{TEST2}-DA\text{TEST1}) \quad (2\text{-}2)$$

It is noted here that the calculation method is changed as follows depending upon which of a target value Dpt equivalent to a detection value Dp for the reference quantity of light from the light emitter element 601 and the value Pave2 given by the above step is greater (Step S215). Similarly to the first embodiment, the target value Dpt here is equivalent to an analog value given by adding the dark output Vp0 to 3V. The detection value Dp and the signal DA1 value establish a linear relation therebetween, the gradient of which is equivalent to the previously determined value ΔDp.

(1) Pave2≧Dpt: Step S216 (FIG. 31A)

In this case, as shown in FIG. 31A, the target value Dpt is between the measured values Pave1 and Pave2 and hence, set values DA10, DA20 of the signals DA1, DA2 for providing the target light quantity can be calculated by interpolation. First, a set value DA10 of the signal DA1 is determined so as to attain a detection value Dp which is equal to or higher than and closest to the target value Dpt. Then, a value DA20 of the signal DA2 is determined such that the value DA20 in combination with the set value DA10 may provide a detection value Dp closest to the target value Dpt.

Specifically, the set values DA10 and DA20 are determined based on the following equations:

$$DA10=DA\text{TEST2}-\text{INT}[(Pave2-Dpt)/\Delta Dp] \quad (2\text{-}3)$$

$$DA20=[(Pave2-Dpt) \bmod \Delta Dp]/(\Delta Dp/64.9) \quad (2\text{-}4)$$

It is noted here that INT[x] represents an operator giving a maximum integer not higher than x, whereas [x mod y] represents an operator giving a remainder of x divided by y.

(2) Pave2<Dpt: Step S217 (FIG. 31B)

In this case, as shown in FIG. 31B, the target value Dpt is not intermediate the measured values Pave1 and Pave2 and hence, the set values DA10, DA20 for the signals DA1, DA2 for attaining the target light quantity are determined by extrapolation. The method for determining the set values DA10, DA20 is fundamentally the same as the above but uses somewhat different calculation equations as below:

$$DA10=DA\text{TEST2}+\text{INT}[(Dpt-Pave2)/\Delta Dp]+1 \quad (2\text{-}5)$$

$$DA20=\{\Delta Dp-[(Dpt-Pave2) \bmod \Delta Dp]\}/(\Delta Dp/64.9) \quad (2\text{-}6)$$

In order to operate the light emitter element 601 to emit the reference quantity of light in the subsequent operations, the CPU 101 may set the signals DA1 and DA2 outputted to the D/A converters 201, 202 to the above set values DA10, DA20. Thus, a light-quantity control signal Slc corresponding to the reference light quantity is supplied to the irradiation-light-quantity regulating unit 605, thereby causing the light emitter element 605 to emit the reference quantity of light. Since the quantity of light from the light emitter element 601 is unstable immediately after the light-quantity control signal Slc is changed, it is desirable to allow a given length of time to elapse before carrying out the detection of light quantity. According to this embodiment, only the detection values detected after the lapse of 100 msec or more from the change of the signal value DA1 or DA2 are regarded as valid.

Incidentally, the foregoing numerical values such as the resistances, set values and the like are merely illustrative. Needless to say, the present invention is not limited to these numerical values.

THIRD EMBODIMENT

Next, description is made on an image forming apparatus according to a third embodiment of the present invention. The image forming apparatus of this embodiment is constructed by adding the light-quantity control signal conversion section 200 of the second embodiment to the image forming apparatus of the first embodiment described above. As will be described hereinlater, however, the arrangement of the apparatus is partially varied and hence, a part of the optimization process for density control factor is also changed. Of the arrangement of the apparatus and the optimization process for density control factor, the description is made on differences from the foregoing first and second embodiments on an item-by-item basis and the explanation on the common features to these embodiments is dispensed with.

(1) Difference in the Apparatus Arrangement

According to the description of the first embodiment described above, the density sensor 60 (FIG. 4) is constructed such that the light receiver unit 670*p* for receiving the p-polarized light component of the reflection light from the intermediate transfer belt 71 has the same arrangement as the light receiver unit 670*s* for receiving the s-polarized light component. According to the third embodiment, on the other hand, the gains of the amplifier circuits 673*p*, 673*s* of these light receiver units are set to different values from each other. The reason is as follows. The reflection light or the s-polarized light component received by the light receiver unit 670*s* is a scattered light. Accordingly, the output voltage Vs corresponding to the s-polarized light component has a lower level than the output voltage Vp corresponding to the p-polarized light component, thus having a narrower dynamic range as the signal. The narrow dynamic range need be compensated for. In other words, the dynamic range of the output voltage Vs is widened by increasing the gain of the amplifier circuit 673*s* corresponding to the s-polarized light component. Thus, the density detection can achieve higher accuracies.

Specifically, the gain of the amplifier circuit 673*s* is set to a value of Sg times (Sg>1) the gain of the amplifier circuit 673*p*. The gain scaling factor Sg may be properly decided according to the optical characteristics of the intermediate transfer belt 71, the sensitivities of the light receiver elements 672*p*, 672 and the like. However, as will be described hereinlater, the subsequent calculation operation will be advantageously expedited if the scaling factor is so defined as to provide the same value of the output voltages Vp, Vs from the both sensors at the time of the maximum density of a color toner. In various calculation operations using both detection values of the output voltages Vp, Vs from the density sensor 60, the detection value for the output voltage Vp first need be multiplied by Sg in order to equalize the ranges of the both detection values.

(2) Execution Timing of Optimization Process and Contents thereof to be Executed The apparatus of the first embodiment is designed to perform the sequence of optimizing operations shown in FIG. 8 after the power-on of the apparatus or just after the replacement of any one of the units. On the other hand, the apparatus of the third embodiment performs a similar optimization process to the above just after the power-on, at the time the mounting of a new photosensitive member 2, and at the time the replacement of any of the developer cartridges. However, the optimization process is not required when a once removed developer is mounted to the apparatus again. Thus the optimization process is not carried out in a case where the same developer is removed from the apparatus and then mounted thereto again. For such identification of the developer, developer specific information such as a serial number thereof may previously be stored in the memory 91 or the like of each of developers 4Y or the like.

Furthermore, the apparatus of this embodiment performs the optimization process shown in FIG. 8 when the control target value for the density control need be changed as dictated by the result of checking the information indicative of the working conditions of each developer, the information including the number of rotations of the developing roller and the dot count value, the counts of which are kept by each developer. The reason is as follows. That is, similarly to the foregoing first embodiment, this image forming apparatus also differentiates the control target value for the density of the patch image according to the usage conditions of the developer, the patch image used in the optimization for density control factor.

Therefore, the optimization process may be performed at some point of time so that the image density may be adjusted based on a control target value used at this point of time. However, as the image forming operations are repeated from this time on, the state of the toner in the developer is changed to entail a progressive image density variation. For the purpose of obviating such an image density variation, it is desirable to re-adjust the image density at any suitable time even during the continuous production of a large number of images, for example, in addition to the aforementioned density adjustment performed at the time of the power-on or the replacement of the unit.

Various times to perform the re-adjustment may be contemplated. In one reasonable approach, for example, the image density may be re-adjusted at the time when the above control target value need be changed. This ensures the consistent image density, because when the changed toner characteristics necessitate the change of the control target value, the change is immediately reflected to the image forming conditions. The control target value is defined based on the number of rotations of the developing roller and the dot count value, the counts of which are kept by each developer.

Thus, this embodiment is arranged such that the image density is re-adjusted when the number of rotations of the developing roller or the dot count value concerning any one of the four developers reaches a predetermined threshold. It is noted that since the apparatus is in operation, the optimization process of FIG. 8 may omit the initialization operation at Step S1. Thus, the initialization operation is omitted to perform only the adjustment of the image density whereby the process time is reduced to decrease user wait time.

Because of the arrangement of the apparatus, it is easier for the engine controller 10 rather than the main controller 11 to grasp the information as to whether a mounted developer is the same that was removed from the apparatus or not, when to change the control target value and the like. Therefore, character information and information on the working conditions of the developer are processed by the CPU 101 of the engine controller 10, such that when determining from such information that the adjustment of the image density is necessary, the CPU 101 may inform on this need to the CPU 111 of the main controller 11. In response to this, the CPU 111 shifts the individual parts of the apparatus to proper operation conditions for the density adjustment.

(3) Sampling Point for Base Profile of Intermediate Transfer Belt 71

In the first embodiment, the base profile of the intermediate transfer belt 71 is determined for the overall circumferential length thereof in order to eliminate the influence of the surface conditions of the intermediate transfer belt 71 on the detection results of the toner image density. In contrast, this embodiment takes an approach wherein the base profile is acquired only from areas of the surface of the intermediate transfer belt 71, where the patch images are to be formed subsequently. This approach saves a memory resource by reducing the amount of data to be stored.

The embodiment will be described by way of the example of the patch image Iv0 shown in FIG. 19. As mentioned supra, the length L1 of the patch image Iv0 corresponds to the circumferential length L0 of the photosensitive member 2. The density sensor 60 performs the sampling on 74 different points in the patch image Iv0 thus formed. The density of the patch image Iv0 is determined based on the sampling results. If, therefore, the base profile is acquired at least from the same places as the 74 sampling points in the patch image Iv0, the density of the patch image may be determined in a manner free from the influence of the surface conditions of the intermediate transfer belt 71. Specifically, the following procedure is taken.

Figures 32A, 32B, 32C:
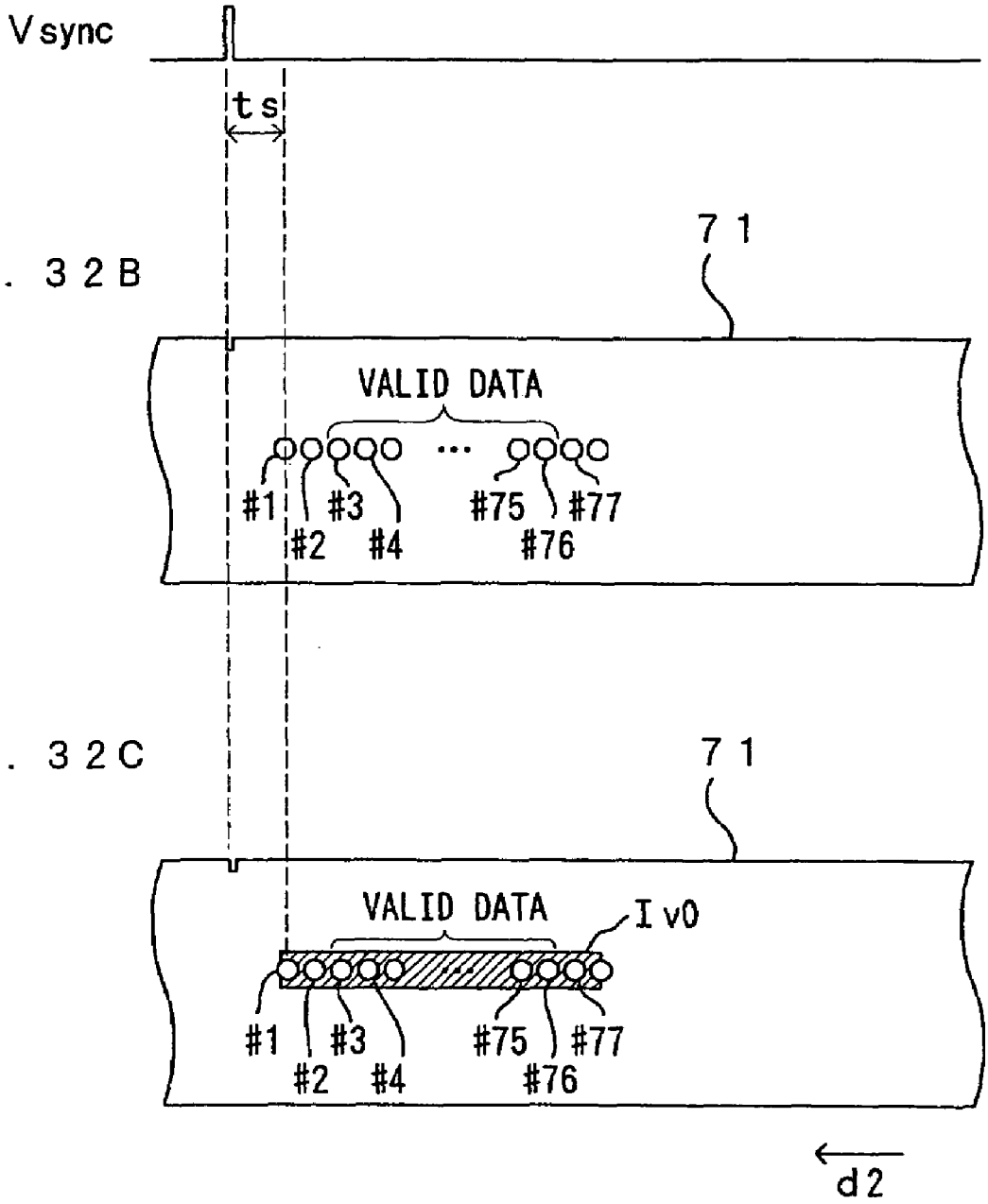
FIG. 32 are diagrams each showing the relation between the base-profile detecting points and the patch image according to a third embodiment.

FIG. 32 are diagrams each showing the relation between the base-profile detecting points and the patch image according to this embodiment. For obtaining the base profile of the surface of the intermediate transfer belt 71, the density sensor 60 starts the sampling after the lapse of a given length of time ts from a fluctuation of the vertical synchronizing signal Vsync (FIG. 32A) outputted from the vertical synchronization sensor 77 in association with the drivable rotation of the intermediate transfer belt 71, as shown in FIG. 32B. In the figures, the numerals with # affixed thereto indicate the ordinal positions of the sampling points. Then, 74 sample data pieces detected at the third sampling point #3 to the 76-th sampling point #76 are stored as valid data.

Next, the patch image Iv0 is formed on the intermediate transfer belt 71 in a manner to cover at least the sampling points #3 to #76, as shown in FIG. 32C. More specifically, the patch image Iv0 is formed on an area between the sampling points #1 and #78. When the density of the patch image Iv0 is detected, the sampling is performed on the same sampling points from that the base profile was detected, or specifically on the sampling points #3 to #76. The respective sets of 74 sample data pieces on the base profile and the patch image Iv0 thus obtained may be used for determining the density of the patch image in a manner excluding the influence of the surface conditions of the intermediate transfer belt 71.

This approach negates the need for storing the sample data pieces on the base profile with respect to the sampling points (#2 and its preceding points and #77 and its succeeding points) outside of the area subjected to the detection of the density of the patch image Iv0, thus contributing to the saving of the memory resource.

The other patch images Iv1 and the like may be subjected to the same procedure. This embodiment assigns the following blocks of sampling points out of the sampling points #1 to #312 to the respective patch images, the sampling points #1 to #312 located at 312 circumferential positions on the intermediate transfer belt 71.

Iv0, Iv3: #3-#76 (74 points)
Iv1, Iv4: #119-#192 (74 points)
Iv2: #235-#308 (74 points)
Iv5: #235-#255 (21 points)
Ie0: #56-#76 (21 points)
Ie1: #119-#139 (21 points)
Ie2: #182-#202 (21 points)
Ie3: #245-#265 (21 points)

If, in this way, the respective positions to form the individual patch images are so defined as to permit as many sampling points as possible to be shared, the sample data pieces to be stored as the base profile can be reduced to 232 pieces. As a value representative of each patch image, only a sum or average value of the sample data pieces in each block may be stored for further reduction of the number of data pieces to be stored. In this case, the evaluation value is calculated based on the aforesaid representative value of each block corresponding to each patch image.

(4) Setting Developing Bias

The process is a replacement for the "(D) Setting Developing Bias" of the first embodiment. This embodiment is adapted to set the direct current developing bias Vavg to any of the 256 levels in the range of (−50)V to (−400)V by defining a developing-bias setting parameter Pv taking any integer ranging from 0 to 255. In short, the process is expressed as:

$$Vavg=-(50+Pv\times 350/255)[V] \quad (3\text{-}1)$$

Provided Pv=0, for example, then Vavg=(−50)V Provided Pv=100, then Vavg=(−187.3)V. Hereinafter, the value of the developing bias Vavg corresponding to the developing-bias setting parameter Pv will be expressed as Vavg(Pv). The above examples are expressed as Vavg(0)=(−50)V and Vavg (100)=(−187.3)V The image density is increased with increase in the developing-bias setting parameter Pv.

This embodiment is also adapted to set the exposure energy to any of the 8 levels ranging from the minimum level E(0) to the maximum level E(7). The lowest image density is attained at the exposure energy E(0), whereas the highest image density is attained at the exposure energy E(7).

Figure 33:
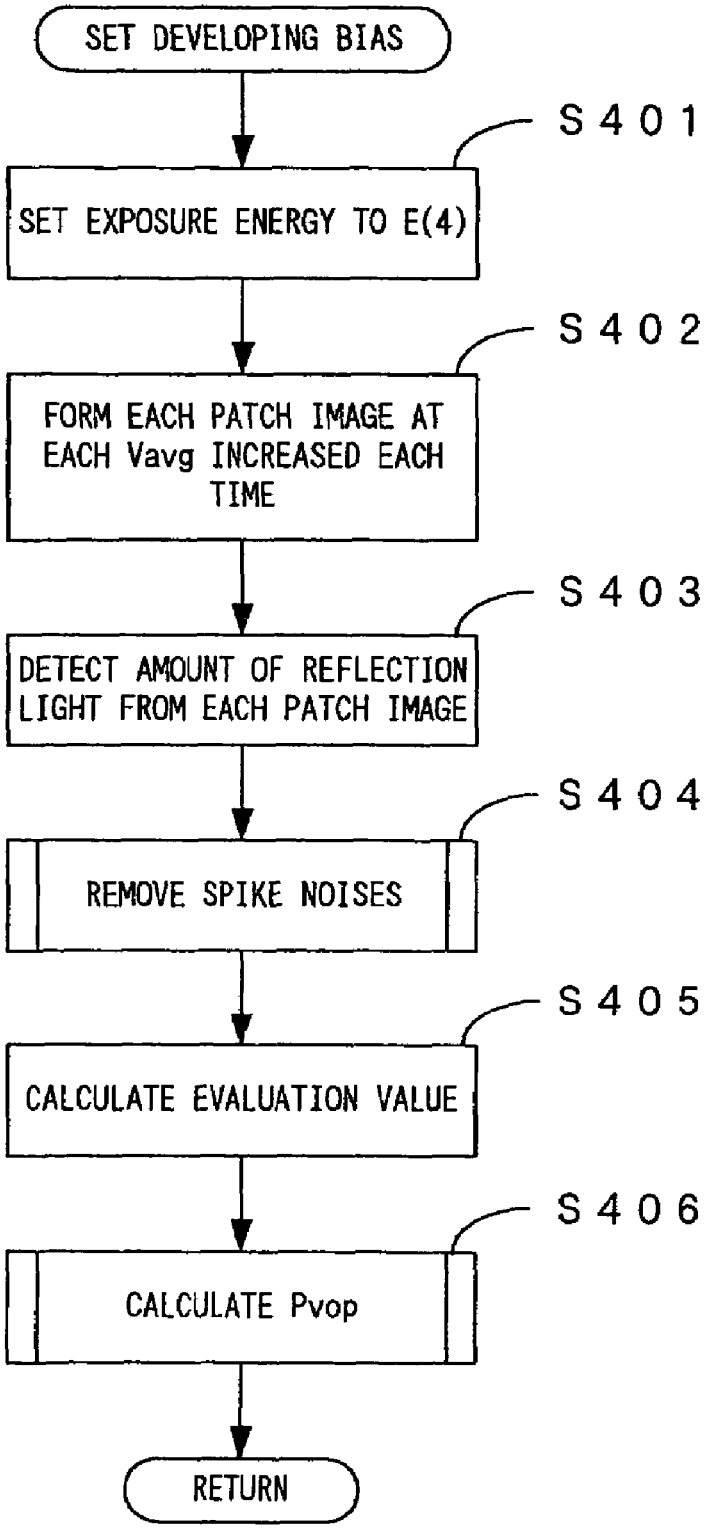
FIG. 33 is a flow chart representing the steps of a process for setting a developing bias according to the third embodiment.

FIG. 33 is a flow chart representing the steps of the developing-bias setting process according to this embodiment. The developing-bias setting process is started by setting the exposure energy to E(4) (Step S401). Subsequently, the developing-bias setting parameter Pv is sequentially set to each different level for varying the direct current developing bias Vavg so that each patch image may be formed at each different bias value (Step S402). The pattern and shape of the patch image to be formed are the same as those of the patch image of the first embodiment shown in FIG. 19. The values of the developing-bias setting parameter Pv(n) in correspondence to the patch image Ivn are defined as follows: Pv(0)=44 (corresponding to Vavg=−110V); Pv(1)=76; Pv(2)=108; Pv(3)=140; Pv(4)=172; Pv(5)=204 (corresponding to Vavg=−330V).

A predetermined number of samples are detected from each of the patch images thus formed by means of the density sensor 60 detecting the amount of reflection light therefrom (Step S403). After removal of the spike noises from the sample data (Step S404), an evaluation value A(n) for the patch image Ivn is calculated (Step S405). The calculation operations are the same as those of the first embodiment. Based on the evaluation value thus determined, the optimum value Pvop of the developing-bias setting parameter Pv that provides the optimum developing bias Vop is calculated (Step S406). The following relationship exists between the optimum value Pvop and the optimum direct current developing bias Vop:

$$Vop=Vavg(Pvop) \tag{3-2}$$

Thus, the optimum direct current developing bias Vop can be obtained by determining the optimum value Pvop of the developing-bias setting parameter Pv. This embodiment differentiates the calculation method between the color toner and the black toner, as will be specifically described hereinlater.

Figure 34:
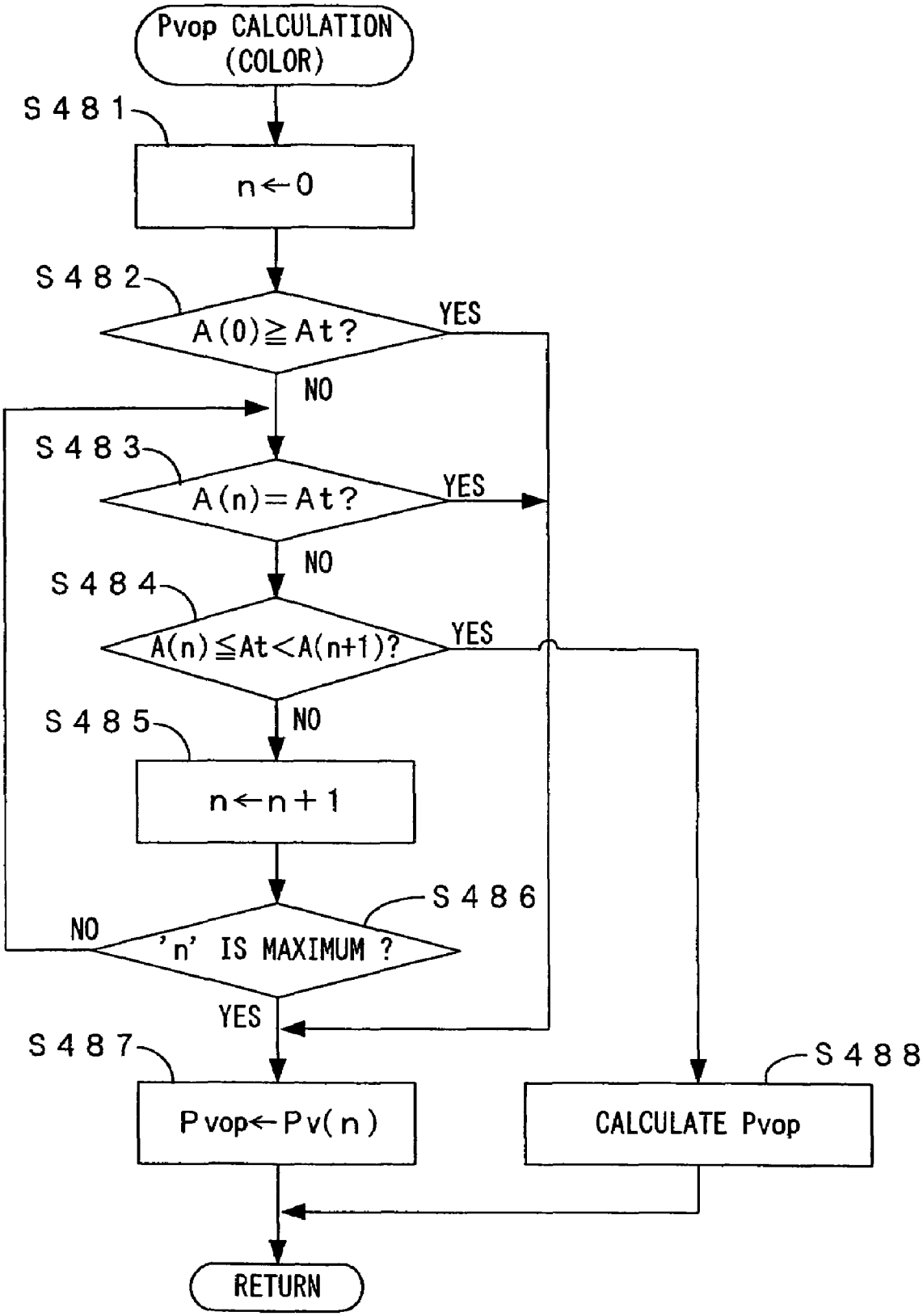
FIG. 34 is a flow chart representing the steps of a calculation process for optimum value of developing-bias setting parameter for color toner according to the third embodiment.

FIG. 34 is a flow chart representing the steps of a calculation process for optimum value of a developing-bias setting parameter for color toner according to this embodiment. In the optimum-value calculation process, a variable 'n' is first set to 0 (Step S481) and then, an evaluation value A(0) for the patch image Iv0 is compared with its target value At (Step S482). If the evaluation value A(0) is greater than the target value At (YES), the control flow jumps to Step S487 where the developing-bias setting parameter Pv(0) used for forming the patch image Iv0 is selected as the optimum value Pvop. Then, the calculation process is terminated. This means a case where an adequate image density is attained in spite of setting the developing-bias parameter Pv to such a low value.

On the other hand, if Step S482 gives "NO", the control flow enters a processing loop including Steps S483 to S486, wherein the optimum value of the developing-bias parameter Pv is determined as follows. Specifically, where an evaluation value A(n) for the patch image Ivn corresponding to the variable 'n' is equal to the target value At (Step S483), the control flow jumps to Step S487 where a developing-bias parameter Pv(n) used at the formation of this patch image is selected as the optimum value Pvop. Otherwise, determination is made as to whether or not the target value At exists between the evaluation value A(n) for the patch image Ivn and an evaluation value A(n+1) for a patch image Iv(n+1) formed under a condition to provide a 1-level higher density than the former one (Step S484). If the target value At exists between these two evaluation values, the control flow jumps to Step S488 where the optimum value Pvop is determined by interpolation based on the following equation:

$$Pvop=\{At-A(n)\}/\{A(n+1)-A(n)\}\times\{Pv(n+1)-Pv(n)\}+Pv(n) \tag{3-3}$$

It is noted that the calculation result is rounded to the nearest integer.

Where the target value At does not exist between these two evaluation values, the variable 'n' is incremented (Step S485) and then the above steps are repeated to find the optimum value Pvop. However, in a case where the variable 'n' reaches the maximum value 5 before the optimum value is found (Step S486), a developing-bias parameter Pv(n) at such a point of time, or Pv(5) is considered as the optimum value Pvop. By performing this process on each of the color toners of yellow, cyan and magenta, each optimum value Pvop of the developing-bias setting parameter for each color is set to any value between Pv(0) to Pv(5). When the CPU 101 outputs the resultant value Pvop to the developer controller 104 (FIG. 2), an optimum developing bias Vop at this value is applied to the developing roller 44 from the developer controller 104.

Figure 35:
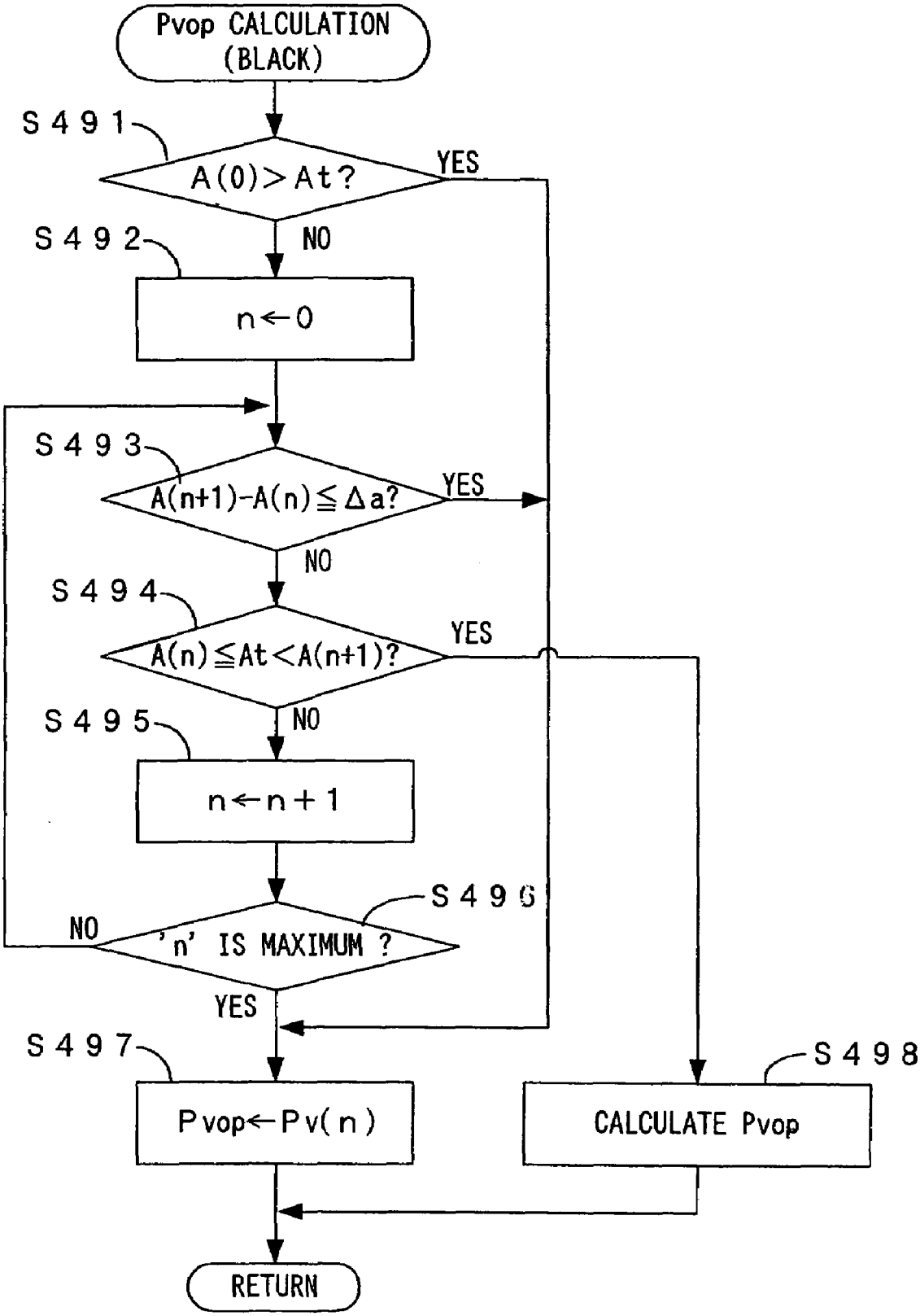
FIG. 35 is a flow chart representing the steps of a calculation process for optimum value of developing-bias setting parameter for black toner according to the third embodiment.

FIG. 35 is a flow chart representing the steps of a calculation process for optimum value of a developing-bias setting parameter for black toner according to this embodiment. In a patch image of the black toner, the saturation of the evaluation value with respect to the amount of toner adhesion described in the first embodiment is more likely to occur than in the patch image of the color toner. Hence, similarly to the first embodiment, this embodiment determines the optimum value of the developing-bias setting parameter for the black toner taking into account the variation rate of the evaluation value. Specifically, when a difference between an evaluation value A(n+1) for a patch image Iv(n+1) and an evaluation value A(n) for a patch image Ivn is equal to or smaller than Δa, the control flow jumps to Step S497 where a developing-bias parameter Pv(n) used for forming the patch image Ivn is selected as the optimum value Pvop.

The other contents of the process are substantially the same as those for the color toner. The calculation at Step S498 can use the same equation (3-3) for the color toner. Thus, the developing-bias setting parameters Pv providing the optimum developing biases Vops are determined for the toners of four colors (Y, M, C, K).

(5) Setting Exposure Energy

The process is a replacement for the "(E) Setting Exposure Energy" of the first embodiment. As described in the section "(4) Setting Developing Bias" herein, the apparatus of the third embodiment is adapted to set the exposure energy to any of the 8 levels from E(0) to E(7). Specifically, by setting an exposure-energy setting parameter Pe to any level of 0 to 7, the exposure energy of the light beam L emitted from the exposure unit 6 is set to E(Pe). According to the exposure-energy setting process of this embodiment, patch images at 4 levels of the exposure energy E(0), E(2), E(4) and E(7) are formed under the optimum developing bias Vop. Based on the image densities of the patch images, a parameter Pe providing the optimum value of the exposure energy is determined for each toner color. The contents of the process are basically the same as those of the exposure-energy setting process of the first embodiment (FIG. 25) and hence, the description thereof is dispensed with. However, as an alternative step to Step S57 where the optimum exposure energy Eop is directly determined by calculation, the optimum value of the exposure-energy setting parameter Pe providing the optimum exposure energy Eop is determined.

As mentioned supra, the image forming apparatus of the third embodiment is partially different from the apparatus of the first embodiment in the arrangement and op rations. With such an arrangement, the apparatus is adapted for the image formation with the direct current developing bias Vavg and the exposure energy E set to the optimum values, likewise to the apparatus of the first embodiment, thus ensuring the formation of the toner image of good image quality in a stable manner.

In the first and second embodiments, the processings different from each other in contents but directed to the same purpose are interchangeable. For instance, the developing-bias setting process (FIGS. 33 to 35) of the third embodiment, in place of the developing-bias setting process (FIGS. 18 and 21), may be applied to the apparatus of the first embodiment or vice versa.

FOURTH EMBODIMENT

Next, explanation is given as to the reason why it is important to consider the surface conditions of the image carrier for accurately determining the image density of the patch image formed on the image carrier such as the photosensitive member 2 or the intermediate transfer belt 71. In addition, description is made on a specific embodiment for achieving high-accuracy measurement of the image density of the toner image irrespective of the surface conditions of the image carrier. FIG. 36 are graphs representing the sensor output value obtained at each sampling point on an image carrier before and after the formation of patch images (toner images) thereon, respectively, the image carrier having consistent surface conditions. FIG. 37 are graphs representing the sensor output value obtained at each sampling point on an image carrier before and after the formation of patch images (toner images) thereon, respectively, the image carrier having inconsistent surface conditions.

Many of the density sensors employed by the image forming apparatuses are arranged to emit light toward the image carrier by means of the light emitter element, and to receive the reflection light from the image carrier by means of the light receiver element for outputting an analog signal corresponding to the amount of received light. The image forming apparatus, in turn, takes measurement of the image density based on a sensor output value obtained by converting the analog signal into a digital signal. Assumed here that the overall surface of the image carrier has consistent reflectivity, surface roughness and the like so that the image carrier has consistent surface conditions, a sensor output value prior to the formation of a toner image like a patch image on the image carrier is at a constant value T irrespective of the sampling point, as shown in FIG. 36A for example. In a case where, for example, patch images of individually different densities OD1 to OD3 are formed on the image carrier, the sensor output is fluctuated at first to third patch positions by respective values corresponding to the image densities thereby giving sensor output values D1, D2, D3 (FIG. 36B). It is noted here that the image carrier has the consistent surface conditions and hence, the sensor output values D1, D2, D3 at the respective patch positions are constant values.

In the actual image forming apparatus, however, the surface conditions of the image carrier are not consistent. Accordingly, even before the formation of the toner image like the patch image on the image carrier, the sensor output value is varied depending upon the sampling points, as shown in FIG. 37A. Where the plural patch images of individually different densities OD1 to OD3 are formed on the image carrier, the sensor output value is fluctuated at the first to third patch positions by respective values corresponding to the image densities (FIG. 37B). Close examination of each patch position reveals that in the same patch area, the sensor output value is varied depending upon the sampling points. This is because the sensor output is affected by the surface conditions of the image carrier.

As indicated by comparison between the graphs of FIGS. 37A and 37B, the amounts of variation at the individual patch positions are decreased with increase in the density of the patch image. In other words, the magnitude of the influence of the surface conditions at the individual patch positions is progressively decreased with increase in the density of the patch image. For more clarity of this tendency, an image of each uniform density of OD1 to OD3 is formed on the overall surface of the image carrier and the sensor output values for each of the density levels are plotted. The results as shown in FIG. 38 are obtained.

FIG. 38 are a graph representing sensor output values prior to the image formation on the image carrier, and a graph representing respective sensor output value sets related to images formed on the image carrier at respectively different but consistent densities. In these figures and FIG. 37, the terms "Tave", "Dave_1", "Dave_2" and "Dave_3" indicate as follows:

"Tave": average sensor output value prior to the image formation on the image carrier, "Dave_1": average sensor output value for image formed at density (OD1), "Dave_2": average sensor output value for image formed at density (OD2), and "Dave_3": average sensor output value for image formed at density (OD3).

It is noted here that "Tave", "Dave_1", "Dave_2" and "Dave_3" are substantially in correspondence to "T", "D1", "D2" and "D3" in FIG. 36. Respective values free from the influence of the surface conditions of the image carrier may be obtained by determining "Dave_1", "Dave_2" and "Dave_3". Thus, the respective image densities can be detected accurately.

As apparent from the above figure, the influence which the surface conditions of the image carrier exert on the sensor output value is varied depending upon the degree of density of the toner image formed on the image carrier. Specifically, where a toner image of a relatively low density is formed on the image carrier, the output from the density sensor is varied in relatively large degrees depending upon the surface conditions of the image carrier because a part of the light from the light emitter element passes through the toner image to be reflected by the image carrier and then passes through the image carrier again to be received by the light receiver element. On the other hand, as the density of the toner image increases, not only the light through the toner image to become incident on the image carrier but also the reflection light from the image carrier through the image carrier again to become incident on the light receiver element are decreased in quantity and hence, the output from the density sensor is subjected to a decreased influence from the surface conditions of the image carrier. Therefore, if the image density of the toner image is detected in the following manner, the accuracy is limited to a certain degree. The sensor output value prior to the image formation on the image carrier (indicative of the surface conditions of the image carrier) is previously obtained as correction information. In the actual detection of the image density of a toner image formed on a given surface area of the image carrier say at a sampling point x1, a sensor output value for the sampling point x1 is regularly corrected based on the correction information as disregarding the degree of density of the toner image. Then, the image density of the toner image is determined based on the so corrected sensor output value.

In the practical detection of the image density of the toner image formed on the sampling point x1, on the other hand, an even higher measurement accuracy can be achieved by correcting the detection value based on the correction information and also by correcting the correction information based on the degree of density of the toner image.

The inventors of the present invention have discovered a fact that with increase in the density of the image on the image carrier, the amount of variation of the sensor output value is proportionally decreased. They also found that the values "Dave_1", "Dave_2", "Dave_3" with the influence of the surface conditions of the image carrier canceled out can be calculated in the following manner based on this finding. The details are described below with reference to FIG. 39.

Figure 39:
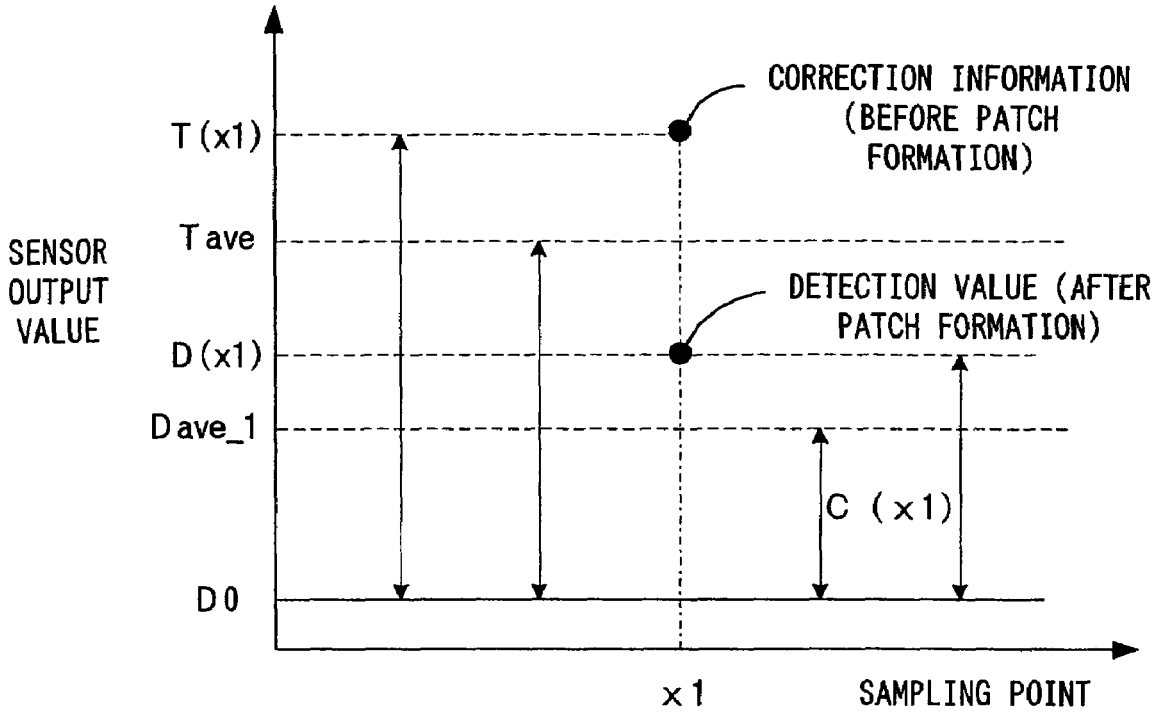
FIG. 39 is a graph representing the relation between the sensor output values before and after the formation of a first patch image (toner image)

FIG. 39 is a graph representing the relation between the sensor output values before and after the formation of a first patch image (toner image). In the figure, the reference character x1 denotes a sampling point indicative of a position on the surface area of the image carrier. Sensor output values obtained from the sampling point x1 before and after the formation of the first patch image are represented by T(x1), D(x1), respectively. The reference character D0 in the figure denotes a so-called dark output value obtained by digitizing an analog signal outputted from the light receiver element of the density sensor wherein the light emitter element is turned OFF. The reason for determining the dark output value D0 is that the dark output value D0 may be subtracted from the sensor output value thereby canceling out the influence of the dark output component for achieving an improved density measurement accuracy. In short, D0 is a reference value related to the amount of light received by the sensor.

Since the amount of variation of the sensor output value is proportionally decreased with increase in the density of the firs patch image on the image carrier, as described above, a relation expressed by the following equation is established:

$$(Tave-D0)/(T(x1)-D0)=(Dave_1-D0)/(D(x1)-D0) \quad (4\text{-}1)$$

The left-hand side of the equation (4-1) represents the relation prior to the formation of the toner image, indicating the ratio between an average sensor output value Tave and a sensor output value T(x1) prior to the formation of the toner image on the image carrier, the values removed of the dark output value D0. On the other hand, the right-hand side of the equation represents the relation of a toner image uniformly formed in the same density as the first patch image, thus indicating the ratio between an average sensor output value Dave_1 for the toner image uniformly formed on the image carrier (a value with the influence of the surface conditions of the image carrier canceled out) and a sensor output value D(x1). The values of these ratios are believed to be equal. The equation (4-1) can be further transformed into:

$$(Dave_1-D0)=(D(x1)-D0)\times\{(Tave-D0)/(T(x1)-D0)\} \quad (4\text{-}2).$$

That is, before the patch image is formed, the following values may be determined: the dark output value D0; and the average sensor output value Tave and the sensor output value T(x1) at the surface area x1 prior to the formation of the toner image on the image carrier. When a patch image is practically formed, a sensor output value D(x1) may be detected at the surface area x1 where the first patch image was formed. The individual values may be substituted in the above equation (4-2) thereby to obtain a corrected sensor output value C(x1) from which both the influences of the surface conditions of the image carrier and of the dark output component are removed. Thus, an accurate image density of the first patch image may be determined based on the correction value C(x1) (=$Dave_{_1-D0}$).

While FIG. 39 illustrates only the case where the first patch image is formed, the same holds for the second and third patch images.

The above illustrates the case where the sensor output value is obtained by A/D conversion of the signal from the light receiver element of the density sensor so that the image density of the patch image is determined based on a single sensor output value. However, the same procedure as in the first and third embodiments may be taken wherein the reflection light from the image carrier is split into the two light components, the amounts of which are used for the determination of the sensor output values, based on which values the image density of the patch image is determined. In particular, the former density measurement is suited to the patch image of the black toner, whereas the latter density measurement is suited to the patch image of the color toner.

Next, the operations of the image forming apparatus of the fourth embodiment are described. The image forming apparatus of this embodiment has the same mechanical and electrical arrangements as those of the first embodiment and hence, the description thereof is dispensed with.

Figure 40:
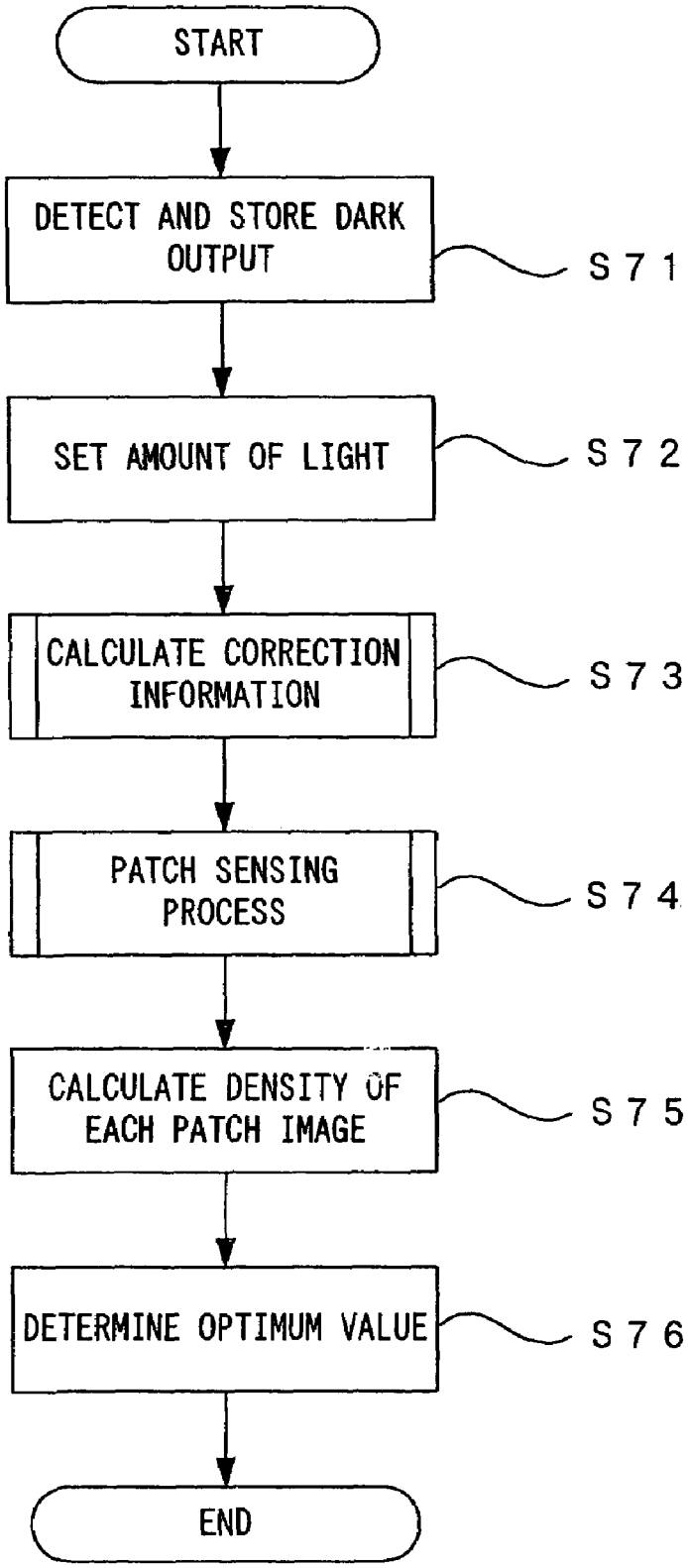
FIG. 40 is a flow chart representing the steps of an optimization process for density control factor performed in an image forming apparatus according to a fourth embodiment of the present invention.

FIG. 40 is a flow chart representing the steps of an optimization process for density control factor performed in the fourth embodiment. In this image forming apparatus, the CPU 101 controls the individual parts of the apparatus according to the aforesaid timings and a program previously stored in the ROM 106, thereby deciding the optimum value of the density control factor.

Prior to the transfer of a patch image to the intermediate transfer belt 71 equivalent to the "image carrier" of the present invention, Steps S71 to S73 are performed for determining information on the intermediate transfer belt 71 as correction information. Specifically, the first Step S71 detects dark output voltages Vp0, Vs0 and then A/D converts these values into dark output values Dp0, Ds0, which are stored in the RAM 107. The "dark output voltages Vp0, Vs0" represent respective amounts of the p-polarized light and s-polarized light in a state where the light emitter element 601 is turned OFF by outputting a light-quantity control signal Slc(0), equivalent to a turn-off command, to the irradiation-light-quantity regulating unit 605. That is, these output voltages mean the dark outputs of the p-polarized and s-polarized light components, respectively. The adverse effects of the dark output components are eliminated by individually subtracting the dark output values Dp0, Ds0 from sensor output values actually detected, as will be described hereinlater, thereby achieving the higher accuracies of the measurement. Thus, this embodiment determines the dark output values Dp0, Ds0 as reference values related to the amount of light received by the sensor. The step is equivalent to "reference-value detection step" of the present invention.

Next, a signal Slc(2) which is above the dead zone is set as the light-quantity control signal Slc. The light-quantity control signal Slc(2) is applied to the irradiation-light-quantity regulating unit 605 to activate the light emitter element 601 (Step S72). Then, the light from the light emitter element 601 is irradiated on the intermediate transfer belt 71 while the respective amounts of the p-polarized light and s-polarized light of the reflection light from the intermediate transfer belt 71 are detected by the reflection-light-quantity detecting unit 607. Output voltages Vp, Vs corresponding to the respective amounts of received lights are A/D converted into sensor output values, which are inputted to the CPU 101. The CPU 101, in turn, calculates respective correction information pieces from the sensor output values and then stores in the RAM 107 (Step S73: Correction-Information Detection Step).

Figure 41:
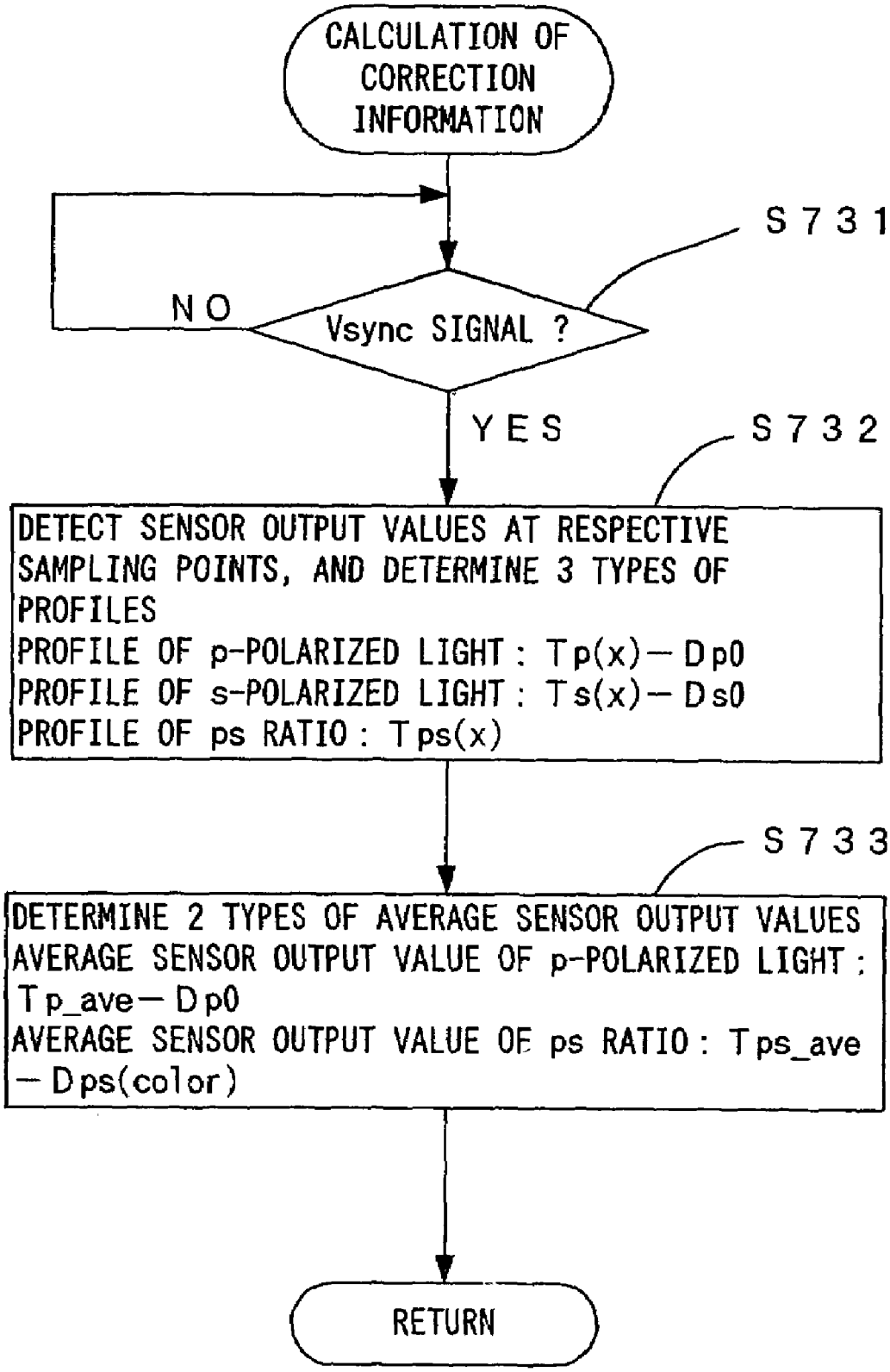
FIG. 41 is a flow chart representing the steps of a correction-information calculation process.

FIG. 41 is a flow chart representing the steps of a correction-information information calculation process. In the correction-information calculation process (Step S73), after the lapse of a predetermined period of time from the output of the vertical synchronizing signal Vsync (Step S731), sampling of sensor output values Tp(x), Ts(x) of the p-polarized light and s-polarized light is started to detect the sensor output values for one period of the intermediate transfer belt 71 prior to the patch-image formation, thereby determining the following 3 types of profiles as the correction information and storing in the RAM 107 (Step S732):

Profile of p-polarized light: Tp(x)−Dp0

Profile of s-polarized light: Ts(x)−Ds0

Profile of ps ratio: Tps(x)

Figure 42:
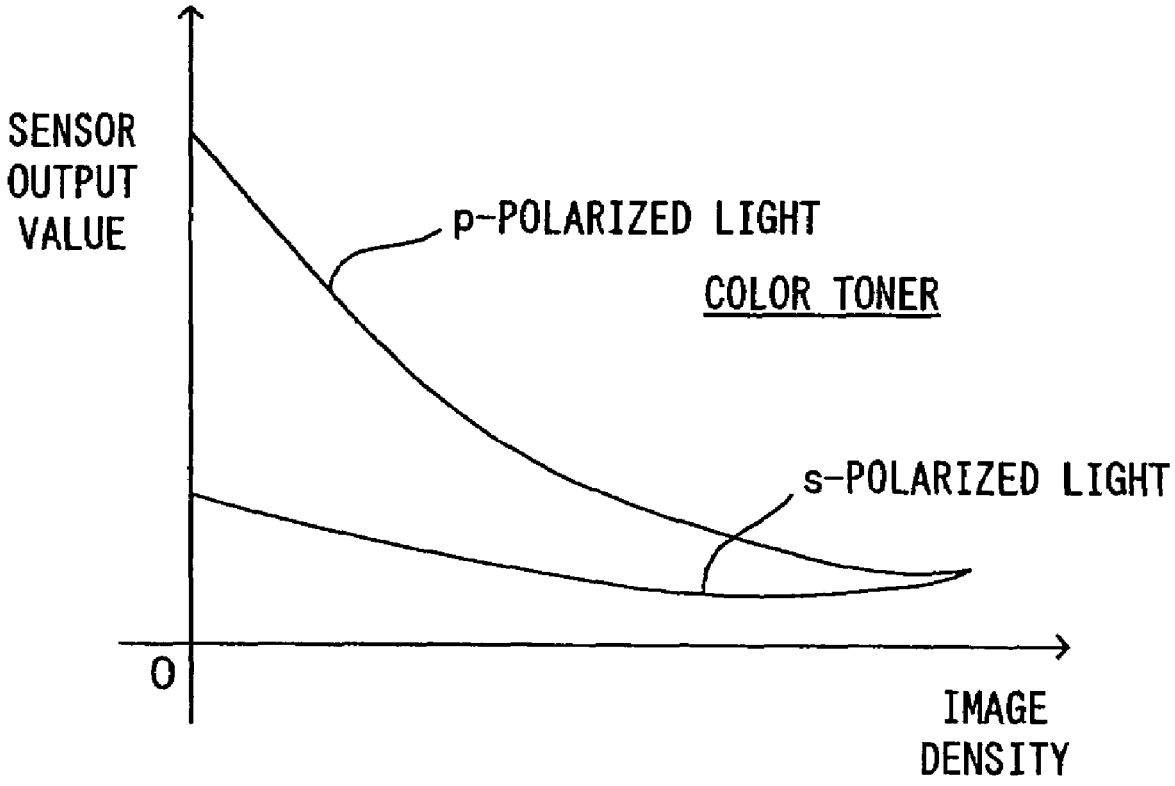
FIG. 42 is a graph showing how the sensor output value is varied relative to the image density of a color toner.

The term Tps(x) means the ratio between the p-polarized light and the s-polarized light at each sampling point (x), or is expressed as:

$$Tps(x)=Sg\times\{(Tp(x)-Dp0)/(Ts(x)-Ds0)\},$$

wherein the reference character Sg denotes the gain scaling factor for the s-polarized light. This embodiment defines the respective gains of the amplifier circuits 673*p*, 673*s* so as to provide an equal value of these sensor outputs at the maximum density of the color toner (FIG. 42). Therefore, in accordance with the variation of the image density, the sensor output value is also fluctuated in great degrees. As to the color toner, in particular, the ps ratio Tps(x) is progressively decreased with increase of the image density and reaches '1' at the maximum density.

In addition, respective average sensor output values for the p-polarized light and the ps ratio are determined:

average sensor output value for p-polarized light: Tp_ave−Dp0, average sensor output value for ps ratio: Tps_ave−Dps (color).

The resultant average values are stored in the RAM 107 (Step S733). The reference character Dps (color) means as follows. As described above, the settings are made based on the principle that the ps ratio is at '1' when the maximum density of the color toner is detected. In actual fact, however, the ps ratio may not be set strictly to '1' because of the variations of the components constituting the sensor, the accuracies of the output detector when the settings are made, or adjustment accuracies varying depending upon the adjustment method or the like. Furthermore, due to the specifications, color, lot and the like of a used toner, the output at the detection of the maximum density of each toner is deviated from '1'. If, in this case, the calculation is made based on the set concept that the maximum density so detected is at '1', this may result in the degraded accuracies of detection and correction of the color toner. Instead of simply fixing the value of the maximum density of each color toner detected by the sensor to '1', the value is defined as adjustable Dps(color). Thus, the accuracy of the detection of the color toner based on the ps ratio is increased. That is, Dps(color) is a reference value related to the amount of light received by the sensor at the time of detecting the color toner, thus corresponding to D0 in the equation (4-2).

Figure 43:
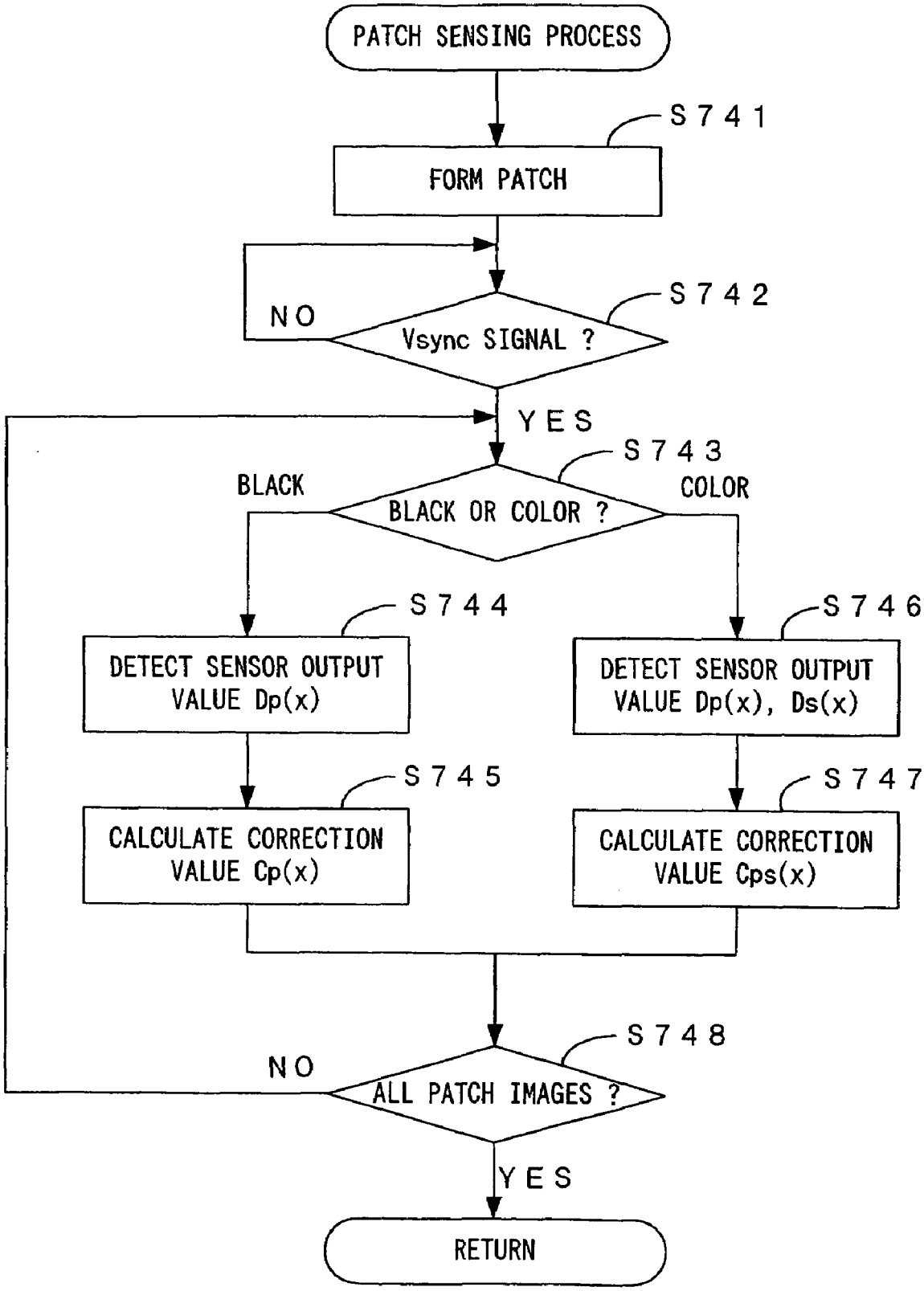
FIG. 43 is a flow chart representing the steps of a patch sensing process.

When the correction information is thus acquired, the control flow proceeds to Step S74 of FIG. 40 wherein a patch sensing process is performed. FIG. 43 is a flow chart representing the steps of the patch sensing process. In the patch sensing process (Step S74), with the density control factor varied stepwise, patch images corresponding to patch-image signals previously stored in the ROM 106 are formed on the photosensitive member 2 and then transferred onto the intermediate transfer belt 71 (Step S741).

Figure 44:
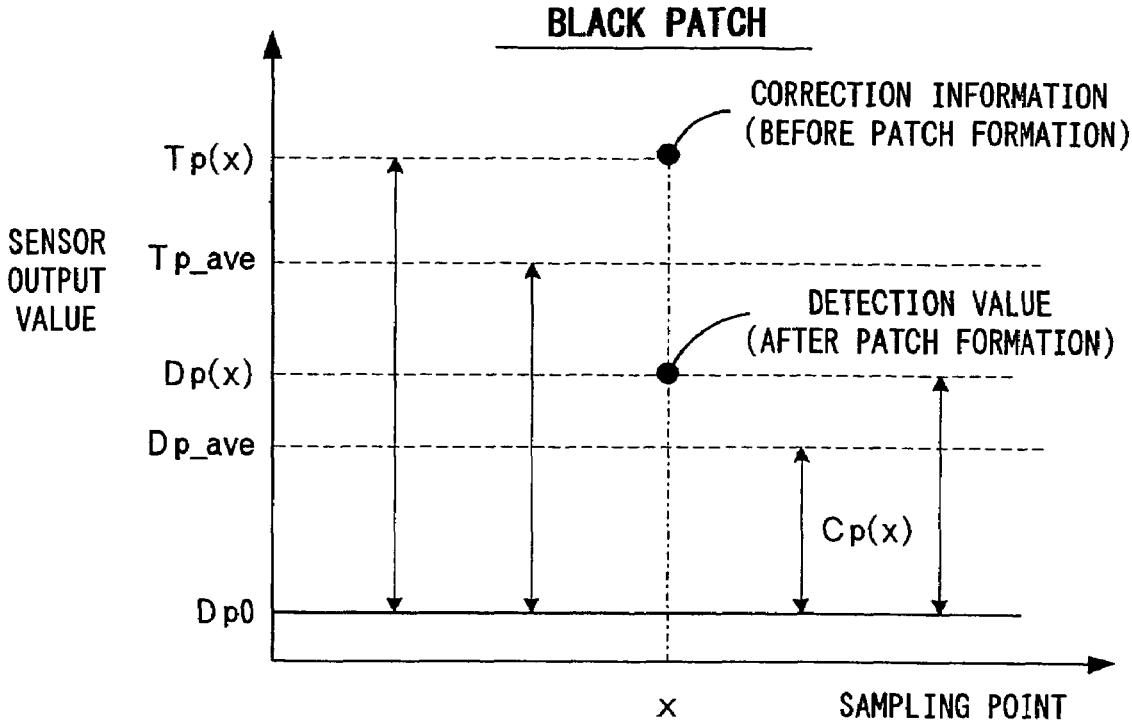
FIG. 44 is a graph representing the relation between the sensor output values before and after the formation of a patch image (toner image) of a black toner.

Similarly to the correction-information calculation process (Step S73), after the lapse of a predetermined period of time from the output of the vertical synchronizing signal Vsync (Step S742), Steps S743 to S748 are performed each time each patch image is delivered to a sensing position of the density sensor 60, thereby determining correction values for all the patch images. Specifically, Step S743 determines whether the patch image is formed of the black toner (K) or a color toner (Y, M, C). Where the patch image is formed of the black toner, a sensor output value Dp(x) is detected at a sampling point x corresponding to a surface area where the patch image is formed (Step S744: Output Detection Process). Thereafter, the following equation equivalent to the equation (4-2) is used to calculate a correction value Cp(x) (Step S745, see FIG. 44):

$$Cp(x)=(Dp_ave-Dp0)=(Dp(x)-Dp0)\times\{(Tp_ave-Dp0)/(Tp(x)-Dp0)\} \quad (4\text{-}2A)$$

That is, the average sensor output value for the p-polarized light (Tp_ave−Dp0), the sensor output value at the sampling point x (Tp(x)−Dp0) and the dark output value Dp0 are retrieved from the RAM 107. Along with the sensor output value Dp(x) thus detected, these values are substituted in the above equation (4-2A) such that the sensor output value Dp(x) is corrected to calculate the correction value Cp(x) (Corrected-Value Calculation Step).

Figure 45:
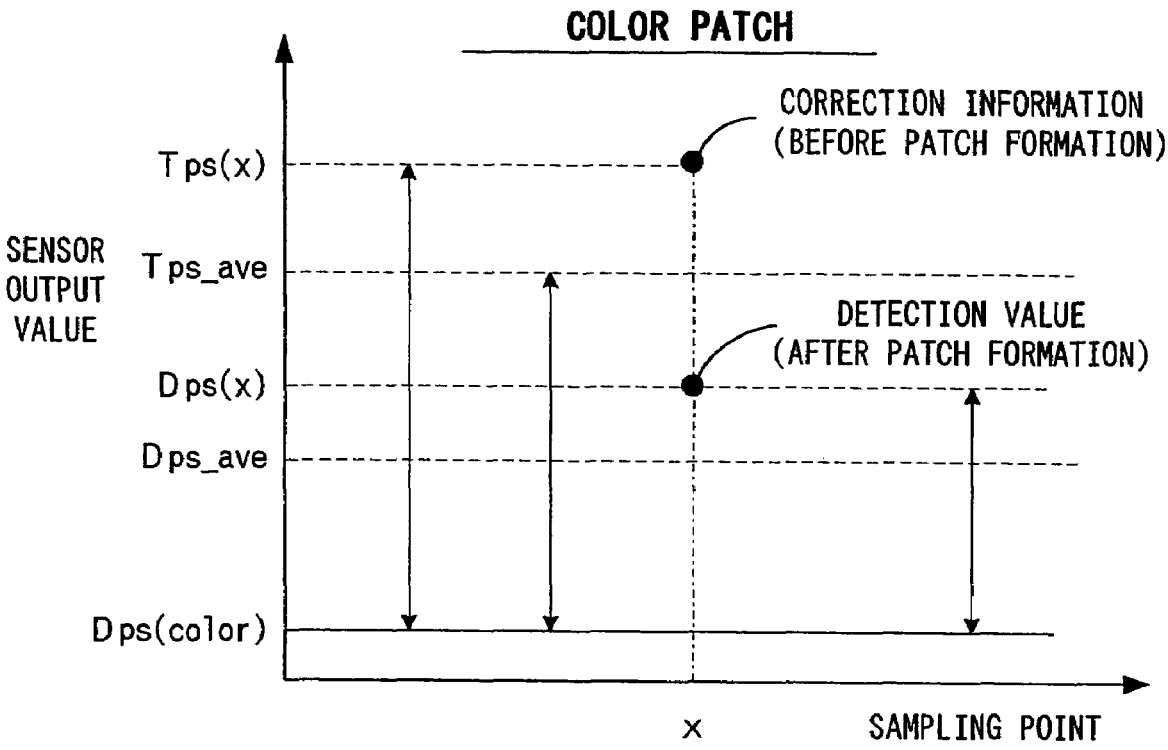
FIG. 45 is a graph representing the relation between the sensor output values before and after the formation of a patch image (toner image) of a color toner.

Where, on the other hand, Step S743 determines the patch image to be formed of a color toner, sensor output values Dp(x), Ds(x) are detected at a sampling point x corresponding to a surface area where the patch image is formed (Step S746). Thereafter, the following equation equivalent to the equation (4-2) is used to calculate a correction value Cps(x) (Step S747, see FIG. 45):

$$Cps(x)=Dps_ave=(Dps(x)-Dps(color))\times\{(Tps_ave-Dps(color))/(Tps(x)-Dps(color))\}+Dps(color) \quad (4\text{-}2B)$$

That is, the average sensor output value for the ps ratio {Tps_ave−Dps(color)}, the ps ratio value at the sampling point x {Tps(x)−Dps(color)} and the reference value Dps (color) are retrieved from the RAM 107. Along with the ps ratio Dps(x) between the sensor output values Dp(x) and Ds(x) thus detected, these values are substituted in the above equation (4-2B) such that the ps ratio is corrected to calculate the correction value Cps(x) (Correction-Value Calculation Step).

Such detecting operations (Steps S744, S746) and calculation operations (Steps S745, S747) are performed on all the patch images. That is, if Step S748 gives "YES", the control flow proceeds to Step S75 of FIG. 40 for calculating the image density of each patch image based on the correction values Cp(x), Cps(x). Based on these image densities, the optimum value of the density control factor is decided (Step S76: Density Deriving Step).

According to this embodiment as described above, the 3 types of profiles indicative of the surface conditions of the intermediate transfer belt 71 are previously stored as the correction information prior to the determination of the image density of the patch image (toner image) formed on the intermediate transfer belt 71. When the image density of the patch image is determined, the sensor output value detected by the density sensor 60 is not used as it is but is corrected based on the correction information. Therefore, the influence of the surface conditions of the intermediate transfer belt 71 is canceled out for measuring the image density of the patch image with high accuracy. This ensures that images are formed in consistent density based on the measurement results.

The above embodiment determines the image density of the patch image taking the degree of density thereof into account. Specifically, the correction information is corrected according to the degree of density of the patch image on the intermediate transfer belt 71, so that an even higher accuracy of the image density measurement can be attained. Furthermore, this embodiment provides 2 types of processes for determining the correction value, which include the process for determining the correction value Cp(x) by performing Steps S744, S745, and the process for determining the correction value Cps(x) by performing Steps S746, S747. Either of these processes may be selectively performed depending upon the color of the toner forming the patch image and hence, the optimum process for each toner color may be used for determining the image density of the patch image. This is advantageous in enhancing the accuracy of the image density measurement.

By the way, there may be a case where spike-like noises are superimposed on the output voltages Vp, Vs from the density sensor 60 described above, the spike-like noises caused by varied reflectivities by minor contamination or flaws on the roller 75 and intermediate transfer belt 71, electrical noises entering sensor circuits and the like. Therefore, it is desirable to perform the spike noise removal likewise to the first and third embodiments.

While Step S75 of FIG. 40 determines the density of the patch image per se based on the correction values Cp(x), Cps(x), the density value may be converted into an index value indicative of the density. For example, an evaluation value A indicative of the image density of a patch image of the black toner may be determined using the following equation:

$$\text{Evaluation value } A=1-Cp(x)/Tp_\text{ave};$$

whereas an evaluation value A indicative of the image density of a patch image of the color toner may be determined using the following equation:

$$\text{Evaluation value } A=1-\{Cps(x)-Dps(\text{color})\}/\{Tp_s_\text{ave}-Dps(\text{color})\}.$$

As a yardstick representing the amount of toner adhesion for each toner color, these evaluation values are determined by normalizing the detection values of the patch image based on the correction information indicative of the surface conditions of the intermediate transfer belt 71. Similarly to the image density, the evaluation value varies depending upon the toner character information and the working conditions of the apparatus (such as the usage conditions of the toner). However, the relation between the evaluation value and the image density under each condition can be empirically determined in advance and formulated into table to be stored. Therefore, the evaluation value is favorably used as the yardstick indicating the degree of image density corrected for the detection errors.

While the fourth embodiment determines the density of the patch image formed of the color toner based on the ratio between the p-polarized light and the s-polarized light, the density of the patch image may be determined from a difference between the p-polarized light and the s-polarized light. The method will be described with reference to FIGS. 46 to 48.

Prior to the transfer of a patch image to the intermediate transfer belt 71 equivalent to the "image carrier" of the present invention, Steps S71 to S73 are performed for acquiring information on the intermediate transfer belt 71 as correction information, just as in the fourth embodiment. It is noted, however, that the density of the color patch image is determined based on the difference between the p-polarized light and the s-polarized light, as will be described hereinlater and hence, the correction information is calculated according to an operation flow of FIG. 46.

Figure 46:
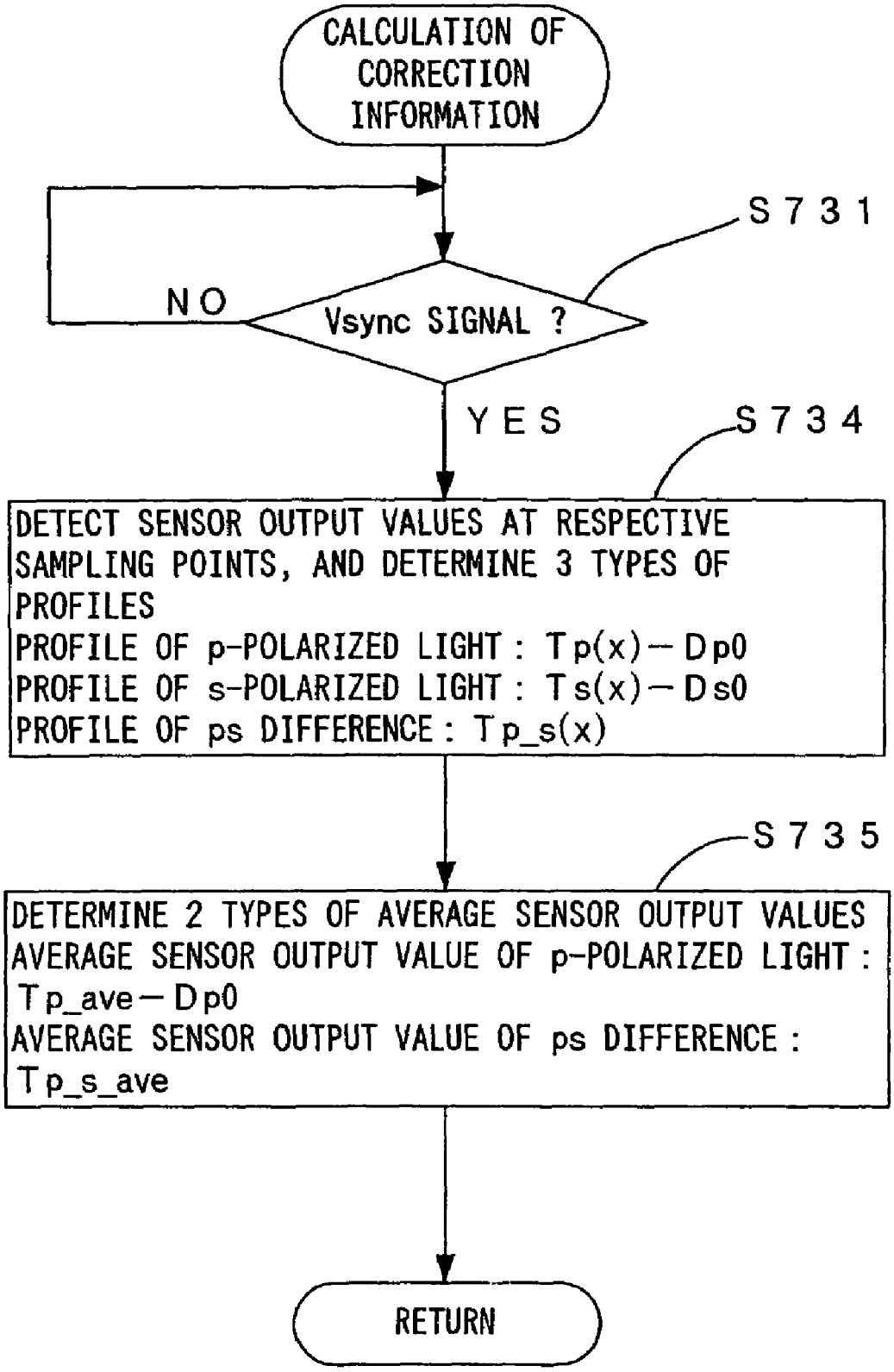
FIG. 46 is a flow chart representing the steps of a correction-information calculation process.

FIG. 46 is a flow chart representing the steps of a correction-information calculation process. In the correction-information calculation process, after the lapse of a predetermined period of time from the output of the vertical synchronizing signal Vsync (Step S731), sampling of sensor output values Tp(x), Ts(x) of the p-polarized light and s-polarized light is started to detect the sensor output values for one period of the intermediate transfer belt 71 prior to the patch-image formation thereby acquiring the following 3 types of profiles as the correction information, which are stored in the RAM 107 (Step S734):

Profile of p-polarized light: Tp(x)−Dp0

Profile of s-polarized light: Ts(x)−Ds0

Profile of ps difference: Tp_s(x)

The term Tp_s(x) means a difference between the p-polarized light and the s-polarized light at each sampling point (x), or is expressed as:

$$Tp_s(x)=Sg\times\{Tp(x)-Dp0\}-\{Ts(x)-Ds0\}$$

In this embodiment, as well, the respective gains of the amplifier circuits 673*p*, 673*s* are so defined as to provide an equal value of the respective sensor outputs at the maximum density of the color toner (FIG. 42). Therefore, in accordance with the variation of the image density, the sensor output value is also fluctuated in great degrees. As to the color toner, in particular, the ps difference Tp_s(x) is progressively decreased with increase of the image density.

In addition, respective average sensor output values of the p-polarized light and the ps difference are determined:

average sensor output value of p-polarized light: Tp_ave−Dp0, average sensor output value of ps difference: Tp_s_ave={Sg×Σ[Tp(x)−Dp0]−Σ[Ts(x)−Ds0]}/number of samples. The resultant average values are stored in the RAM 107 (Step S735).

Figure 47:
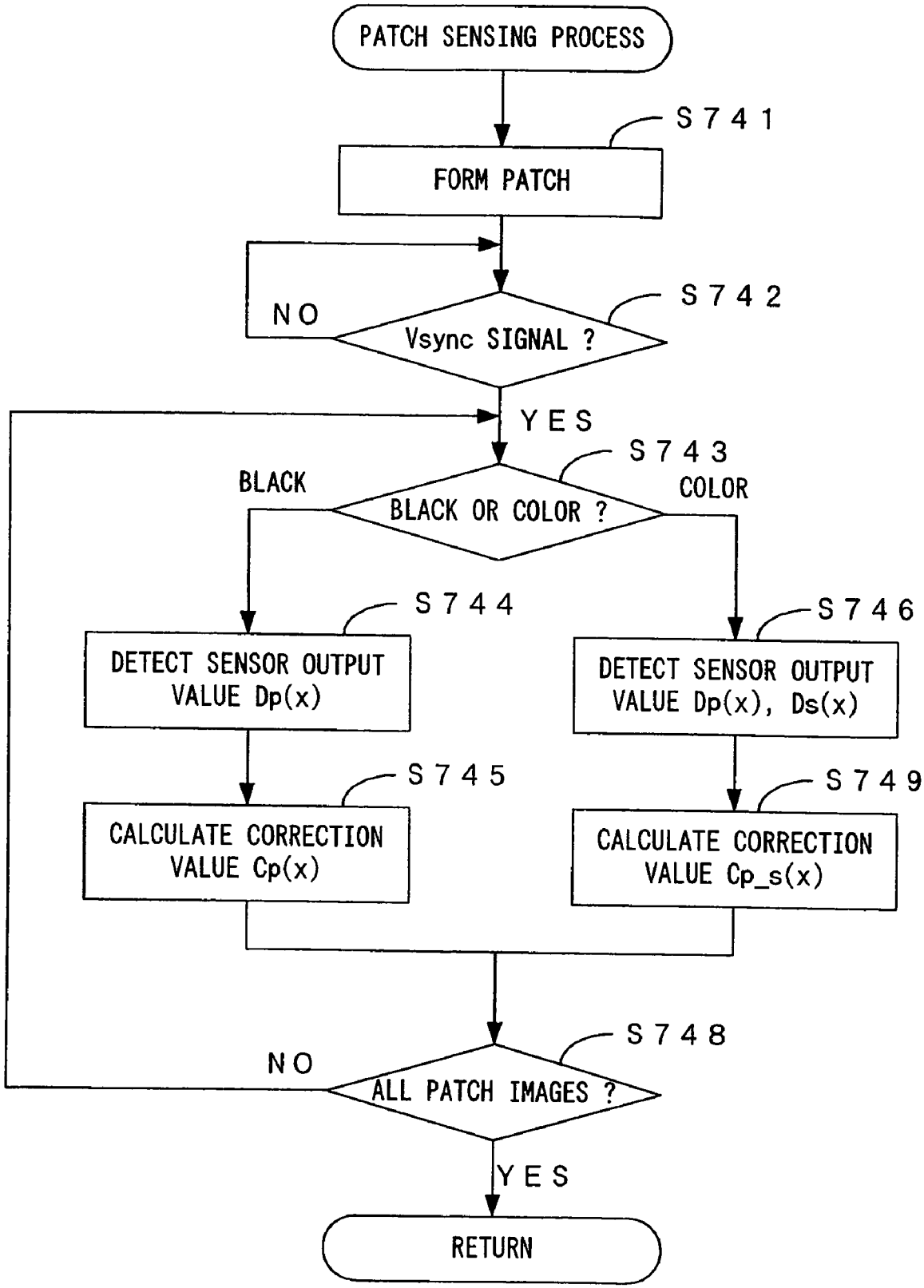
FIG. 47 is a flow chart representing the steps of a patch sensing process.
Figure 48:
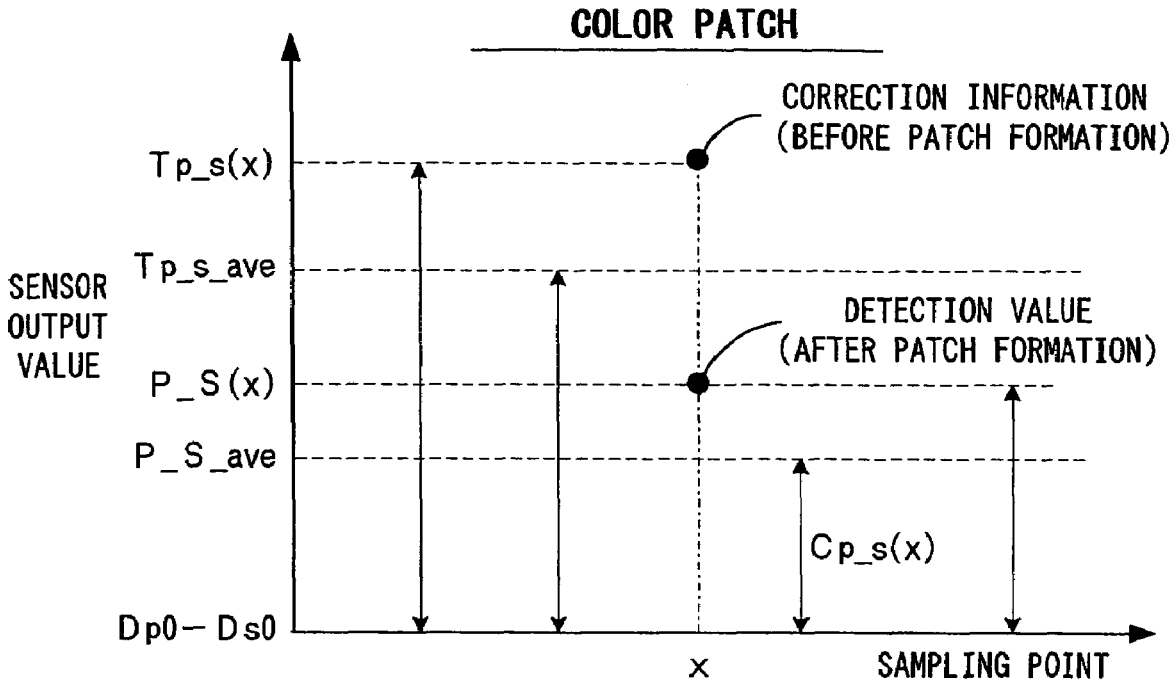
FIG. 48 is a graph representing the relation between the sensor output values before and after the formation of a patch image (toner image) of a color toner.

When the correction information is acquired in this manner, a patch sensing process illustrated in FIG. 47 is performed. FIG. 47 is a flow chart representing the steps of the patch sensing process. The patch sensing process performs the same steps as those of the patch sensing process of the fourth embodiment (FIG. 43), except for the calculation method for the correction value of the color. In Step S741, patch images are formed on the photosensitive member 2 while varying the density control factor stepwise and then, the resultant patch images are transferred onto the intermediate transfer belt 71. After the lapse of a predetermined period of time from the output of the vertical synchronizing signal Vsync (Step S742) and at delivery of a patch image of the black toner (K) to the sensing position of the density sensor 60, a sensor output value Dp(x) is detected at a sampling point x corresponding to a surface area where the patch image is formed (S744: Output Detection Step).

Thereafter, a correction value Cp(x) is calculated based on an equation equivalent to the equation (4-2) (Step S745, see FIG. 44):

$$Cp(x)=(Dp_ave-Dp0)=(Dp(x)-Dp0)\times\{(Tp_ave-Dp0)/[Tp(x)-Dp0]\} \quad (4\text{-}2A).$$

That is, the average sensor output value of the p-polarized light (Tp_ave−Dp0), the sensor output value at the sampling point x (Tp(x)−Dp0) and the dark output value Dp0 are retrieved from the RAM 107. Along with the sensor output value Dp(x) thus detected, these values are substituted in the above equation (4-2A) such that the sensor output value Dp(x) is corrected to calculate the correction value Cp(x) (Correction-Value Calculation Step).

When, on the other hand, a patch image formed of the black toner (K) is delivered to the sensing position of the density sensor 60, sensor output values Dp(x), Ds(x) are detected at a sampling point x corresponding to a surface area where the patch image is formed (Step S746). Thereafter, a correction value Cp_s(x) is calculated based on an equation equivalent to the equation (4-2) (Step S749, see FIG. 48):

$$Cp_s(x)=Dp_s_ave=Dp_s(x)\times(Tp_s_ave/Tp_s(x)) \quad (4\text{-}2C).$$

That is, the average sensor output value of the ps difference (Tp_s_ave) and the ps difference value at the sampling point x (Tps(x)) are retrieved from the RAM 107. Along with the ps difference Dp_s(x) between the sensor output values Dp(x) and Ds(x) thus detected, these values are substituted in the above equation (4-2C) such that the ps difference is corrected to calculate a correction value Cp_s(x) (Correction-Value Calculation Step).

Such detecting operations (Steps S744, S746) and calculation operations (Steps S745, S749) are performed on all the patch images. That is, if Step S748 gives "YES", the image density of each patch image is calculated based on the correction value Cp(x) or Cp_s(x). Based on the resultant image densities, the optimum value of the density control factor is decided.

Similarly to the fourth embodiment, the spike noise removal may preferably be carried out, or the density value may be converted into an index value indicative of the density.

FIFTH EMBODIMENT

In the image forming apparatus of the non-contact development system, the developing roller 44 and the photosensitive member 2 oppose each other via a gap. The size of the gap varies from apparatus to apparatus because of the manufacturing variations, deformation resulting from thermal expansion and the like. In one apparatus, the gap size delicately varies from place to place or with time. With such gap variations, the magnitude of the alternating current electric field for causing toner jump is also varied. This may result in significant variations of the image density of the toner image. In this connection, the inventors have made study on a patch processing technique suitable for the image forming apparatus of the non-contact development system.

Figure 49:
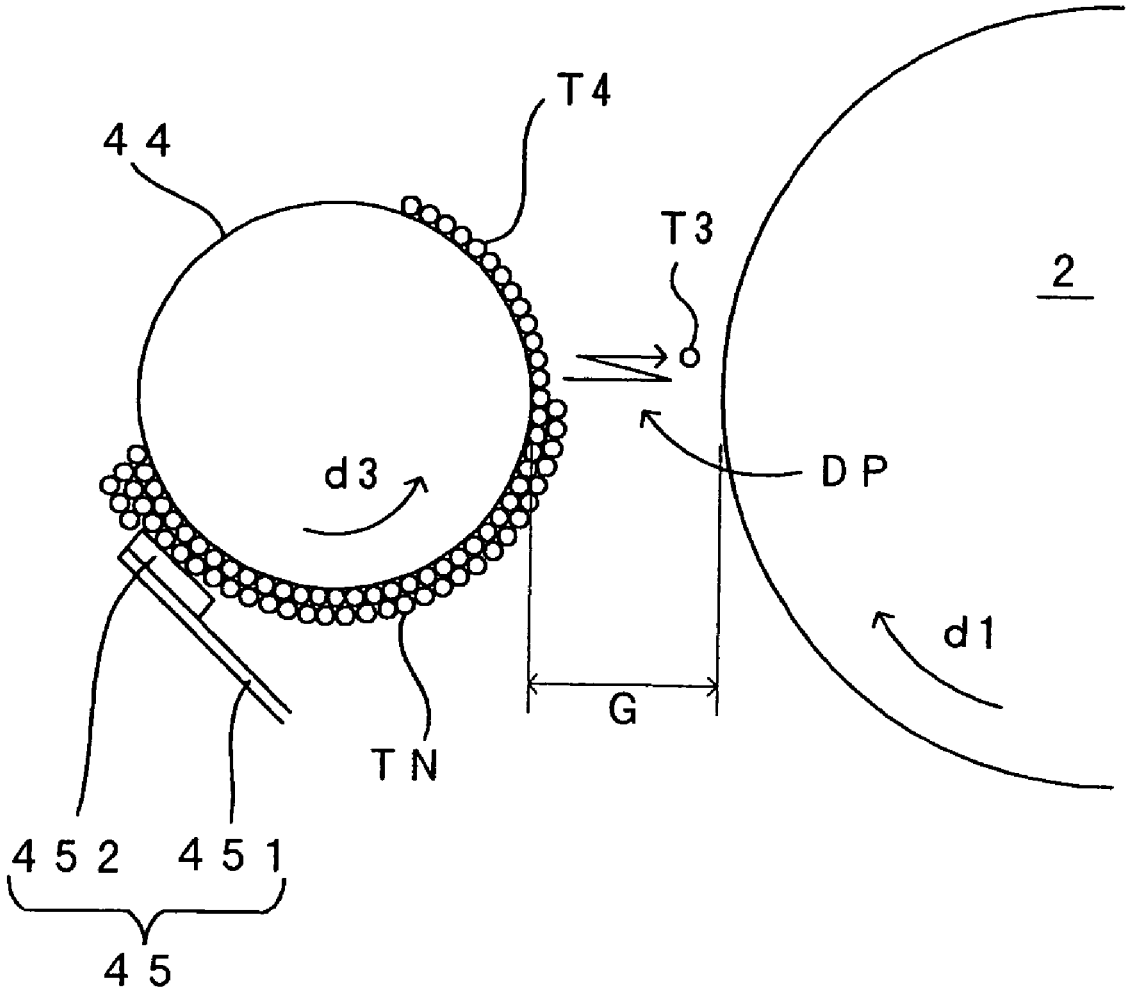
FIG. 49 is a diagram showing a development position in an image forming apparatus of a non-contact development system.
Figure 50A:
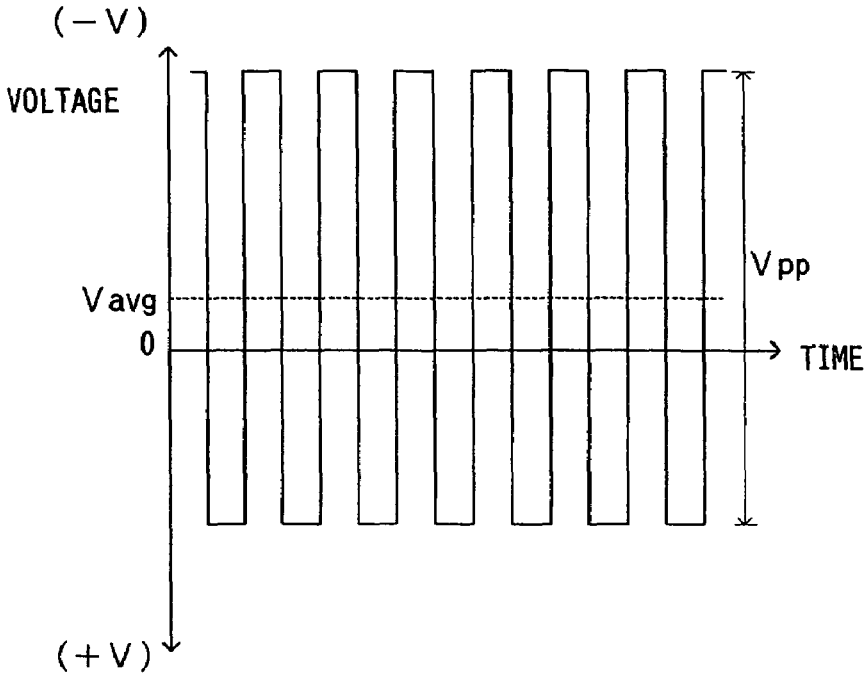
FIG. 50 are graphs each representing an example of the waveform of developing bias.

FIG. 49 is a diagram showing a development position in the image forming apparatus of the non-contact development system. FIG. 50 are graphs each representing an example of the waveform of the developing bias. In this apparatus, a developing roller 44 disposed in one of the developers (such as the yellow developer 4Y shown in FIG. 1) confronts the photosensitive member 2 via a gap G therebetween, the developer located in opposing relation with the photosensitive member 2. The developer controller 104 applies a developing bias to the developing roller 44. As shown in FIG. 50A, the developing bias is an alternating current voltage whose waveform is generated by superimposing a square-wave voltage having an amplitude Vpp upon a direct current component Vavg. As will be described hereinlater, the application of the developing bias having such a waveform permits the control of the amount of jumping toner based on the amplitude Vpp as well as the control of the image density based on the direct current component Vavg.

Figure 50B:
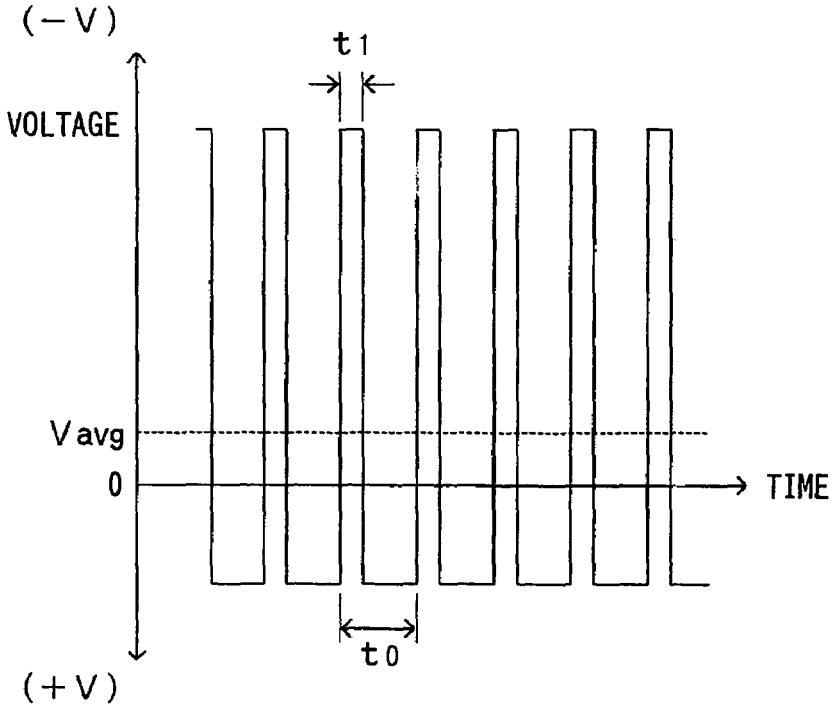

The waveform of the alternating current voltage as the developing bias is not limited to this. The developing bias may have a waveform generated by superimposing a sine or triangular wave upon the direct current component. Another example of the usable bias may have a duty ratio other than 50%, as shown in FIG. 50B. In this case, a weighted average voltage may be used as a direct current component Vavg, which is a value given by averaging instantaneous values of voltage waveforms of time-varying amplitude in a given range of time, and converting the resultant average value into a direct current voltage value.

The inventors have empirically found the following fact concerning this duty ratio of the developing bias in a direction to promote the toner adhesion to the photosensitive member 2. In the waveform of FIG. 50B, as the ratio (t1/t0) of a duty in a time period (character t1) of application of a negative voltage (a level on the upper side of the figure) versus one period (character t0) of the voltage wave is progressively decreased from 50%, the density of a fine-line image is accordingly increased. More specifically, where the duty ratio is varied with the amplitude Vpp of the developing bias maintained at a constant value and with the direct current component Vavg so adjusted as to provide a constant solid image density, the density of the fine-line image is dependent upon the duty ratio. That is, the lower the duty ratio, the higher the density of the fine-line image. On the other hand, where the jump performance of the toner is lowered due to the variations with time of the apparatus or deteriorated toner, the fine-line image is particularly susceptible to quality degradation. For continuous formation of the fine-line images of more stable image quality, the time period of application of the negative voltage may preferably be set to smaller than 50%. The duty ratio (t1/t0) of the developing bias may preferably in the range of 30 to 48%, or more preferably of 35 to 45%.

Returning to FIG. 49, when the alternating current voltage as the developing bias is applied to the developing roller 44, an alternating current electric field occurs at a development position DP defined between the developing roller 44 and the photosensitive member 2. Because of the effect of the electric field, a part of the toner TN borne on the developing roller 44 is liberated therefrom to jump to the development position DP where the toner particles are in reciprocating motion (character T3). The jumping toner particles are made to adhere to various parts of the photosensitive member 2 according to surface potentials thereat, thereby developing the electrostatic latent image on the photosensitive member 2 with toner.

Figure 51:
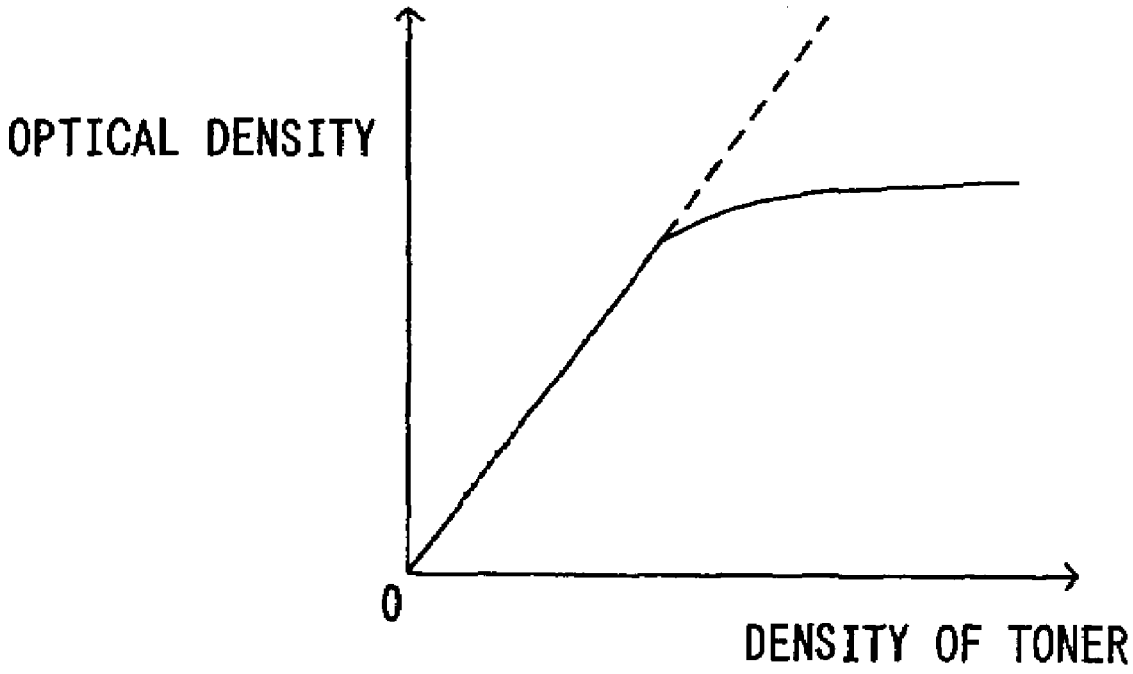
FIG. 51 is a graph representing the relation between the density of toner on the photosensitive member and the optical density.

In the aforementioned development process, a suitable range exists for the amount of toner to be projected to the development position DP. FIG. 51 is a graph representing the relation between the density of the toner on the photosensitive member 2 and the optical density of the toner image. As shown in FIG. 51, the optical density of the image may be increased by increasing the density of the toner forming the toner image. However, once the toner is densely adhered, the optical density is not much increased in spite of a further increase of the adhered toner, thus exhibiting a saturation characteristic in a region of high toner density as shown in FIG. 51. In other words, in such a high density of the adhered toner, somewhat increase or decrease of the amount of toner adhered to the photosensitive member 2 produce little change in the image density. Given that the density of the toner adhered to the photosensitive member 2 to form the toner image is dependent upon the amount of toner jumping to the development position DP, this characteristic suggests that once the amount of jump toner is increased to a degree, the resultant toner image suffers less density variations despite somewhat variations in the amount of jumping toner.

In the image forming apparatus of the non-contact development system, the image formation may preferably be performed under conditions to provide such an amount of jump toner as to reduce the image density variations, in the light of providing the toner image featuring less density variations and high image contrast. The reason is that while the apparatus of the non-contact development system inevitably encounters a degree of variations of the gap G for manufacture reasons, the variation of the image density associated with the gap variations can be reduced by this approach. However, an excessively increased amount of toner adhesion leads to an excessive toner consumption as well as to a fear of causing trouble in the transfer/fixing process to be described hereinlater. Hence, the upper limit of the amount of toner is defined by these requirements.

This embodiment adopts the following arrangements (1), (2) thereby ensuring the sufficient and required amount of jump toner and adjusting the image density by controlling the direct current developing bias and the exposure energy in a manner to be described hereinlater.

(1) The regulator blade 45 serves to regulate the toner layer over the developing roller 44 to a thickness that the toner particles are stacked substantially in double layers. Of the toner TN forming the toner layer, toner particles (character T4 in FIG. 49) in direct contact with the developing roller 44 are less prone to jump because of a strong mirror image force between the toner particles and the developing roller 44. Therefore, the toner particles are stacked substantially in the double layers such as to increase the amount of toner particles out of direct contact with the developing roller 44 and more prone to jump. The existence of the toner particles more prone to jump affords the following effects. That is, such toner particles permit a relatively small force to effect the toner jump from the developing roller 44. Furthermore, in the reciprocating motion according to the alternating current electric field, such toner particles impinge upon the toner T4 on the developing roller 44, thereby causing the toner T4 to jump. As a result, a sufficient amount of toner may be supplied to the development position DP.

(2) The amplitude Vpp of the developing bias is set to the highest possible value within a range that the electric discharge at the development position DP is not produced. While the image forming apparatus of the non-contact development system according to this embodiment is adapted to control the amount of jump toner by varying the magnitude of the electric field produced at the development position DP, the magnitude of the electric field is also fluctuated by the variation of the gap G (FIG. 49). Hence, the amplitude Vpp of the alternating current voltage is set to the highest possible value thereby ensuring that a sufficient amount of toner may be projected despite a decreased electric field due to an increased gap G. However, if the voltage is too high, the electric discharge occurs between the developing roller 44 and the photosensitive member 2, resulting in a seriously degraded image quality. Therefore, the voltage must be set in such a magnitude as not to cause the electric discharge. According to this third embodiment, a design central value for the gap G is 150 μm. On assumption that a gap formed between the developing roller 44 and the photosensitive member 2 closest to each other is 80 μm, the amplitude Vpp of the developing bias is set to 1500V, whereas the frequency thereof is set to 3 kHz. The duty ratio of the developing bias is set to 40%.

Figure 52:
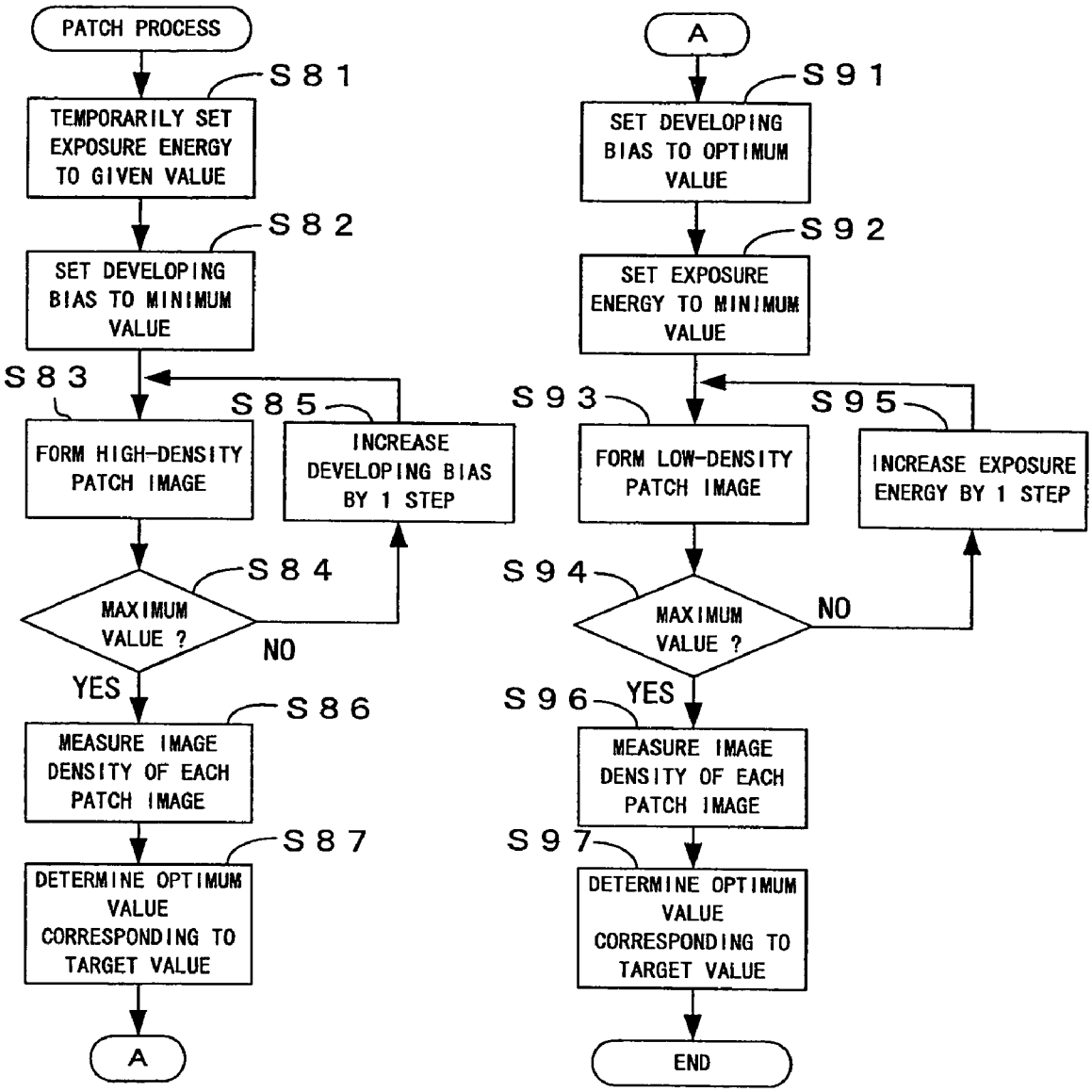
FIG. 52 is a flow chart representing the steps of a patch process performed by an image forming apparatus according to a fifth embodiment of the present invention.

In order to ensure the stable formation of toner images of good image quality, the image forming apparatus of this fifth embodiment performs the patch process at a suitable time like when the apparatus is energized, the patch process wherein a predetermined patch image is formed and image forming conditions are optimized based on the image density of the patch image. Specifically, the CPU 101 of the engine controller 10 executes a previously stored program for carrying out operations shown in FIG. 52 for each of the toner colors. FIG. 52 is a flow chart representing the steps of the patch process performed by this image forming apparatus. The summary of the patch process is as follows.

Processings shown on the left-hand side of FIG. 52 are performed as follows. A per-unit-area energy E of the exposure light beam L (hereinafter, simply referred to as "exposure energy") is temporarily set to a given value say a central value of its variable range (Step S81). In this state, each solid image, as a high-density patch image, for example, is formed under each different bias condition set by varying the direct current component Vavg of the developing bias (hereinafter, referred to as "direct current developing bias") each time (Steps S82 to S85). Then, the image densities of the patch images thus formed are detected by means of the density sensor 60 (Step S86) so as to find a bias value providing a density substantially equal to a predetermined target value, or an optical density OD=1.3 according to this embodiment. The bias value thus found is determined to be the optimum developing bias.

Subsequently, processings shown on the right-hand side of FIG. 52 are performed. Specifically, the direct current developing bias Vavg is set to the previously determined optimum developing bias (Step S91). As a low-density patch image, a fine-line image consisting of a plurality of 1-dot lines spaced away from one another like a pattern that one line is ON and ten lines are OFF, for example, is formed under each different energy condition set by varying the exposure energy E each time (Steps S92 to S95). Then, the image densities of the patch images thus formed are detected by means of the density sensor 60 (Step S96) so as to find an exposure energy providing a density substantially equal to a predetermined target value, or an optical density OD=0.22 according to this embodiment. The exposure energy value thus found is determined to be the optimum exposure energy.

Figures 53A, 53B:
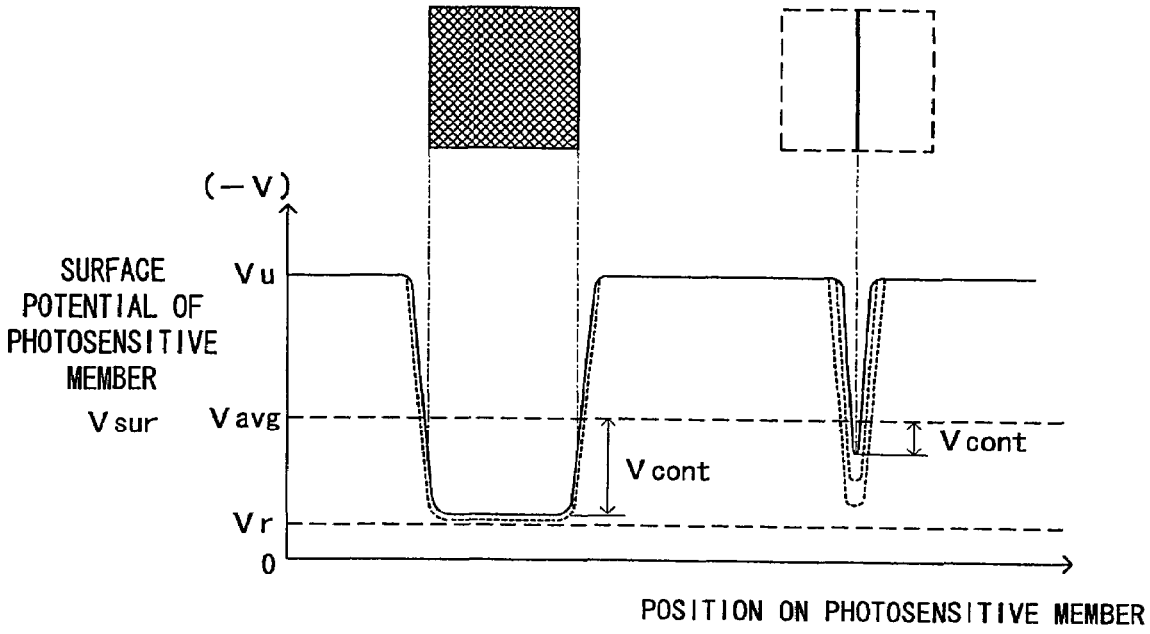
FIG. 53 are graphs showing exemplary surface potential profiles of a photosensitive member on which electrostatic latent images individually corresponding to a solid image and a fine-line image are formed.

The reason for performing the process in this manner is described with reference to FIG. 53. FIG. 53 are graphs showing exemplary surface potential profiles of a photosensitive member 2 on which electrostatic latent images individually corresponding to a solid image and a fine-line image are formed. When the photosensitive member 2 uniformly charged to a given surface potential Vu is partially exposed to the light beam L, the charge at the exposed portion is neutralized so that an electrostatic latent image is formed on the surface of the photosensitive member 2. A surface potential for high-density image like a solid image assumes a well-like profile whose bottom is lowered nearly to a residual potential Vr dependent upon the characteristics of the photosensitive member 2, because a relatively large area of the surface of the photosensitive member 2 is exposed to the light. On the other hand, a surface potential Vsur for low-density image like a fine-line image assumes a sharp dip-like profile because a narrow surface area is exposed to the light. While the figure illustrates the low-density image of a single line, the same holds for an image including plural lines in spaced relation.

When the electrostatic latent image of such a potential profile is delivered to the development position DP opposite the developing roller 44 bearing the toner thereon, the toner particles reciprocally jumping at the development position DP become adhered to either the developing roller 44 or the photosensitive member 2 according to direct current potentials at the portions thereof. At this time, the greater the difference between the potential of the direct current developing bias Vavg and the surface potential Vsur of the photosensitive member 2, the more promoted the toner transfer from the developing roller 44 to the photosensitive member 2. Thus, the greater the potential difference or the contrast potential Vcont, the higher the density of the toner adhered to the photosensitive member 2 and hence, the image density is increased accordingly.

Now, consider a case where the exposure energy is varied. As indicated by dot lines in FIG. 53, the surface potential profile for the solid image has a small variation, whereas the profile for the fine-line image is notably varied in the depth and/or the width of the dip. Thus, the exposure energy has a small influence on the potential profile for the electrostatic latent image of the solid image but a significant influence on the potential profile for the electrostatic latent image of the fine-line image. As to the density of the developed toner image, therefore, the exposure energy E produces small density variations in the solid image but greater density variations in the fine-line image.

Where the direct current developing bias Vavg is varied, on the other hand, the contrast potential Vcont is varied so that both the solid image and the fine-line image are varied in the image density to large degrees.

Thus, these two parameters, the direct current developing bias Vavg and the exposure energy E, affect differently the respective image densities of the solid image and the fine-line image. That is, the image density of the fine-line image is significantly affected by both the direct current developing bias Vavg and the exposure energy E, whereas the image density of the solid image is significantly varied by the direct current developing bias Vavg but not so much by the exposure energy E.

Figure 54:
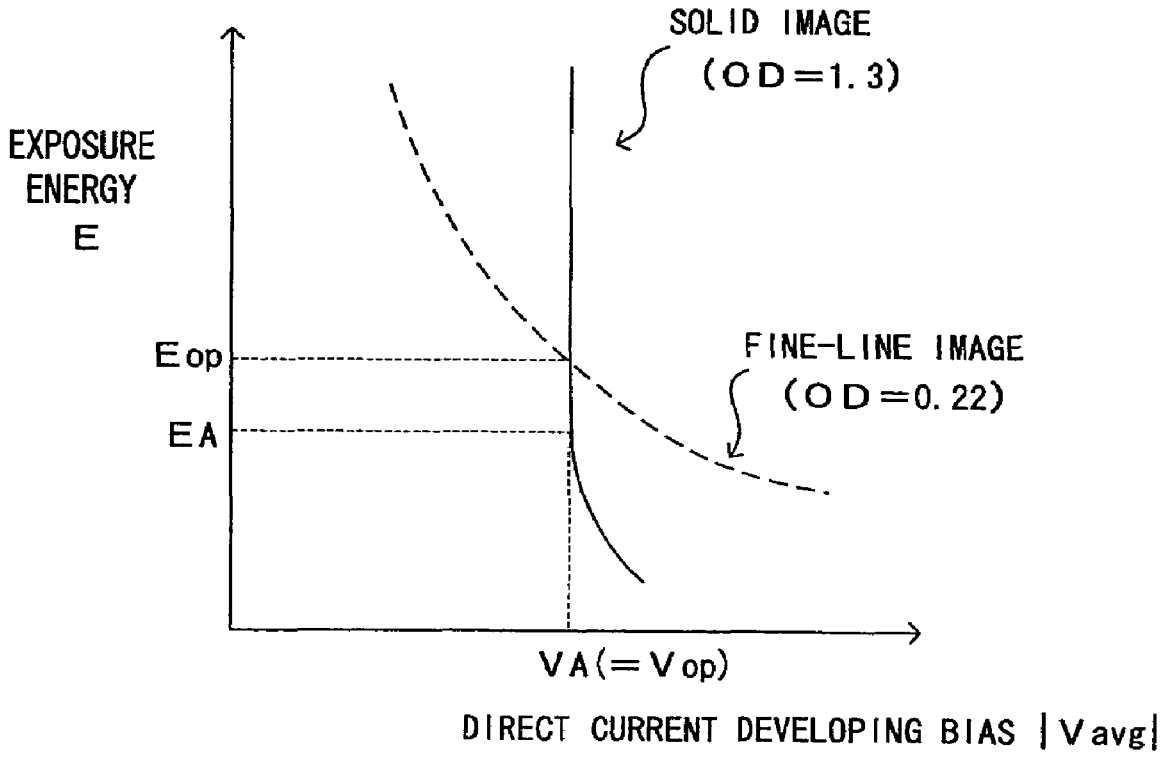
FIG. 54 is a graph representing respective equidensity curves of the solid image and the fine-line image.

A more detailed description is made on this fact with reference to FIG. 54. FIG. 54 is a graph representing respective equidensity curves of a solid image and a fine-line image. More specifically, a solid image or a fine-line image is formed with a combination (Vavg, E) of the direct current developing bias Vavg and the exposure energy E varied each time. The graph shows each combination that provides an image density equal to each target density (OD=1.3, OD=0.22) of the solid image and the fine-line image.

Since the exposure energy E has a minor influence on the density of the solid image, as described above, the equidensity curve representing the optical density OD=1.3 of the solid image has a gradient approximate to the vertical, as indicated by a solid line in FIG. 54, which has the following meaning. When the combination (Vavg, E) of the direct current developing bias Vavg and the exposure energy E is on this curve, the solid image can always attain the target value OD=1.3 if it is formed under such conditions. Since the gradient of the curve is substantially vertical in a region of the exposure energy of EA or more as shown in FIG. 54, the solid image of the target density can be obtained at any value of the exposure energy E in this region, provided that the direct current developing bias Vavg is set to a potential VA shown in the figure. It is noted that the equidensity curve is curved at exposure energy values of EA or less because the surface potential Vsur of the photosensitive member 2 is not sufficiently lowered to the residual potential Vr by the irradiation of light of such a low energy and hence, the depth of the latent image is varied depending upon the magnitude of the energy.

Under the condition of the exposure energy E of EA or more (this embodiment defines the central value in its variable range to be higher than EA), solid images as the high-density patch images are formed at different direct current developing biases Vavg so as to determine a bias potential VA such as to provide a density equal to the target value (OD=1.3). Thus is determined the optimum value of the direct current developing bias Vavg for providing a solid image of a desired image density. In the solid image, the exposure energy E may take an arbitrary value that is not smaller than EA, as described above.

In contrast, the image density of the fine-line image is varied by both the exposure energy E and the direct current developing bias Vavg and hence, the equidensity curve therefor is inclined downward toward the right as indicated by a broken line in FIG. 54.

In order to achieve the target image densities of both the solid image and fine-line image, the direct current developing bias Vavg and the exposure energy E may be combined to have values corresponding to an intersection of these two curves in FIG. 54. As apparent from the equidensity curve for the solid image having substantially the vertical gradient, the value of the direct current developing bias Vavg corresponding to the intersection is substantially equal to the already determined value as the bias potential VA providing the solid image of the target density. That is, this indicates that the previously determined optimum direct current developing bias VA for the solid image is also an optimum developing bias Vop permitting this apparatus to achieve the target density of the fine-line image. Therefore, using the direct current developing bias Vavg at the optimum value Vop, fine-line images as the low-density patch images may be formed at different exposure energies E to determine such an exposure energy Eop as to provide the target value (OD=0.22). Thus, image forming conditions (Vop, Eop) for satisfying both the target densities of the solid image and fine-line image can be determined.

When the variable ranges of the direct current developing bias Vavg and the exposure energy E are decided, consideration is given to that the desired image densities of both the solid image and fine-line image can be attained in the range of practicable combinations. In addition, the following points are also taken into consideration.

Where the contrast potential (Vcont shown in FIG. 53) is set to an excessively high or low value to obtain a desired image density, the degradation of image quality may result, which is associated with image blur (where the contrast potential Vcont is too high, a solid image-formed in a size of say 1 square centimeter sustains scattered toner therearound), image deformation (where the contrast potential Vcont is too low, a solid image to be formed in a shape of say 1 square centimeter is deformed into a lozenge shape), and the like. Furthermore, the residual potential Vr of the photosensitive member 2 has variations associated with temperature or the manufacturing variations and hence, the variable range of the direct current developing bias Vavg need be so defined as to limit the contrast potential Vcont in a predetermined range as accommodating the variations of the photosensitive member 2. This embodiment defines the variable range of the direct current developing bias Vavg to range from (−110V) to (−330V).

According to the findings obtained by the inventors, the image quality is also affected by a difference between a surface potential Vu at an un-exposed area (non-image area) of the surface of the photosensitive member 2 and the direct current developing bias Vavg. Where this potential difference is increased, for example, an increased toner fog on the non-image area or a lowered reproducibility of a discrete dot line may result. Where this potential difference is decreased, on the other hand, scumming is likely to occur. Therefore, this embodiment varies the charging bias from the charging controller (FIG. 2) in conjunction with the change of the direct current developing bias Vavg, thereby maintaining the potential difference therebetween (|Vu|−|Vavg|) at a constant value (350V).

While the exposure energy E produces a minor variation of the depth of the electrostatic latent image for the solid image, it does not cause no variation thereof at all. Therefore, if the variable range of the exposure energy E is too broad, the variations of the exposure energy E will lead to the variations of the density of the solid image, resulting in difficulty in finding the optimum image forming conditions. In order to limit the density variations of the solid image associated with the varied exposure energy E to an insignificant degree, the variable range of the exposure energy E may be defined in a manner that the variation of the surface potential at a solid-image area of the electrostatic latent image is limited in the range of 20 V or less, or more preferably of 10V or less when the exposure energy E is varied from the minimum value to the maximum value of its variable range.

As a matter of course, these values are decided according to the arrangement of this embodiment and should be properly changed according to the arrangement of an apparatus.

According to this embodiment, as described above, the toner layer borne on the developing roller 44 is formed in a thickness that the toner particles are stacked in more than 1 layer in order to promote the toner jump, whereas the amplitude Vpp of the developing bias is set to the maximum allowable value for previously projecting a sufficient amount of toner to the development position DP. Then, the image density is adjusted by controlling the two parameters (direct current developing bias Vavg, exposure energy E) constituting the image forming conditions.

In the optimization of these parameters, the exposure energy E is temporarily set to a given value while the solid images as the high-density patch images are formed at different direct current developing biases Vavg. Based on the resultant image densities, the optimum value Vop of the direct current developing bias is determined. Then, using the optimum direct current developing bias Vop thus determined, the fine-line images as the low-density patch images are formed at different exposure energies E. Then, based on the resultant image densities, the optimum value Eop of the exposure energy is determined.

Thus, the image forming apparatus of this embodiment uses relatively simple processes for discretely determining the optimum value of each of the parameters in a positive manner. By performing the image formation under the image forming conditions thus optimized, the apparatus can form the toner images of good image quality in a stable manner.

SIXTH EMBODIMENT

Figure 55:
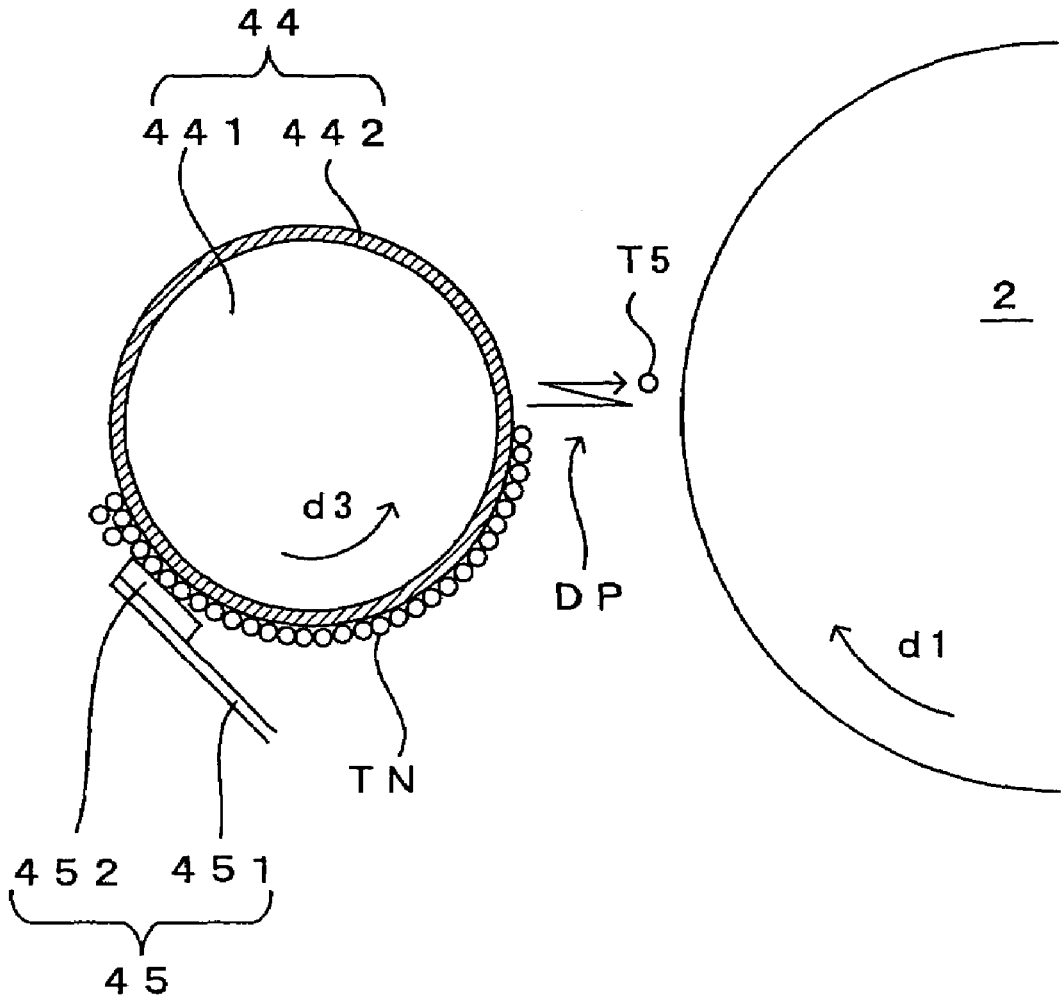
FIG. 55 is a diagram showing an image forming apparatus according to a sixth embodiment of the present invention.

Next, description is made on an image forming apparatus according to a sixth embodiment of the present invention. In the apparatus of this embodiment, the construction of a developer is partially different from that of the fifth embodiment. The constructions and operations of the other parts are the same as those of the fifth embodiment and hence, the description thereof is dispensed with. FIG. 55 is a diagram showing the image forming apparatus of this embodiment. According to this embodiment, the developing roller 44 comprises a metal roller 441 and a resistance layer 442 overlaid on the surface of the roller. The resistance layer 442 is equivalent to "surface layer" of the present invention and is formed of, for example, a resin layer with conductive powder dispersed therein. Usable as the conductive powder are metal powder such as of aluminum, carbon black and the like, whereas usable as the resin layer are phenol, urea, melamine, polyurethane, nylon and the like. The resistance layer 442 may preferably have a specific resistance of $10^4$ Ωcm or more.

The provision of the resistance layer 442 prevents the direct contact between the toner TN and the metal roller 441, thereby reducing the mirror image force on the toner TN such that the toner is improved in the jump performance from the developing roller 44. Therefore, as shown in FIG. 55, the regulator blade 45 limits the thickness of the toner layer over the developing roller 44 substantially to that of a single-particle layer. This is because by virtue of the provision of the resistance layer 442, even a toner T5 in direct contact with the developing roller 44 is prone to jump, as shown in FIG. 55. As a result, even though a smaller amount of toner is delivered to the development position DP, a sufficient amount of toner can be projected to the development position DP.

In the apparatus of such an arrangement, the same process (FIG. 52) as in the apparatus of the first embodiment may be performed thereby discretely determining the respective optimum values of the direct current developing bias Vavg and the exposure energy E in an easy way. Then, the image formation may be carried out under the image forming conditions thus optimized so as to form the toner image of good image quality in a stable manner.

Although using different methods, the aforementioned apparatuses of the fifth and sixth embodiments are arranged to increase the amount of jump toner to the development position DP and hence, the aforementioned patch processing technique may favorably be applied thereto. This technique is also effective in an apparatus using another method for increasing the amount of jump toner. Various other methods than the above may be contemplated for increasing the amount of jump toner.

Where titanium oxide is used as an external additive to the toner, for example, a so-called intermolecular force acting between the toner particles and the surface of the developing roller 44 can be effectively reduced. As a result, the toner is improved in the jump performance. On the other hand, toner fluidity may be used as indication of the evaluation of the magnitude of the intermolecular force between the toner and the developing roller 44. As the fluidity of the toner increases, the intermolecular force can be correspondingly decreased. A usable toner according to the present invention may preferably have a fluidity in terms of angle of repose of 25° or less. Furthermore, the fluidity of the toner depends upon the coverage ratio of the external additive based on the toner mother particles. The intermolecular force may be decreased by adjusting the coverage ratio to 1 or more, thereby increasing the fluidity of the toner. The coverage ratio of the external additive is defined by the following equation:

$$(\text{Coverage ratio})=(D\cdot\rho 1\cdot w)/(d\cdot\rho 2\cdot W\cdot\pi) \quad (6\text{-}1)$$

In the above equation, D and d denote the respective volume mean diameters of the toner mother particles and the external additive; ρ1 and ρ2 denote the respective true specific gravities of the toner mother particles and the external additive; W and w denote the respective masses of the toner mother particles and the external additive; and π denotes a circular constant.

Given the same amount of charge, the smaller the particle size, the greater the mirror image force. For decreased mirror image force, therefore, it is also effective to use toner of a relatively large particle size. The inventors have empirically found that the use of toner having a volume mean diameter of 8 μm or more ensures the adequate amount of jump toner.

According to the foregoing fifth and sixth embodiments, the exposure energy E is temporarily set to the central value of its variable range during the formation of the patch images used for determination of the optimum value of the direct current developing bias Vavg. The value of the exposure energy in this step is not limited to this and may be any value. It is noted, however, that an excessively high exposure energy leads to an increased amount of toner adhered to the latent image and an increased toner consumption results. Where, on the other hand, the exposure energy is too low, not only the density of the fine-line image but also the density of the solid image are varied (depending upon the exposure energy, resulting in the difficulty of accurately determining the optimum image forming conditions. Therefore, the exposure energy in this process may preferably be at a value equal to or higher than that indicated by the character EA in FIG. 54 but not by too much.

<Others>

It is noted that the present invention is not limited to the foregoing embodiments and various changes and modifications may be made thereto so long as they do not deviate from the effects of the present invention. The following arrangements may be made, for example.

The foregoing embodiments use the solid image as the high-density patch image and as the low-density patch image, the fine-line image including a plurality of 1-dot lines spaced away from one another. The images usable as the patch images are not limited to these and may include those of other patterns. These should be properly changed according to the characteristics of a used toner, the sensitivity of a density sensor or the like. The target densities of the patch images should not be limited to the above values and may be changed as required.

While the foregoing embodiments apply the present invention to the image forming apparatuses using the intermediate transfer belt 71 as the "image carrier" of the present invention, the object of the application of the present invention should not be limited to this. The present invention is also applicable to, for example, an image forming apparatus employing a transfer drum as the image carrier, an image forming apparatus adapted to measure the image density of the patch image formed on the photosensitive member, and the like. The present invention may be applied to the all types of image forming apparatuses and methods designed to determine the image density of the toner image formed on the image carrier such as the photosensitive member and the transfer medium.

According to the foregoing embodiments, the image forming apparatuses can form the color image using toners of four colors. However, the object of the application of the present invention should not be limited to this. As a matter of course, the present invention is also applicable to image forming apparatuses designed to form only monochromatic images. While the image forming apparatuses of the foregoing embodiments are printers adapted to form an image supplied from the external device, such as the host computer, on the sheet S such as a copy paper, a transfer paper, a paper and a transparent sheet for an overhead projector, the present invention is applicable to the all types of image forming apparatuses of electrophotographic system such as copying machines and facsimiles.

INDUSTRIAL APPLICABILITY

As described above, the present invention is applicable to the image forming apparatuses of the electrophotographic system such as printers, copying machines and facsimiles and is adapted to stabilize the image density by adjusting the density control factors affecting the image density, thereby achieving the improved image quality.

What is claimed is:

1. An image forming apparatus comprising:

a density sensor irradiating light on an image carrier, receiving light reflected therefrom and outputting a signal based on an amount of received light therefrom; and control means which previously stores correction information indicative of a surface condition of the image carrier prior to the formation of a toner image on the image carrier, and which when determining a density of the toner image formed on the image carrier, corrects the output from the density sensor based on the correction information and then determines the density of the toner image based on the correction value, wherein the control means corrects the correction information according to a degree of the density of the toner image on the image carrier, wherein the control means derives the correction information based on the signal outputted from the density sensor prior to the formation of the toner image on the image carrier and stores the correction information in a storage section, wherein the control means determines the correction information by taking the steps of canceling some sample data pieces of higher order and/or of lower order out of the sample data pieces constituting the signals outputted from the density sensor prior to the formation of the toner image on the image carrier, and replacing each of the canceled data pieces with an average value of the remaining sample data pieces.

2. An image forming apparatus comprising:

a density sensor irradiating light on an image carrier, receiving light reflected therefrom and outputting a signal based on an amount of received light therefrom; and a control means which previously stores correction information indicative of a surface condition of the image carrier prior to the formation of a toner image on the image carrier, and which when determining a density of the toner image formed on the image carrier, corrects the output value from the density sensor based on the correction information and then determines the density of the toner image based on the corrected value, wherein the control means corrects the correction information according to a degree of the density of the toner image on the image carrier, wherein the control means progressively decreases the amount of correction based on the correction information as the density of the toner image is increased.

3. An image forming method comprising:

a density sensing step including irradiating light by a density sensor on an image carrier, receiving reflected ight therefrom and outputting a signal based on an amount of received light therefrom; and a control step including previously storing correction information indicative of a surface condition of the image carrier prior to the formation of a toner image on the imege carrier, and correcting, when determining a density of the toner image formed on the image carrier, the output of the signal outputted in the density sensing step based on the correction information and then determining the density of the toner image based on the correction value, wherein the correction information is corrected according to a degree of the density of the toner image on the carrier, wherein the correction information is derived based on the signal outputted in the density sensing step prior to the formation of the toner image on the image carrier and the correction information is stored, wherein the correction is determined by taking the steps of canceling some sample data pieces of higher order and/or of lower order out of the sample data pieces constituting the signals outputted in the density sensing step prior to the formation of the toner image on the image carrier, and replacing each of the canceled data pieces with an average value of the remaining sample data pieces.

4. An image forming method comprising:

a correction information detecting step performed prior to the formation of a toner image on an image carrier, for obtaining a detection value T(x) by irradiating light on each of plural surface areas x (x=x1, x2, . . . ) of the image carrier, receiving light therefrom and detecting a value related to the amount of received light therefrom;

an output detecting step of irradiating light on a toner image formed on the surface area x1 of the image carrier to receive light from the toner image and detecting a value D(x1) related to the amount of received light therefrom;

a correction value calculating step of correcting the detection value D(x1) based on the following equation thereby to obtain a correction value C(x1):

$$C(x1)=D(x1)\times\{Tave/T(x1)\}$$

where Tave denotes an average value of the detection values T(x); and a density deriving step of determining a density of the toner image based on the correction value C(x1).

5. An image forming method wherein a density of a toner image formed on an image carrier is detected by a density sensor including a light emitter element for irradiating light on the image carrier and a light receiver element for receiving light reflected from the image carrier, the method comprising:

a reference-value detecting step for determining a reference value DO related to the amount of light received by the light receiver element;

a correction information detecting step performed prior to the formation of the toner image on the image carrier for obtaining a detection value T(x) by irradiating light on each of plural surface areas x (x=x1, x2, . . . ) of the image carrier, receiving light therefrom and detecting a value related to the amount of received light therefrom;

an output detecting step of irradiating light on the toner image formed on the surface area x1 of the image carrier, receiving light from the toner image and detecting a value D(x1) related to the amount of received light therefrom;

a correction value calculating step of correcting the detection value D(x1) based on the following equation thereby to obtain a correction value C(x1):

$$C(x1)=\{D(x1)-DO\}\times\{(Tave-DO)/(T(x1)-DO)\}$$

where Tave denotes an average value of the detection values T(x); and a density deriving step of determining a density of the toner image based on the correction value C(x1).

6. An image forming method according to claim 5, wherein the correction information detecting step comprises:

a sub-step performed prior to the formation of the toner image on the image carrier of irradiating light on each of the plural surface areas x (x=x1, x2, . . . ) of the image carrier, receiving light therefrom and outputting a signal according to the amount of received light therefrom; and a sub-step of obtaining the detection value T(x) by canceling some sample data pieces of higher order and/or of lower order out of the sample data pieces constituting the outputted signals, and replacing each of the canceled data pieces with an average value of the remaining sample data pieces.

7. An image forming apparatus comprising:

a density sensor irradiating light on an image carrier, receiving light reflected therefrom and outputting a signal based on an amount of received light therefrom; and a control means which previously stores correction information indicative of a surface condition of the image carrier prior to the formation of a toner image on the image carrier, and which when determining a density of the toner image formed on the image carrier, corrects the output value from the density sensor based on the correction information and then determines the density of the toner image based on the corrected value, wherein the control means corrects an amount of the correction based on the correction information according to a degree of the density of the toner image on the image carrier.

8. An image forming apparatus according to claim 7, wherein the control means progressively decreases the amount of correction based on the correction information as the density of the toner image is increased.

* * * * *